US011673402B2

(12) United States Patent
Hirai et al.

(10) Patent No.: US 11,673,402 B2
(45) Date of Patent: Jun. 13, 2023

(54) LIQUID EJECTING APPARATUS AND METHOD FOR CONTROLLING LIQUID EJECTING APPARATUS

(71) Applicant: Seiko Epson Corporation, Tokyo (JP)

(72) Inventors: Yasuaki Hirai, Shiojiri (JP); Shigenori Fukasawa, Shiojiri (JP); Mitsuhiro Koseki, Chino (JP); Masato Haga, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/468,216

(22) Filed: Sep. 7, 2021

(65) Prior Publication Data

US 2022/0072865 A1 Mar. 10, 2022

(30) Foreign Application Priority Data

Sep. 9, 2020 (JP) ..... JP2020-151172

(51) Int. Cl.
*B41J 2/175* (2006.01)

(52) U.S. Cl.
CPC ..... *B41J 2/17566* (2013.01); *B41J 2/17509* (2013.01)

(58) Field of Classification Search
CPC .... B41J 2/175; B41J 2/17509; B41J 2/17513; B41J 2/1752; B41J 2/17523; B41J 2/17546; B41J 2/17553; B41J 2/17556; B41J 2/17566; B41J 29/02; B41J 29/13; B41J 2002/17516; B41J 2002/17569
See application file for complete search history.

(56) References Cited

U.S. PATENT DOCUMENTS

| | | | |
|---|---|---|---|
| 2018/0056652 A1 | 3/2018 | Maruyama et al. | |
| 2018/0093491 A1 | 4/2018 | Murayama et al. | |

FOREIGN PATENT DOCUMENTS

| | | | | |
|---|---|---|---|---|
| JP | 2002-200767 | | 7/2002 | |
| JP | 2010-094847 | | 4/2010 | |
| JP | 2015066485 | * | 4/2015 | ..... B05C 11/10 |
| JP | 6264811 | * | 1/2018 | ..... B05C 11/10 |
| JP | 2018-034335 | | 3/2018 | |
| JP | 2018-058255 | | 4/2018 | |

* cited by examiner

*Primary Examiner* — Anh T Vo
(74) *Attorney, Agent, or Firm* — Workman Nydegger

(57) ABSTRACT

A liquid ejecting apparatus includes a liquid ejection head that ejects a liquid, a supply flow path that supplies the liquid from a liquid containing portion, which is replaceable and contains the liquid, to the liquid ejection head, a liquid feeding portion that is provided in the supply flow path and is configured to suck the liquid from the liquid containing portion and to feed the liquid to the liquid ejection head, and a control unit that controls driving of the liquid feeding portion. The control unit changes driving control of the liquid feeding portion in accordance with a remaining amount of the liquid in the liquid containing portion.

11 Claims, 20 Drawing Sheets

LIQUID EJECTING APPARATUS AND METHOD FOR CONTROLLING LIQUID EJECTING APPARATUS

The present application is based on, and claims priority from JP Application Serial Number 2020-151172, filed Sep. 9, 2020, the disclosure of which is hereby incorporated by reference herein in its entirety.

BACKGROUND

1. Technical Field

The present disclosure relates to a liquid ejecting apparatus that ejects a liquid onto a medium, and a method for controlling the liquid ejecting apparatus.

2. Related Art

A liquid ejecting apparatus described in JP-A-2018-58255 includes a liquid supply source, which is an example of a liquid containing portion that is detachable and is provided with a bag body that contains a liquid, a liquid ejection unit, which is an example of a liquid ejection head that ejects a liquid, and a supply pump, which is an example of a liquid feeding portion for supplying, to the liquid ejection unit, the liquid from the liquid supply source in a pressurized state. The supply pump is provided in a supply flow path that couples the liquid supply source and the liquid ejection head.

In the liquid ejecting apparatus described in JP-A-2018-58255, if the supply pump is driven when the liquid in the liquid supply source has nearly run out, a high negative pressure acts inside the liquid containing portion. As a result, air bubbles may flow into the liquid containing portion. Then, there is a risk that an ejection failure may occur as a result of the air bubbles flowing out of the interior of the liquid containing portion into the supply flow path and reaching a nozzle of the liquid ejection unit.

SUMMARY

A liquid ejecting apparatus for solving the above-described problem includes a liquid ejection head configured to eject a liquid, a supply flow path configured to supply the liquid from a liquid containing portion to the liquid ejection head, the liquid containing portion being replaceable and configured to contain the liquid, a liquid feeding portion provided on the supply flow path and configured to suck the liquid from the liquid containing portion and feed the liquid to the liquid ejection head, and a control unit configured to control driving of the liquid feeding portion. The control unit changes driving control of the liquid feeding portion in accordance with a remaining amount of the liquid in the liquid containing portion.

In a method for controlling a liquid ejecting apparatus for solving the above-described problem, the liquid ejecting apparatus includes a liquid ejection head configured to eject a liquid, a supply flow path configured to supply the liquid from a liquid containing portion, which is replaceable and contains the liquid, to the liquid ejection head, and a liquid feeding portion provided on the supply flow path and configured to suck the liquid from the liquid containing portion and feed the liquid to the liquid ejection head. The method includes changing driving control of the liquid feeding portion in accordance with a remaining amount of the liquid in the liquid containing portion.

DESCRIPTION OF EXEMPLARY EMBODIMENTS

A first embodiment and a second embodiment of a liquid ejecting apparatus and a method for controlling the liquid ejecting apparatus will be described below with reference to the drawings. The liquid ejecting apparatus is, for example, an inkjet-type printer that performs recording on a medium, such as a sheet, by ejecting ink, which is an example of a liquid.

First Embodiment

Configuration of Liquid Ejecting Apparatus

Figure 1:
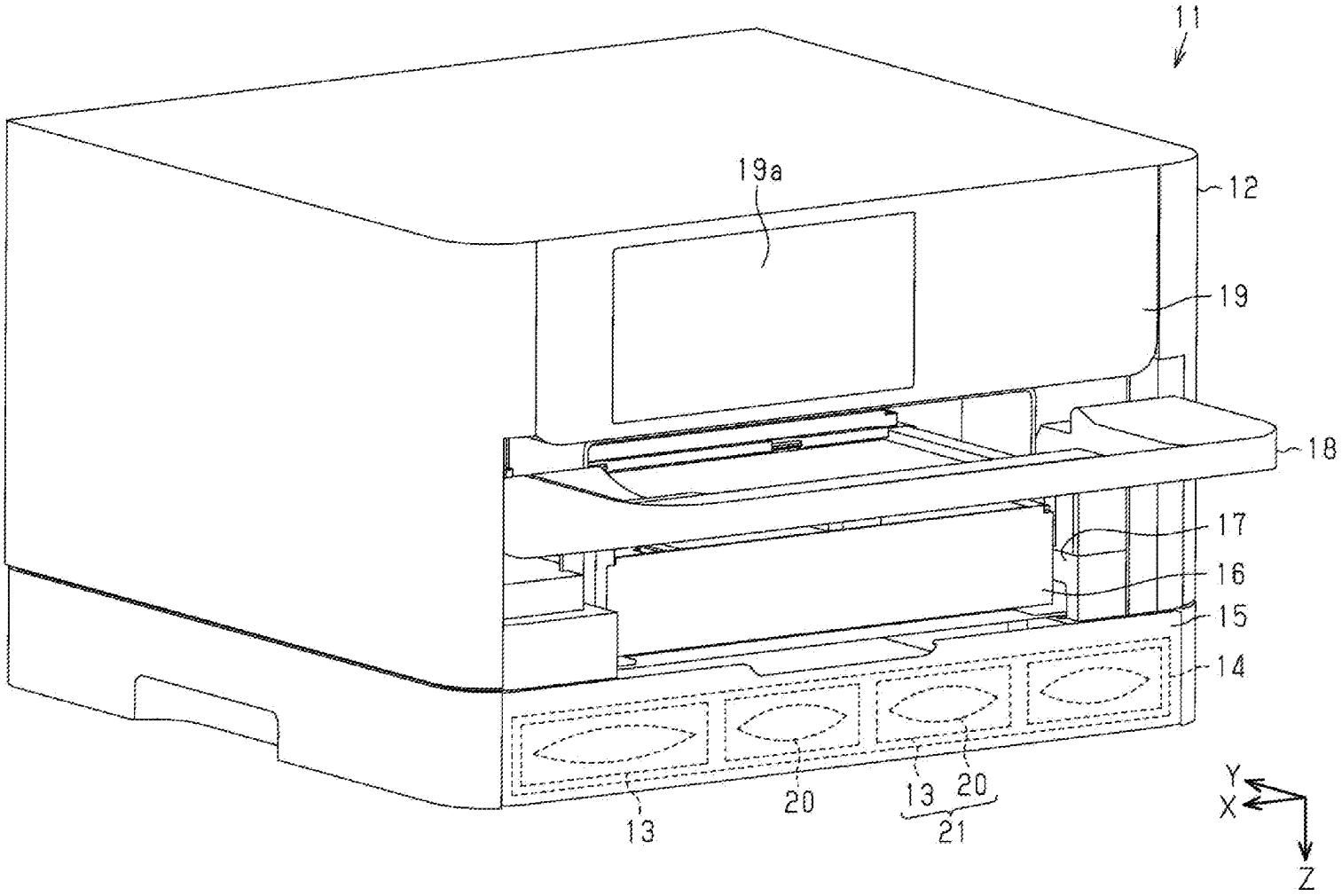
FIG. 1 is a perspective view illustrating a liquid ejecting apparatus according to first and second embodiments.

As illustrated in FIG. 1, a liquid ejecting apparatus 11 includes an outer body 12 having a substantially cuboid shape. On a front face of the outer body 12, a front cover 15, a mounting port 17, a discharge tray 18, and an operating panel 19 are disposed in this order from the bottom side toward the upper side of the outer body 12. The front cover 15 is configured to be rotatable and to cover a mounting unit 14 in which a liquid containing portion 21 is detachably mounted. A medium housing body 16 that can house a medium is mounted in the mounting port 17. The discharge tray 18 discharges the recorded medium. Using the operation panel 19, a user operates the liquid ejecting apparatus 11. The operation panel 19 includes a touch panel display unit 19*a*. A menu, a message, and the like are displayed on the display unit 19*a*. In other words, operations with respect to the liquid ejecting apparatus 11 are mainly performed on the front face of the outer body 12.

The mounting unit 14 is configured such that one or a plurality of the liquid containing portions 21 are detachably mountable therein. The liquid containing portion 21 is configured by a container 13, and a liquid containing body 20 that is placed so as to be removable from the container 13. In this embodiment, four of the liquid containing portions 21 are configured by four of the containers 13, and four of the liquid containing bodies 20 that are placed in the containers 13, respectively. Then, each of the four liquid containing bodies 20 contains a different type of liquid. For example, the liquid is ink each having a different color such as black, cyan, magenta, yellow, or the like. As a result, when a remaining amount of the liquid in the liquid containing body 20 has run out, or the remaining amount of liquid in the liquid containing body 20 becomes low, the user can replace the liquid containing portion 21 with the new liquid containing portion 21 including the liquid containing body 20 that is fully filled with the liquid. In other words, the liquid ejecting apparatus 11 according to this embodiment is configured such that the liquid containing portion 21 containing the liquid can be replaced in the mounting unit 14.

In the drawings, it is assumed that the liquid ejecting apparatus 11 is placed on a flat surface, and a width direction and a depth direction are substantially horizontal. Then, a vertical direction is indicated by a Z axis, and directions along a plane intersecting the Z axis are indicated by an X axis and a Y axis. The X, Y, and Z axes are preferably orthogonal to each other. In the following description, the X axis direction is also referred to as a width direction X, the Y axis direction as a depth direction Y, and the Z axis direction as a vertical direction Z. In this embodiment, a direction intersecting a movement path of the liquid containing portion 21 when mounting the liquid containing portion 21 in the mounting unit 14 is the width direction, and a direction in which the movement path extends is the depth direction. Further, the movement direction of the liquid containing portion 21 when mounting the liquid containing portion 21 in the mounting unit 14 is also referred to as a mounting direction, and a movement direction of the liquid containing portion 21 when removing the liquid containing portion 21 from the mounting unit 14 is also referred to as a removal direction.

Figure 2:
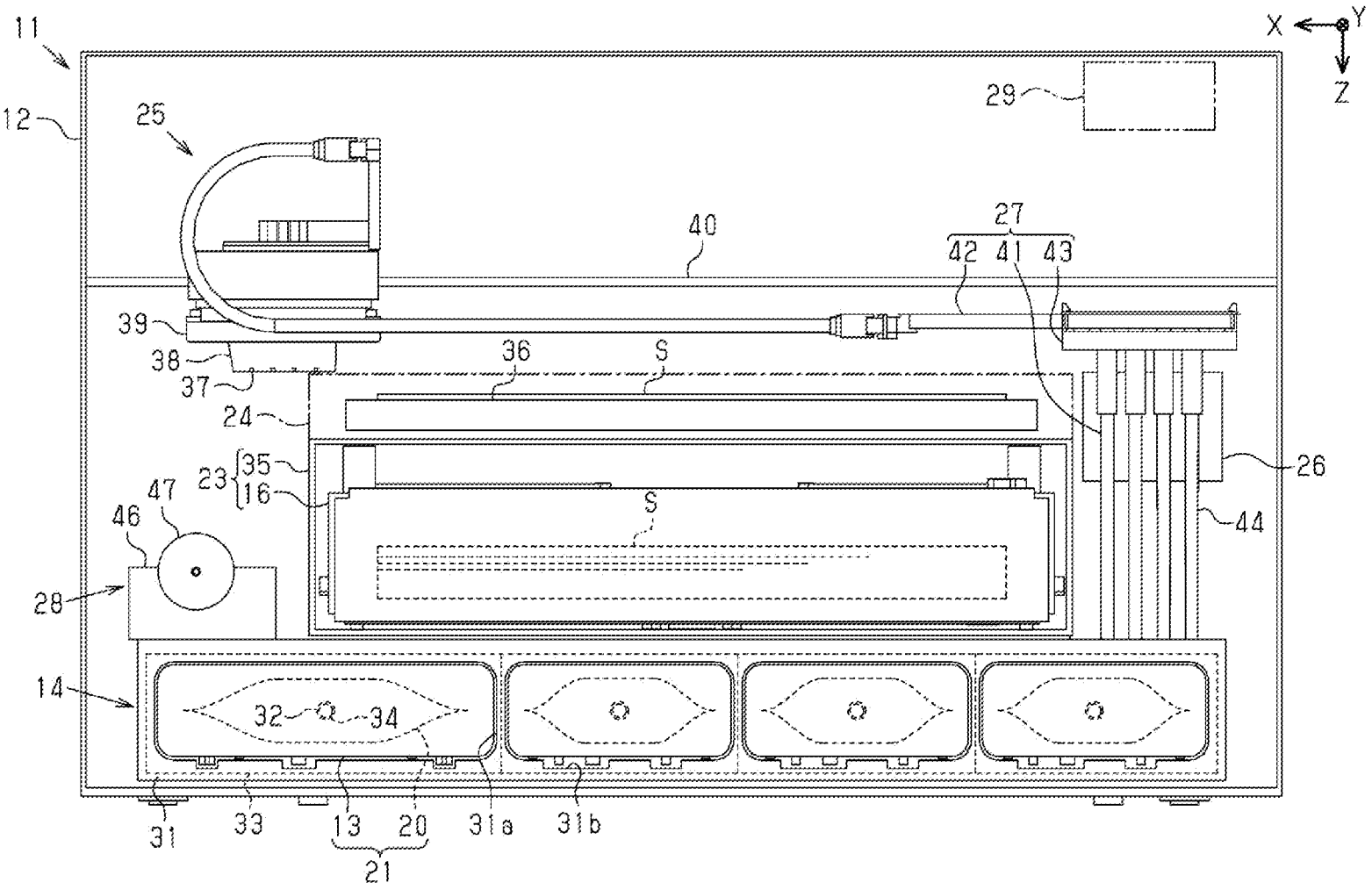
FIG. 2 is a front view illustrating an internal structure of the liquid ejecting apparatus illustrated in FIG. 1.

As illustrated in FIG. 2, in the interior of the outer body 12, the mounting unit 14, a medium housing unit 23, a transport unit 24, and a recording unit 25 are accommodated in this order from the bottom toward the upper side of the outer body 12. In other words, the liquid ejecting apparatus 11 includes the mounting unit 14, the medium housing unit 23, the transport unit 24, and the recording unit 25. Furthermore, the liquid ejecting apparatus 11 includes a maintenance unit 26 that performs maintenance of the recording unit 25, a supply flow path 27 that supplies the liquid to the recording unit 25, and a control unit 29 that controls operations of the recording unit 25 and the like.

The medium housing unit 23 includes the drawer-type medium housing body 16 that houses a medium S, and a guide frame 35 that guides movement of the medium housing body 16. The transport unit 24 includes a medium support portion 36 that supports the medium S. The transport unit 24 takes out a sheet of the medium S contained in the medium housing unit 23, one at a time, and transports the medium S to place it on the medium support portion 36.

The recording unit 25 includes a liquid ejection head 38 that ejects the liquid from nozzles 37, and a carriage 39 that holds the liquid ejection head 38. A guide shaft 40 extending across the width direction is provided in a hanging manner inside the outer body 12. The carriage 39 reciprocates in the width direction along the guide shaft 40, and recording is performed as a result of the liquid ejection head 38 ejecting the liquid onto the medium S, disposed on the medium support portion 36, during the reciprocating movement of the carriage 39.

The liquid containing portion 21 contains the liquid that is supplied to the liquid ejection head 38. The supply flow path 27 is a flow path that supplies the liquid from the liquid containing portion 21 to the liquid ejection head 38. Thus, at least one of the supply flow paths 27 is provided for each type of the liquid. In this embodiment, four of the supply flow paths 27 are provided.

The supply flow path 27 includes an upstream flow path 41, a downstream flow path 42, and a coupling flow path 43 that couples the upstream flow path 41 and the downstream flow path 42. The upstream flow path 41 is configured to include a flow path unit 33 and a flexible supply tube 44.

Figure 3:
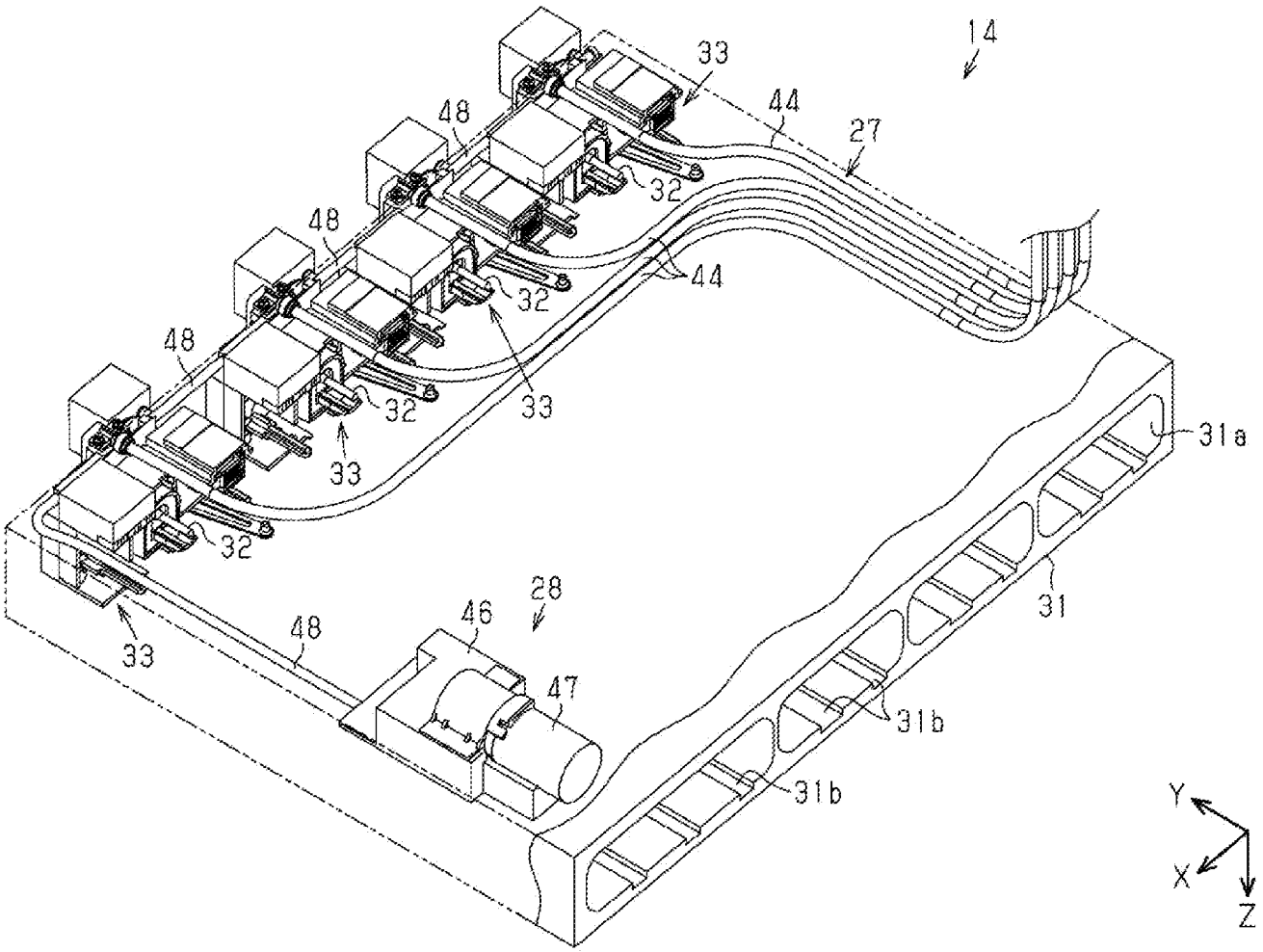
FIG. 3 is a perspective view of a mounting unit provided in the liquid ejecting apparatus illustrated in FIG. 1.

As illustrated in FIG. 3, the mounting unit 14 includes a frame body 31 that forms an accommodating space that can accommodate the liquid containing portions 21. On the front face side of the outer body 12, the frame body 31 forms an insertion port 31*a* that communicates with the accommodating space. Furthermore, the frame body 31 preferably includes a plurality of sets of linear guide rails 31*b* each of which is formed by one or a plurality of protrusions or depressions extending in the depth direction, so as to guide the movement of the liquid containing portion 21 when it is mounted in or removed from the mounting unit 14. The liquid containing portion 21 enters the accommodating space through the insertion port 31*a*, and moves in the depth direction along its movement path extending toward the rear, to be mounted in the mounting unit 14.

The flow path unit 33, which includes a hollow needle-like coupling portion 32, is provided in a rear portion of the accommodating space formed by the frame body 31. When the liquid containing portion 21 is mounted in the mounting unit 14, a supply port 34 illustrated in FIG. 2, which is included in the liquid containing portion 21, is coupled to the coupling portion 32. Then, the liquid containing portion 21 enters a state of being able to supply the liquid contained in the liquid containing portion 21 to the liquid ejecting apparatus 11 via the coupling portion 32. In this embodiment, four of the flow path units 33 are provided respectively corresponding to the four liquid containing portions 21 mounted in the liquid ejecting apparatus 11.

The mounting unit 14 includes a supply mechanism 28 that supplies the liquid in the liquid containing portion 21 to the liquid ejection head 38 illustrated in FIG. 2. Then, the supply mechanism 28 includes a voltage transformation mechanism 46, a driving source 47 of the voltage transformation mechanism 46, and a voltage transformation flow path 48 that couples the flow path unit 33 and the voltage transformation mechanism 46.

For example, the voltage transformation mechanism 46 includes an atmospheric air open valve, and the driving source 47 is a vacuum pump. When the atmospheric air open valve is opened, it communicates with the voltage transformation flow path 48 and the atmospheric air. By discharging air in the voltage transformation flow path 48 to the outside, the vacuum pump reduces the air pressure in the voltage transformation flow path 48. By the vacuum pump being driven while the atmospheric air open valve is closed, the pressure in the voltage transformation flow path 48 is reduced. Further, by stopping the driving source 47 and opening the atmospheric air open valve, the voltage transformation flow path 48 is opened to the atmospheric air, and the pressure in the voltage transformation flow path 48 returns to its original state. In this manner, by driving the supply mechanism 28, the pressure in the voltage transformation flow path 48 is controlled by the control unit 29 illustrated in FIG. 2. Note that opening a valve is also referred to as valve opening or releasing a valve. Further, closing a valve is also referred to as valve closing or shutting a valve.

Figure 4:
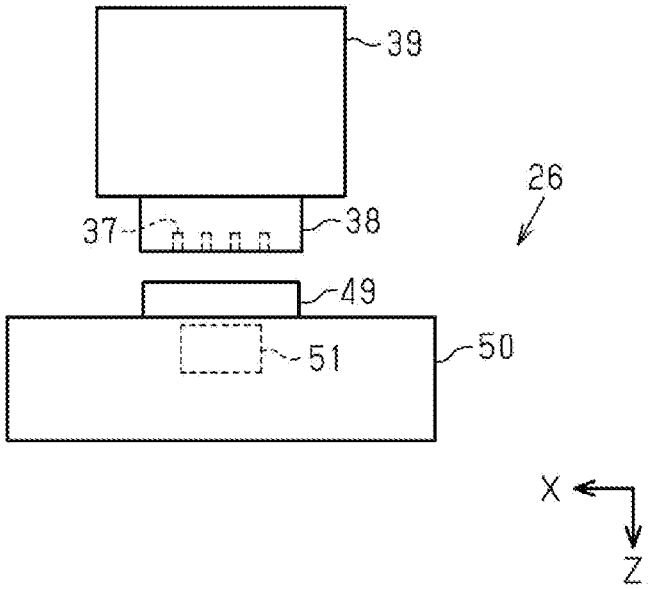
FIG. 4 is a schematic view of a maintenance unit provided in the liquid ejecting apparatus illustrated in FIG. 1.

As illustrated in FIG. 4, the maintenance unit 26 includes a bottomed box-shaped cap 49 formed so as to have a size corresponding to the liquid ejection head 38, a lifting mechanism 50 for moving the cap 49 up and down, and a suction portion 51 for sucking the interior of the cap 49.

In the liquid ejecting apparatus 11, maintenance operations such as capping, flushing, cleaning, and the like are performed in order to prevent or eliminate an ejection failure caused by clogging of the nozzle 37 of the liquid ejection head 38, adhesion of foreign material to the nozzle 37, or the like.

"Capping" refers to an operation in which, when the liquid ejection head 38 is not ejecting the liquid, the cap 49 comes into contact with the liquid ejection head 38 so as to surround openings of the nozzles 37. As a result, a closed space region is formed surrounding a space between the cap 49 and a lower face, of the liquid ejection head 38, in which the nozzles 37 are open. Since thickening of the liquid inside the nozzle 37 is suppressed by the capping, occurrence of the ejection failure can be prevented.

"Flushing" refers to an ejecting operation for discharging, from the nozzles 37, liquid droplets that are not related to the recording. Since a thickened liquid, air bubbles, or foreign material, which may cause the ejection failure of the nozzle 37, are discharged by the flushing, the clogging of the nozzle 37 can be prevented. The flushing is performed by the liquid ejection head 38 ejecting liquid droplets from the nozzles 37 toward the interior of the cap 49.

"Cleaning" refers to an operation in which a suction force is applied to the nozzle 37 of the liquid ejection head 38 to forcibly discharge the liquid from the nozzle 37. By moving upward and coming into contact with the liquid ejection head 38 so as to surround the openings of the nozzles 37, the cap 49 forms the closed space region surrounding the space between the cap 49 and the lower face, of the liquid ejection head 38, in which the nozzles 37 are open. Then, in this state, by driving the suction portion 51 and generating a negative pressure in the closed space region, suction cleaning is performed in which the liquid in the liquid ejection head 38 is discharged through the nozzles 37.

Figure 5:
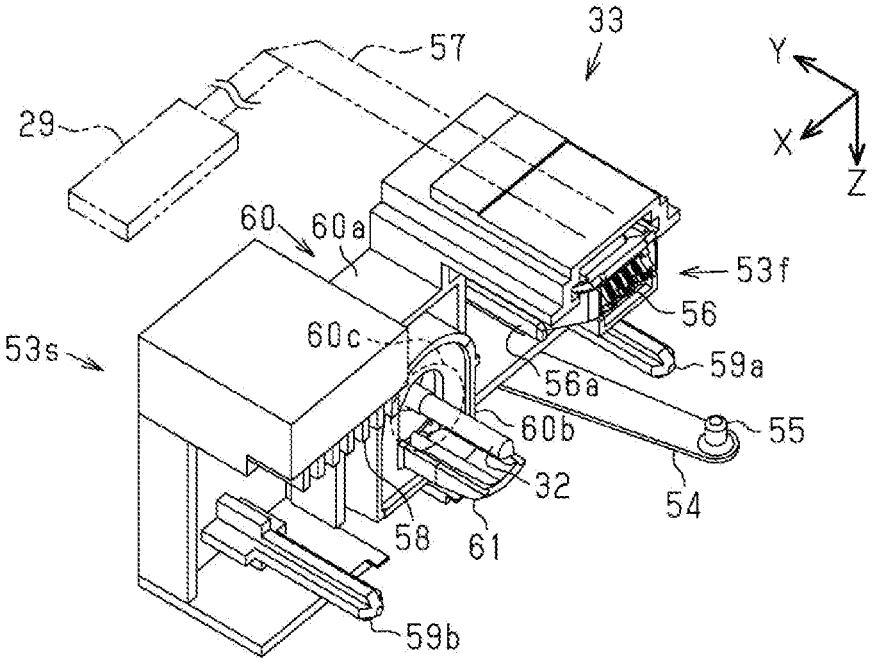
FIG. 5 is a perspective view of a flow path unit provided in the liquid ejecting apparatus illustrated in FIG. 1.

As illustrated in FIG. 5, the flow path unit 33 includes a first coupling mechanism **53*f* and a second coupling mechanism 53*s* on both sides sandwiching the coupling portion 32 in the width direction. The first coupling mechanism 53*f* includes an arm 54 that is disposed vertically below the coupling portion 32 so as to protrude in the removal direction. An engaging portion 55 that engages with the liquid containing portion 21 illustrated in FIG. 2 is provided at a tip end of the arm 54. The arm 54 is configured such that a tip end side thereof is rotatable about a base end side thereof. The engaging portion 55 protrudes vertically upward from the arm 54, for example, and is disposed on the movement path of the liquid containing portion 21 when mounting the liquid containing portion 21 in the mounting unit 14 illustrated in FIG. 3**.

The first coupling mechanism **53*f* includes a substrate coupling portion 56 that is disposed vertically above the coupling portion 32 so as to protrude in the removal direction. The substrate coupling portion 56 is coupled to the control unit 29 via an electrical circuit 57 such as a flat cable. The substrate coupling portion 56 is preferably disposed such that an upper end thereof protrudes further in the removal direction than a lower end thereof, to face diagonally downward. Further, a pair of guide protruding portions 56*a* protruding in the width direction and extending along the mounting direction are preferably disposed on both sides of the substrate coupling portion 56** in the width direction.

The second coupling mechanism **53*s* preferably includes a block 58 for preventing incorrect insertion, which is disposed vertically above the coupling portion 32 so as to protrude in the removal direction. The block 58 has a shape formed by protrusions and depressions that are disposed facing downward, and this shape formed by the protrusions and depressions is different for each of the flow path units 33**.

The flow path unit 33 includes a pair of positioning protrusions **59*a* and 59*b*, a push-out mechanism 60 disposed so as to surround the coupling portion 32, and a liquid receiving portion 61 protruding in the removal direction below the coupling portion 32. The pair of positioning protrusions 59*a* and 59*b* are arranged side by side in the width direction with the coupling portion 32 interposed therebetween, so as to be included in the first coupling mechanism 53*f* and the second coupling mechanism 53*s*, respectively. For example, the positioning protrusions 59*a* and 59*b* may be rod-shaped protrusions protruding in the removal direction in parallel with each other. The protruding length in the removal direction of the positioning protrusions 59*a* and 59*b* is preferably longer than the protruding length in the removal direction of the coupling portion 32**.

The push-out mechanism 60 includes a frame member **60*a* that surrounds a base end portion of the coupling portion 32, a pressing portion 60*b* that protrudes in the removal direction from the frame member 60*a*, and an urging portion 60*c* that urges the liquid containing portion 21 in the removal direction via the pressing portion 60*b*. The urging portion 60*c* may be, for example, a coil spring interposed between the frame member 60*a* and the pressing portion 60*b***.

Liquid Containing Portion

Figure 6:
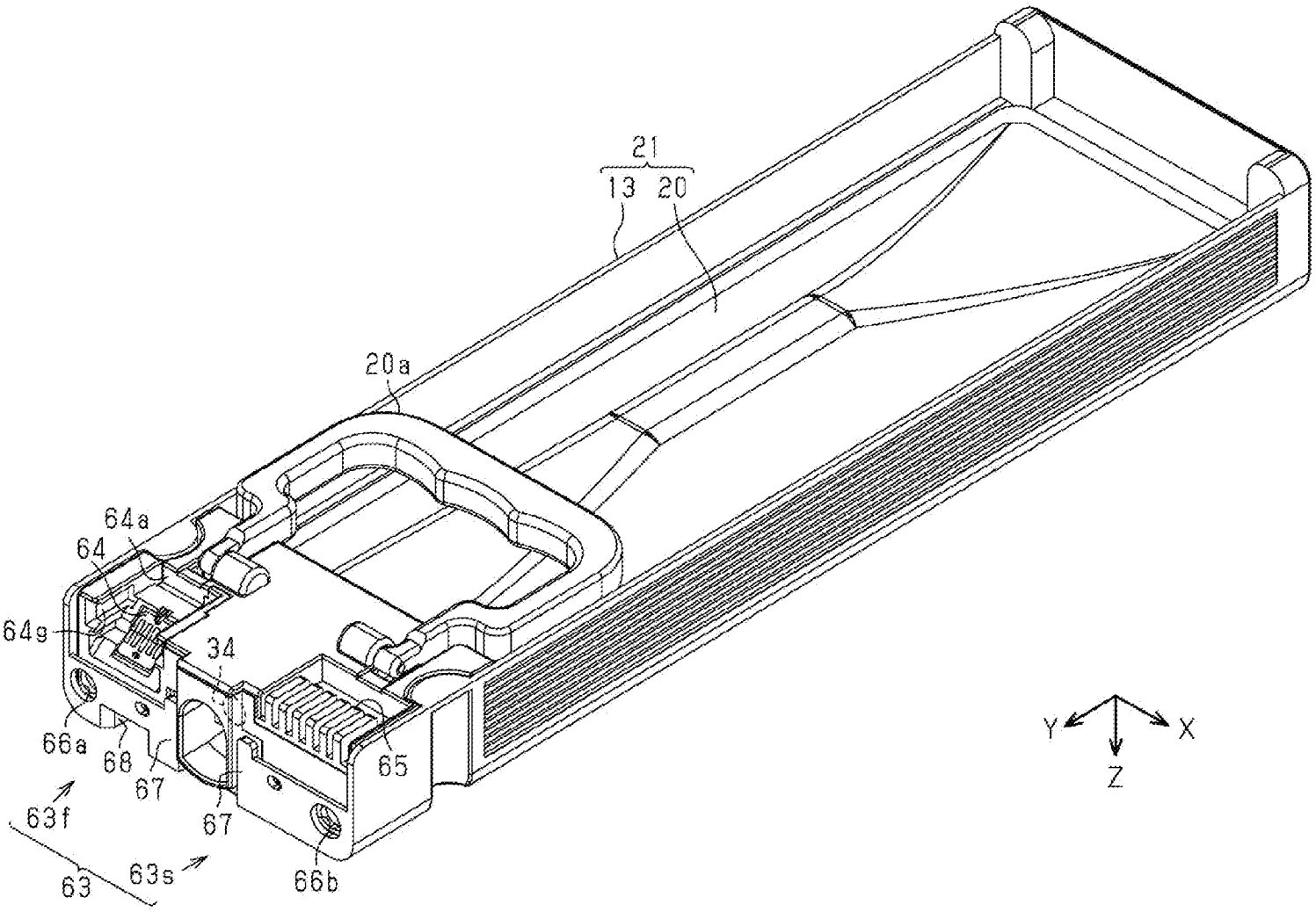
FIG. 6 is a perspective view of a liquid containing portion mounted in the liquid ejecting apparatus illustrated in FIG. 1.

As illustrated in FIG. 6, the liquid containing portion 21 includes the container 13 having a substantially cuboid outer shape and the liquid containing body 20 detachable from the container 13, and the liquid containing body 20 includes a handle 20*a* that is gripped by the user when the user attaches or detaches the liquid containing body 20 to and from the container 13.

When it is assumed that an end advancing first when mounting the liquid containing portion 21 in the mounting unit 14 illustrated in FIG. 3 is a tip end, and an end opposite from the tip end is a base end, a coupling structure 63 is provided in a tip end portion of the liquid containing portion 21. The coupling structure 63 includes a first coupling structure 63*f* and a second coupling structure 63*s* on both sides, sandwiching the supply port 34, in the width direction of the coupling structure 63.

The first coupling structure 63*f* includes a printed wired board 64 disposed vertically above the supply port 34. The printed wired board 64 may include an IC chip that stores various types of information relating to the liquid containing portion 21. For example, the various types of information include information such as a type of the liquid containing portion 21, an amount of liquid contained in the liquid containing portion 21, and the like. Furthermore, the printed wired board 64 includes a coupling terminal electrically coupled to the substrate coupling portion 56 included in the flow path unit 33 illustrated in FIG. 5.

The printed wired board 64 is preferably disposed in a recessed portion 64*a*, which is provided in a mode of being open upward and in the mounting direction, so as to be in a posture facing diagonally upward. Further, guide recessed portions 64*g* extending in the mounting direction are preferably disposed on both sides in the width direction of the printed wired board 64.

The second coupling structure 63*s* preferably includes an identification portion 65 for preventing incorrect insertion, which is disposed vertically above the supply port 34. The identification portion 65 includes protrusions and depressions that are shaped so as to fit into the block 58, illustrated in FIG. 5, of the flow path unit 33 that corresponds to the identification portion 65 to be coupled thereto.

The coupling structure 63 includes a pair of positioning holes 66*a* and 66*b*, and an urging force receiving portion 67 that receives an urging force of the urging portion 60*c* illustrated in FIG. 5. The positioning holes 66*a* and 66*b* are arranged side by side in the width direction with the supply port 34 interposed therebetween, so as to be included in the first coupling mechanism 63*f* and the second coupling mechanism 63*s*, respectively. The first positioning hole 66*a* included in the first coupling structure 63*f* is a circular hole, while the second positioning hole 66*b* included in the second coupling structure 63*s* is preferably an elliptical hole long in the width direction.

As illustrated in FIG. 6, when the liquid containing portion 21 is inserted into the accommodating space, and the tip end of the liquid containing portion 21 approaches the flow path unit 33 illustrated in FIG. 5, first, tip ends of the positioning protrusions 59*a* and 59*b* illustrated in FIG. 5 each having the protruding length long in the removal direction enter into and are engaged with the positioning holes 66*a* and 66*b* of the liquid containing portion 21, and the movement of the liquid containing portion 21 in the width direction is restricted. The second positioning hole 66*b* corresponding to the second positioning projection 59*b* is an elliptical long hole extending in the width direction. Thus, the first positioning protrusion 59*a* that enters into the first positioning hole 66*a* having the circular shape serves as a reference for positioning.

After the positioning protrusions 59*a*, and 59*b* are engaged with the positioning holes 66*a* and 66*b*, when the liquid containing portion 21 further advances to the rear, the urging force receiving portion 67 comes into contact with the pressing portion 60*b* illustrated in FIG. 5 and receives the urging force of the urging portion 60*c* illustrated in FIG. 5, and the supply port 34 of the liquid containing portion 21 is coupled to the coupling portion 32 illustrated in FIG. 5. In this way, the positioning protrusions 59*a* and 59*b* preferably determine the position of the liquid containing portion 21 before the coupling portion 32 is coupled to the supply port 34.

When the liquid containing portion 21 is inserted into a correct position, the identification portion 65 properly fits into the block 58, illustrated in FIG. 5, of the flow path unit 33. In contrast, when the user attempts to mount the liquid containing portion 21 in an incorrect position, the identification portion 65 does not fit into the block 58. Thus, the liquid containing portion 21 cannot advance any further to the rear. As a result, incorrect mounting is prevented.

When the liquid containing portion 21 advances in the mounting direction, the substrate coupling portion 56 illustrated in FIG. 5 enters into the recessed portion 64*a* of the liquid containing portion 21, and the guide recessed portions 64*g* are guided by the guide protruding portions 56*a* illustrated in FIG. 5. Thus, the position of the liquid containing portion 21 is adjusted, and the printed wired board 64 and the substrate coupling portion 56 come into contact with each other. As a result, the printed wired board 64 and the substrate coupling portion 56 are electrically coupled to each other, and information is transmitted and received between the printed wired board 64 and the control unit 29 illustrated in FIG. 5. In this way, the first positioning hole 66*a*, which serves as the reference for positioning, is preferably disposed in the first coupling structure 63*f* including the printed wired board 64, of the first coupling structure 63*f* and the second coupling structure 63*s*.

When the supply port 34 of the liquid containing portion 21 is coupled to the coupling portion 32 so as to be able to supply the liquid to the coupling portion 32, and the printed wired board 64 comes into contact with the substrate coupling portion 56 and is electrically coupled to the substrate coupling portion 56, the coupling of the coupling structure 63 to the flow path unit 33 is complete.

Figure 7:
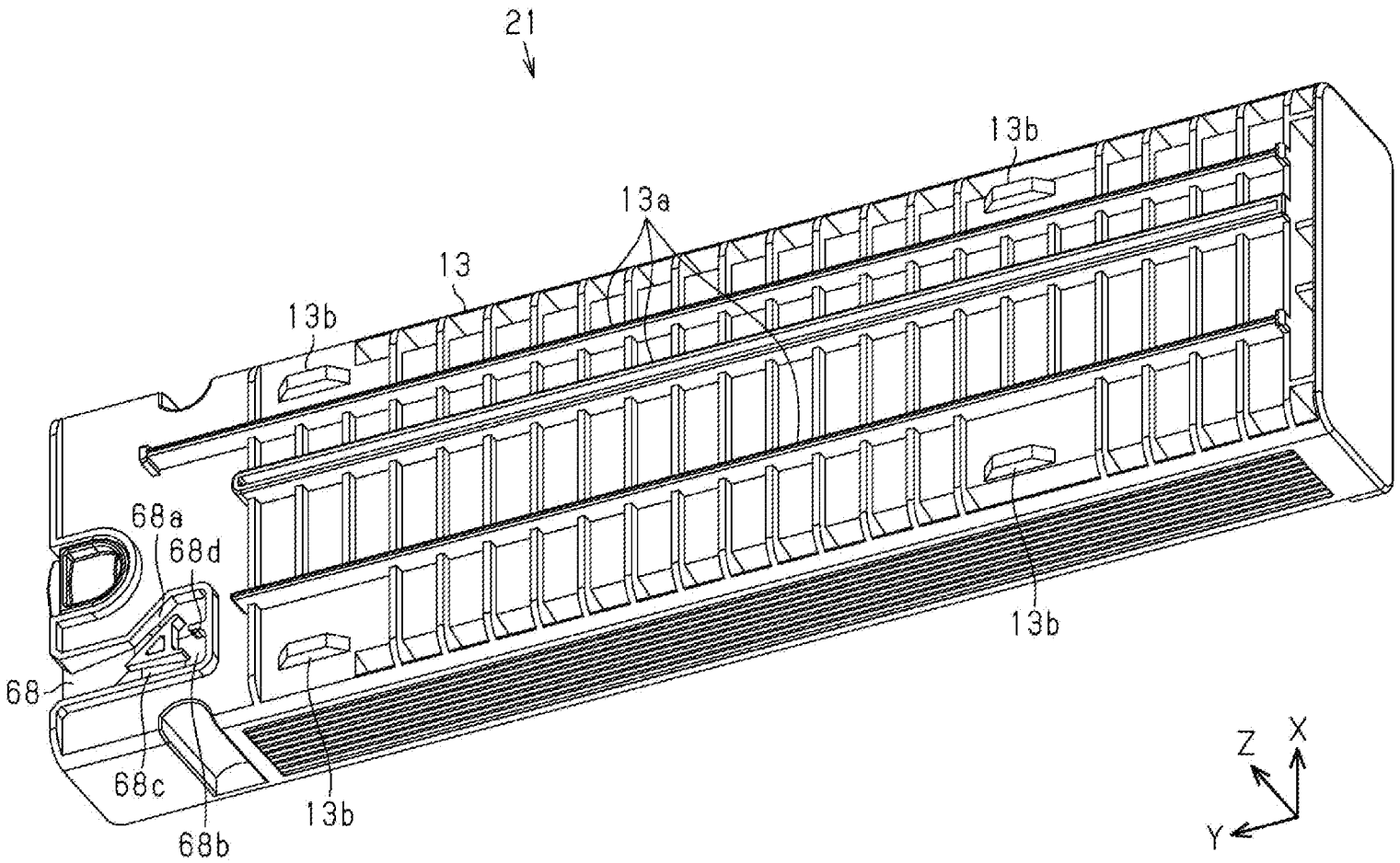
FIG. 7 is a perspective view of the liquid containing portion illustrated in FIG. 6, as viewed from a different angle.

As illustrated in FIG. 7, an engagement groove 68 extending from the tip end of the container 13 in the removal direction is provided as a recess in a bottom surface of the container 13. Of the first coupling structure 63*f* and the second coupling structure 63*s* configuring the coupling structure 63 illustrated in FIG. 6, the engagement groove 68 is preferably disposed in the first coupling structure 63*f* in which the first positioning hole 66*a* serving as the reference for positioning is also provided.

The engagement groove 68 may be, for example, a heart cam groove including a first inclined groove 68*a* extending from a tip end of the bottom surface in the removal direction, a locking groove 68*b* extending in the width direction from a terminal end of the first inclined groove 68*a*, and a second inclined groove 68*c* extending from a terminal end of the locking groove 68*b* toward a starting end of the first inclined groove 68*a*. When the liquid containing portion 21 approaches a terminal end of the movement path when mounting the liquid containing portion 21 in the mounting unit 14 illustrated in FIG. 3, the engaging portion 55 provided in a protruding manner at the tip end of the arm 54 illustrated in FIG. 5 engages with the engagement groove 68.

The first inclined groove 68*a*, the locking groove 68*b*, and the second inclined groove 68*c* are each inclined so as to become increasingly shallower from the starting end toward the terminal end thereof, and thus, a step is formed at each intersecting section. Thus, after the engaging portion 55 is engaged with the starting end of the first inclined groove 68*a*, when the liquid containing portion 21 moves along the mounting direction, the engaging portion 55 illustrated in FIG. 5 engages with the first inclined groove 68*a*, the locking groove 68*b*, and the second inclined groove 68*c* in this order following the inclination. The engaging portion 55 does not return to the first inclined groove 68*a* from the locking groove 68*b*. Further, the engaging portion 55 does not return to the locking groove 68*b* from the second inclined groove 68*c*.

As illustrated in FIG. 7, the locking groove 68*b* has a shape in which a portion between the starting end and the terminal end thereof is bent toward the tip end side. Then, the locking groove 68*b* includes, in the bent portion, an engagement wall portion 68*d* that is positioned to the rear of the engaging portion 55 illustrated in FIG. 5 in the mounting direction, and engages with the engaging portion 55. Then, when the engaging portion 55 engages with the engagement wall portion 68*d*, even while receiving the urging force of the urging portion 60*c* illustrated in FIG. 5, the movement of the liquid containing portion 21 in the removal direction is restricted, and a state in which the liquid containing portion 21 is mounted in the mounting unit 14 is maintained. When the liquid containing portion 21 engages with the engaging portion 55, the mounting of the liquid containing portion 21 in the mounting unit 14 is complete.

When the liquid containing portion 21 inserted into the accommodation space is pushed by the user in the mounting direction, and the engaging portion 55 engages with the engagement groove 68 and relatively moves along the first inclined groove 68*a*, the liquid containing portion 21 receives the urging force of the urging portion 60*c*. Thus, during a time period from when the engaging portion 55 moves from the first inclined groove 68*a* to the locking groove 68*b* until when the engaging portion 55 engages with the engagement wall portion 68*d*, the liquid containing portion 21 moves slightly in the removal direction due to the urging force of the urging portion 60*c*.

When a configuration is adopted in which a contact sound, such as a "snap", or a clicking sound is generated as a result of the engaging portion 55 coming into contact with the engagement wall portion 68*d* at a terminal end of the movement of the liquid containing portion 21 in the removal direction, a sensation, a feeling, or a click feeling can be imparted to the user that indicates that the mounting of the liquid containing portion 21 is complete. As a result, a mounting failure caused by insufficient insertion of the liquid containing portion 21 or the like can be suppressed.

As illustrated in FIG. 7, in a state in which the engaging portion 55 is engaged with the engagement wall portion 68*d*, when the liquid containing portion 21 is pushed further in the mounting direction by the user, the engaging portion 55 transitions to the second inclined groove 68*c* along the inclination of the locking groove 68*b*. Then, the engaging portion 55 moves toward the terminal end of the second inclined groove 68*c* due to the urging force of the urging portion 60*c*, along the inclination of the second inclined groove 68*c*, and the engaging portion 55 is disengaged from the engagement groove 68. As a result, the liquid containing portion 21 moves in the removal direction due to the urging force of the urging portion 60*c*, and a base end portion of the liquid containing portion 21 comes out of the frame 31 and the outer body 12 illustrated in FIG. 1, through the insertion port 31*a* illustrated in FIG. 3. At this time, the supply port 34 illustrated in FIG. 6 is separated from the coupling portion 32 illustrated in FIG. 5, the printed wired board 64 illustrated in FIG. 6 is separated from the substrate coupling portion 56 illustrated in FIG. 5, and then, the mounting of the liquid containing portion 21 in the mounting unit 14 illustrated in FIG. 1 is released.

Rail engaging portions 13*a*, which are formed so as to correspond to the protrusions and depressions of the guide rails 31*b* illustrated in FIG. 2, are preferably provided in a bottom portion of the container 13. The movement path of the liquid containing portion 21 used when mounting the liquid containing portion 21 in the mounting unit 14 can be made clear by the guide rails 31*b*. Further, with the guide rails 31*b*, even when inserting a plurality of the liquid containing portions 21, the liquid containing portions 21 arranged adjacent to each other can be moved without coming into contact with each other unnecessarily.

Three or more of leg portions 13*b*, which keep the posture of the container 13 horizontal, are preferably provided in a protruding manner By providing four of the legs portions 13*b*, the position of the liquid containing portion 21 in the vertical direction can be determined. Thus, the posture of the liquid containing portion 21 can be held properly, and the liquid containing portion 21 and the coupling portion 32 can be appropriately coupled to each other. Thus, the coupling between the liquid containing portion 21 and the coupling portion 32 can be appropriately maintained.

Supply Flow Path, Liquid Feeding Portion, and Liquid Storing Portion

Figure 8:
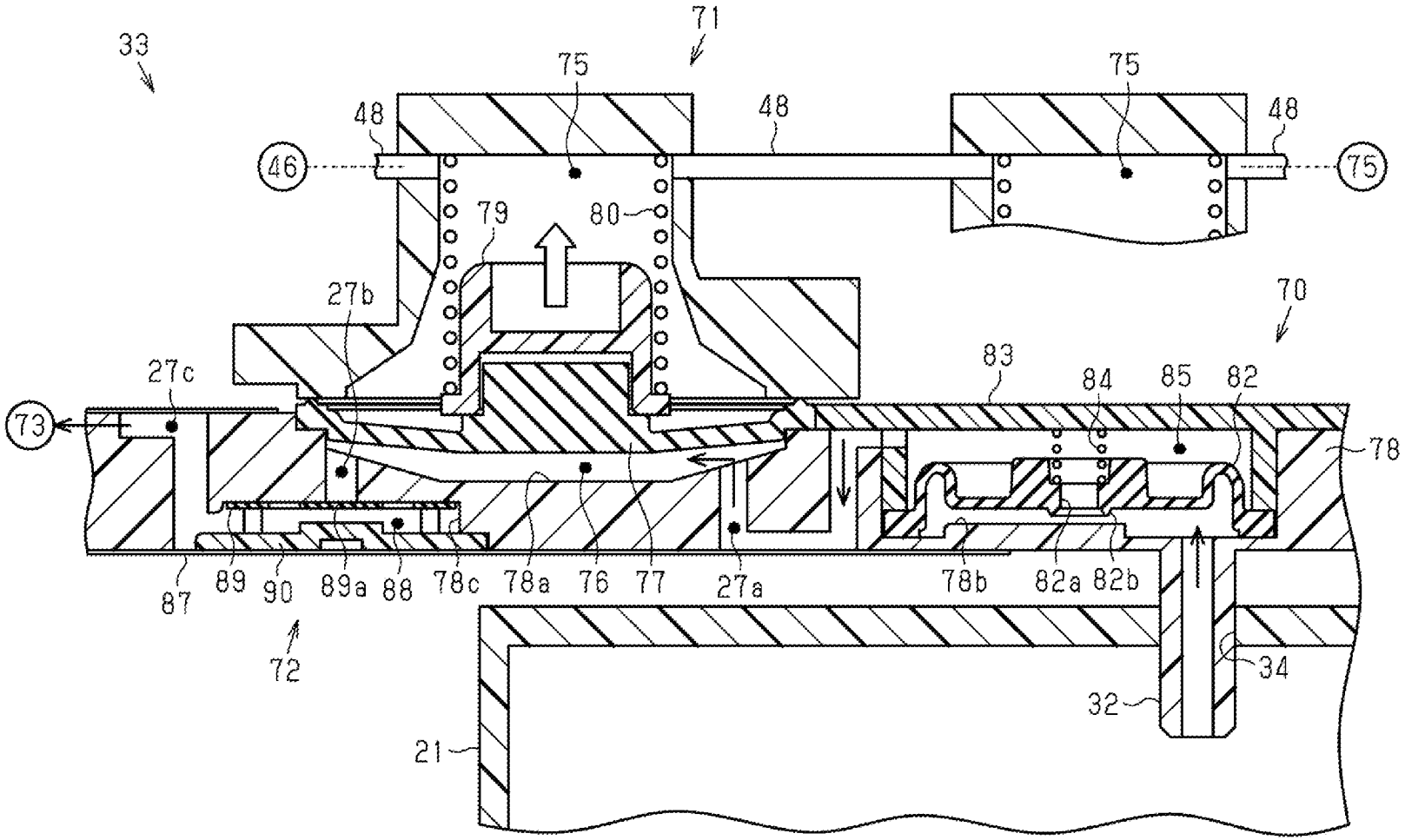
FIG. 8 is a schematic view illustrating an internal configuration of the flow path unit illustrated in FIG. 5 during a suction operation.

As illustrated in FIG. 8, the flow path unit 33 includes a suction-side one-way valve 70, a liquid feeding portion 71, a discharge-side one-way valve 72, and a liquid storing portion 73 in this order from the coupling portion 32 side, the coupling portion 32 being an upstream end of the supply flow path 27 illustrated in FIG. 2. In other words, the liquid ejecting apparatus 11 includes the suction-side one-way valve 70, the liquid feeding portion 71, the discharge-side one-way valve 72, and the liquid storing portion 73. Then, the suction-side one-way valve 70, the liquid feed unit 71, the discharge-side one-way valve 72, and the liquid storing portion 73 are provided in the supply flow path 27. The liquid containing portion 21 is coupled to the coupling portion 32, which is the upstream end of the supply flow path 27.

The liquid feeding portion 71 is a diaphragm pump that performs a suction operation for sucking the liquid and a discharge operation for discharging the sucked liquid. The suction-side one-way valve 70 and the liquid feeding portion 71 are communicated with each other through a first flow path 27*a*. Then, the liquid feeding portion 71 and the discharge-side one-way valve 72 are communicated with each other through a second flow path 27*b*. Furthermore, the discharge-side one-way valve 72 and the liquid storing portion 73 are communicated with each other through a third flow path 27*c*. The first flow path 27*a*, the second flow path 27*b*, and the third flow path 27*c* configure a portion of the supply flow path 27.

As illustrated in FIG. 8, the liquid feeding portion 71 includes a voltage transformation chamber 75 to which the voltage transformation flow path 48 is coupled, a liquid feeding chamber 76 configuring a portion of the supply flow path 27, and a diaphragm 77 that partitions the voltage transformation chamber 75 and the liquid feeding chamber 76. Furthermore, the liquid feeding portion 71 includes a flow path forming member 78 in which a liquid feeding recessed portion 78*a* is formed. Then, the liquid feeding chamber 76 is formed by being surrounded by the liquid feeding recessed portion 78*a* and the diaphragm 77, and a downstream end of the first flow path 27*a* and an upstream end of the second flow path 27*b* are coupled to each other.

The liquid feeding portions 71 provided in each of the plurality of flow path units 33 are coupled to each other in series by the voltage transformation flow path 48. In other words, of the plurality of flow path units 33, the liquid feeding portion 71 of one of the flow path units 33 is coupled to the voltage transformation mechanism 46 via the voltage transformation flow path 48, and with respect to the other flow path units 33, the voltage transformation chambers 75 of the flow path units 33 adjacent to each other in the width direction are coupled to each other via the voltage transformation flow path 48. As a result, for example, when an arrangement interval between the flow path units 33 is changed, it is possible to easily handle the change by making the voltage transformation flow path 48 flexible, or replacing the voltage transformation flow path 48 with the one having a different length. Then, when the driving source 47 included in the supply mechanism 28 is driven, the pressure in the voltage transformation chamber 75 becomes negative.

The driving of the supply mechanism 28 is controlled by the control unit 29. In other words, the driving of the liquid feeding portion 71 is controlled by the control unit 29 in conjunction with the driving of the supply mechanism 28. The liquid feeding portions 71 may be respectively coupled to each of the separate voltage transformation flow paths 48. Then, those voltage transformation flow paths 48 may be respectively coupled to each of the separate supply mechanisms 28. As a result, by driving the driving source 47 corresponding to the liquid feeding portion 71, only the pressure in the voltage transformation chamber 75 of that liquid feeding portion 71 can be made negative. In other words, the driving of the liquid feeding portion 71 can be controlled for each of the liquid containing portions 21.

A spring seat 79 that is displaced together with the diaphragm 77 and a first coil spring 80 that urges the diaphragm 77 toward the liquid feeding chamber 76 side are accommodated in the voltage transformation chamber 75. Then, when a negative pressure is generated in the voltage transformation chamber 75 as a result of the driving of the driving source 47 included in the supply mechanism 28, the diaphragm 77 is displaced in a direction that increases the volume of the liquid feeding chamber 76, in resistance to an urging force of the first coil spring 80. As a result, the liquid feeding portion 71 performs the suction operation.

As illustrated in FIG. 8, the suction-side one-way valve 70 includes a suction side recessed portion 78*b* formed in the flow path forming member 78, a flexible suction-side valve body 82, and a suction-side fixing member 83 that fixes the suction-side valve body 82 by coming into contact with an outer edge portion of the suction-side valve body 82. Furthermore, a second coil spring 84 is disposed between the suction-side valve body 82 and the suction-side fixing member 83. The second coil spring 84 urges the suction-side valve body 82 in a direction in which an annular protrusion 82*b* comes into contact with an inner bottom surface of the suction-side recessed portion 78*b*.

The suction-side one-way valve 70 includes a suction-side valve chamber 85 that is formed by being surrounded by the suction-side recessed portion 78*b* and the suction-side fixing member 83. The suction-side valve chamber 85 is partitioned into an upstream portion and a downstream portion by the suction-side valve body 82, and a downstream end of the coupling portion 32 is coupled to the upstream portion, and an upstream end of the first flow path 27*a* is coupled to the downstream portion.

A through hole 82*a* is formed in a central portion of the suction-side valve body 82, and the annular protrusion 82*b* is formed in a position surrounding the through hole 82*a* so as to face the inner bottom surface of the suction-side recessed portion 78*b*. Thus, the upstream portion and the downstream portion of the suction-side valve chamber 85 can communicate with each other through the through hole 82*a*.

When the liquid feeding portion 71 performs the suction operation, the liquid in the suction-side valve chamber 85 is sucked into the liquid feeding chamber 76 through the first flow path 27*a*, and a negative pressure is generated in the downstream portion of the suction-side valve chamber 85. As a result, the suction-side valve body 82 is displaced in resistance to a urging force of the second coil spring 84. Then, the annular protrusion 82*b* is separated from the inner bottom surface of the suction-side recessed portion 78*b*, and the upstream portion and the downstream portion of the suction-side valve chamber 85 are communicated with each other. In other words, the suction-side one-way valve 70 is opened to open the supply flow path 27. As a result, the liquid in the liquid containing portion 21 is supplied toward the liquid feeding portion 71 side through the coupling portion 32.

As illustrated in FIG. 8, the discharge-side one-way valve 72 includes a discharge-side valve chamber 88 that is formed by being surrounded by a discharge-side recessed portion 78*c* formed in the flow path forming member 78 and a film member 87. In the discharge-side valve chamber 88, a flexible discharge-side valve body 89, and a discharge-side fixing member 90 that fixes the discharge-side valve body 89 by coming into contact with an outer edge portion of the discharge-side valve body 89 are provided. Further, the discharge-side valve chamber 88 configures a portion of the supply flow path 27, and a downstream end of the second flow path 27*b* and an upstream end of the third flow path 27*c* are coupled to each other. Note that an opening of the second flow path 27*b* with respect to the discharge-side valve chamber 88 is always closed by a contact portion 89*a* of the discharge-side valve body 89.

When the liquid feeding portion 71 performs the suction operation, since the liquid in the discharge-side valve chamber 88 is sucked through the second flow path 27*b* toward the liquid feeding portion 71 side, the contact portion 89*a* closes the second flow path 27*b*. In other words, the discharge-side one-way valve 72 is closed.

Figure 9:
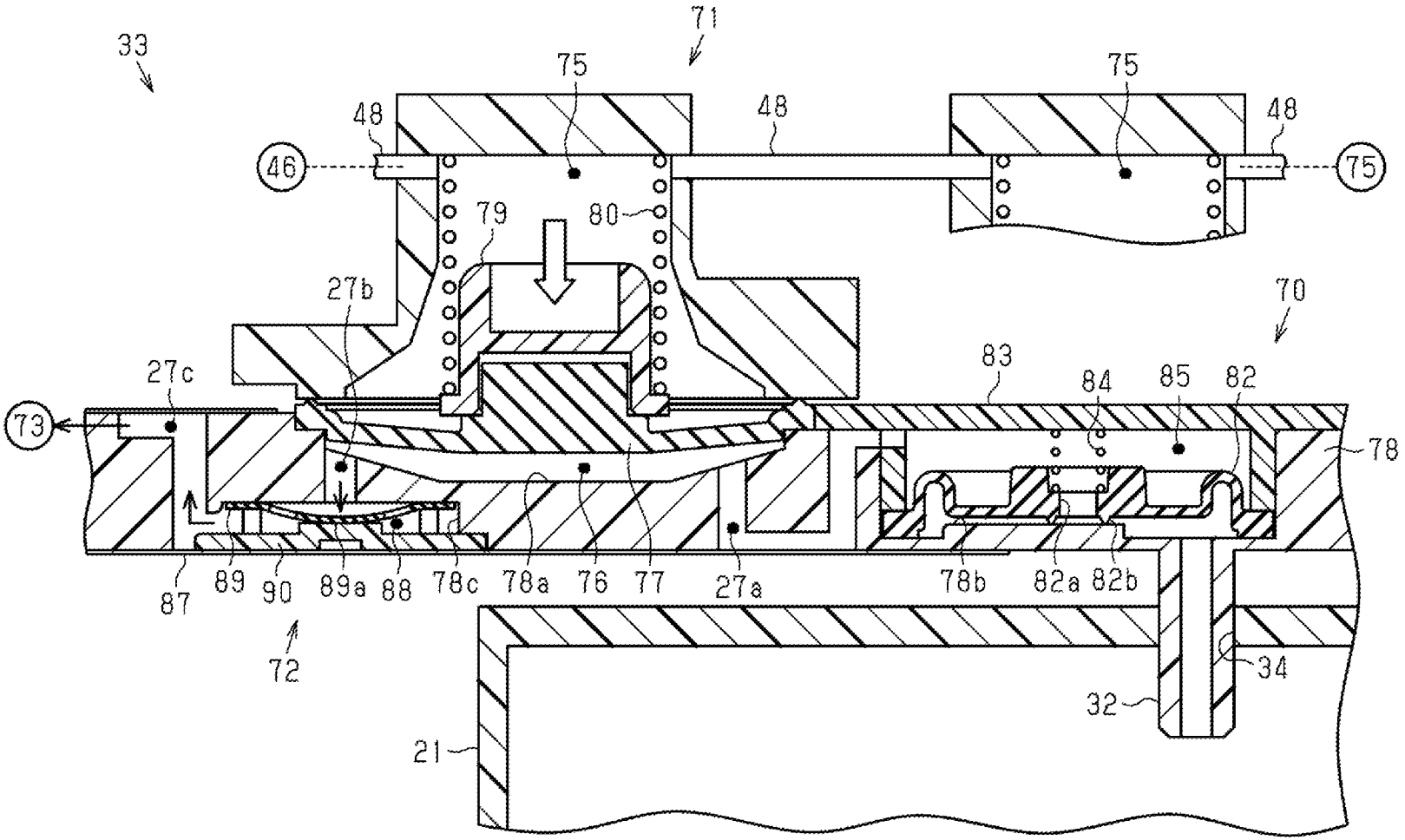
FIG. 9 is a schematic view illustrating the internal configuration of the flow path unit illustrated in FIG. 5 during a discharge operation.

As illustrated in FIG. 9, after the suction operation, when the supply mechanism 28 opens the interior of the voltage transformation chamber 75 to the atmospheric air, the diaphragm 77 is displaced in a direction that reduces the volume of the liquid feeding chamber 76 due to the urging force of the first coil spring 80. As a result, the liquid feeding portion 71 performs the discharge operation.

In the suction-side one-way valve 70, the second coil spring 84 urges the suction-side valve body 82 in a direction in which the annular protrusion 82*b* comes into contact with the inner bottom surface of the suction-side recessed portion 78*b*. In other words, the suction-side valve body 82 is configured to be able to close the supply flow path 27 by making the upstream portion and the downstream portion of the suction-side valve chamber 85 unable communicate with each other.

When the liquid feeding portion 74 performs the discharge operation, since the liquid in the liquid feeding chamber 76 is discharged in a pressurized state, the liquid in the liquid feeding chamber 76 flows into the suction-side valve chamber 85 through the first flow path 27*a*. As a result, the negative pressure in the suction-side valve chamber 85 is eliminated, and the annular protrusion 82*b* of the suction-side valve body 82 comes into contact with the inner bottom surface of the suction-side recessed portion 78*b* due to the urging force of the second coil spring 84. In other words, the suction-side one-way valve 70 is closed.

When the liquid feeding portion 71 performs the discharge operation, since the liquid in the liquid feeding chamber 76 is discharged in the pressurized state, in the discharge-side one-way valve 72, the contact portion 89*a* is displaced so as to be separated from the opening of the second flow path 27*b* due to a pressurizing force of the liquid. In other words, the discharge-side one-way valve 72 is opened to open the supply flow path 27. As a result, the liquid flows into the discharge-side valve chamber 88 through the second flow path 27*b*, and at the same time, the incoming liquid is supplied to the liquid storing portion 73 through the third flow path 27*c*.

Figure 10:
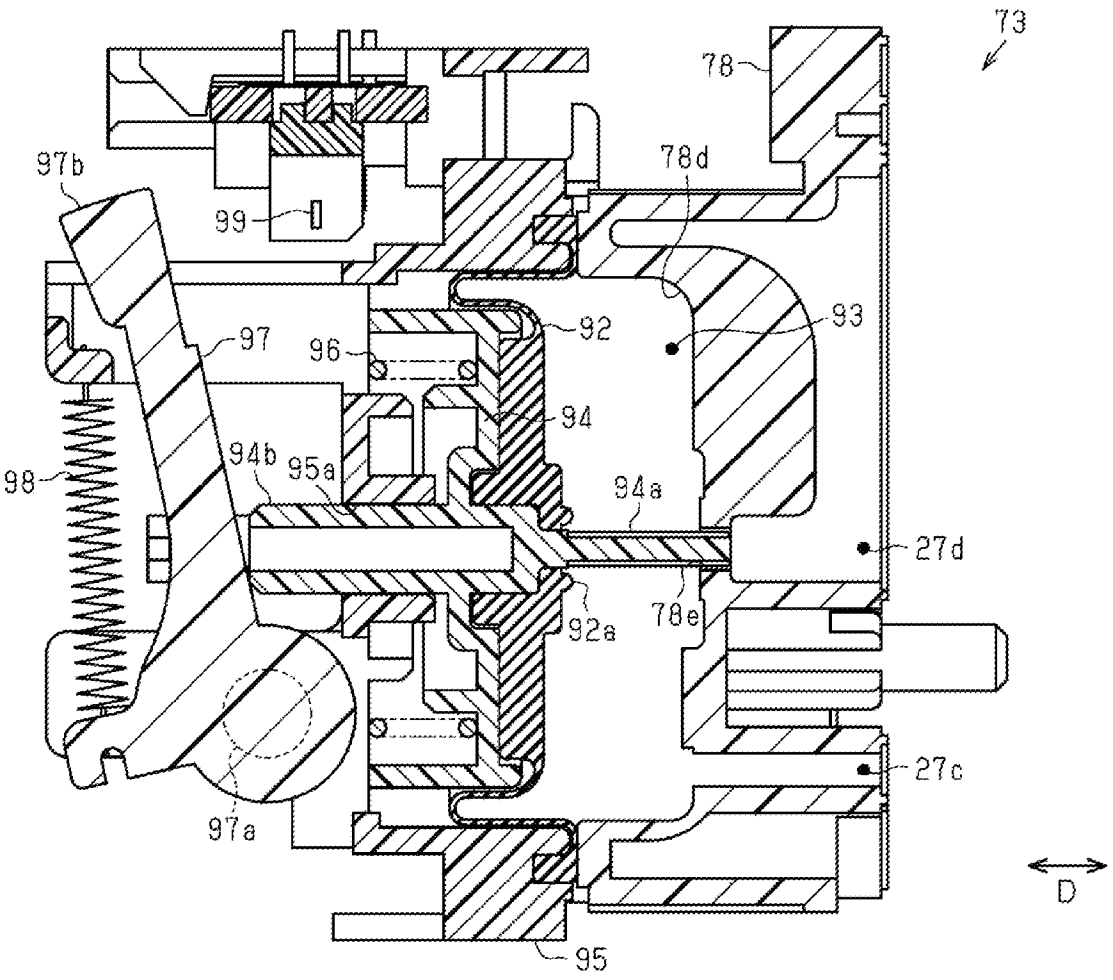
FIG. 10 is a cross-sectional view of a liquid storing portion provided in the flow path unit illustrated in FIG. 5.

As illustrated in FIG. 10, the liquid storing portion 73 includes a liquid chamber 93 that is formed by being surrounded by a liquid storing portion recessed portion 78*d* formed in the flow path forming member 78 and a flexible member 92. A downstream end of the third flow path 27*c* and an upstream end of the fourth flow path 27*d* are coupled to the liquid chamber 93. The third flow path 27*c*, the liquid chamber 93, and the fourth flow path 27*d* configure a portion of the supply flow path 27.

The liquid storing portion 73 communicates with the supply tube 44 illustrated in FIG. 2 through the fourth flow path 27*d*. Then, the liquid flows through the supply tube 44 up to the liquid ejection head 38, which is a downstream end of the supply flow path 27 illustrated in FIG. 2. In other words, in the supply flow path 27, the liquid storing portion 73 is provided between the liquid feeding portion 71 illustrated in FIG. 8 and the liquid ejection head 38.

The liquid storing portion 73 can store the liquid in the liquid chamber 93. The liquid feeding portion 71 provided in the supply channel 27 sucks the liquid from the liquid containing portion 21 and discharges the liquid by continuously performing the suction operation and the discharge operation in an alternating manner. As a result, the liquid feeding portion 71 feeds the liquid to the liquid ejection head 38 through the liquid storing portion 73, while temporarily storing the liquid in the liquid chamber 93 of the liquid storing portion 73.

The liquid storing portion 73 includes a displacement member 94, a fixing member 95, and a first urging member 96. The displacement member 94 is coupled to the flexible member 92 and is displaced together with the flexible member 92. The fixing member 95 fixes the flexible member 92 by coming into contact with an outer edge portion of the flexible member 92. The first urging member 96 is disposed between the displacement member 94 and the fixing member 95. The first urging member 96 is, for example, a coil spring.

The displacement member 94 is provided on an outer surface, which is opposite from an inner surface configuring the liquid chamber 93 of the flexible member 92. Further, the first urging member 96 urges the displacement member 94 to urge the flexible member 92 in a direction that reduces the volume of the liquid chamber 93.

The displacement member 94 includes a first guided portion 94*a* protruding into the liquid chamber 93 along a displacement direction D, and a second guided portion 94*b* protruding toward the side opposite from the liquid chamber 93. Further, a first guide portion 78*e* that guides the first guided portion 94*a* in the displacement direction D of the flexible member 92 is formed in the flow path forming member 78. Further, a second guide portion 95*a* that guides the second guided portion 94*b* in the displacement direction D is formed in the fixing member 95. In other words, the liquid storing portion 73 includes the guide portions 78*e* and 95*a* and the guided portions 94*a* and 94*b*, and the guided portions 94*a* and 94*b* are coupled to the flexible member 92 and displaced together with the flexible member 92.

As illustrated in FIG. 10, the first guided portion 94*a* is provided in a shaft shape so as to protrude toward the liquid chamber 93 side from a substantially central position of the flexible member 92 having a substantially disc shape. Further, the first guide portion 78*e* is formed in a hole shape in the liquid storing portion recessed portion 78*d*, and the first guided portion 94*a* is inserted into the first guide portion 78*e*.

The first guided portion 94*a* is preferably a rod-like columnar body having one or a plurality of recessed lines extending along the displacement direction D, for example, and a portion of the fourth flow path 27*d* is configured by a gap between the first guide portion 78*e* having a round hole shape, and the first guided portion 94*a*. Further, the flexible member 92 includes a closing portion 92*a* that protrudes in an annular shape in a position surrounding the first guided portion 94*a*.

Figure 11:
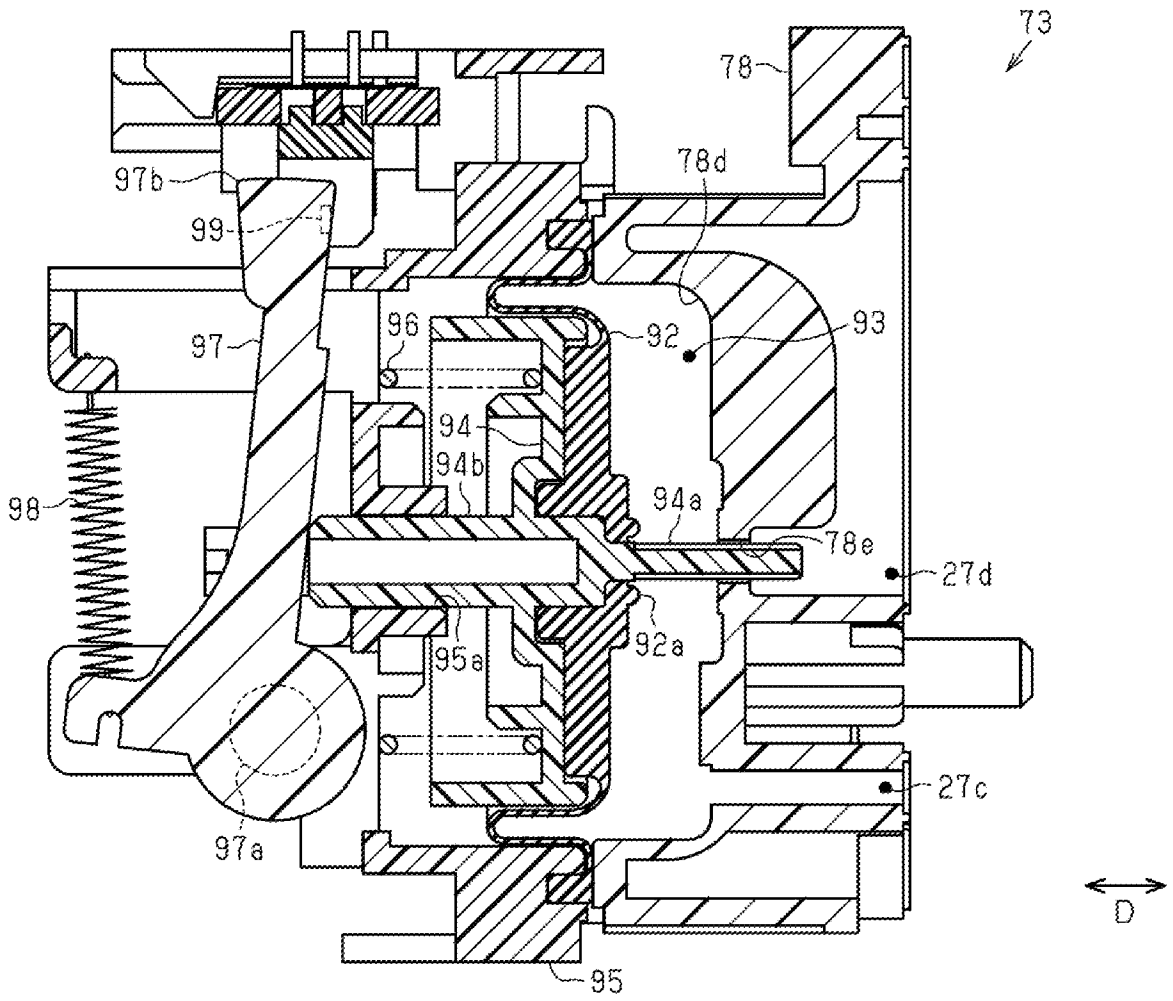
FIG. 11 is a cross-sectional view of the liquid storing portion in a state in which an amount of a liquid has fallen below a predetermined amount.

The first guided portion 94*a* is preferably positioned in a position furthest away from the first guide portion 78*e*, and when the volume of the liquid chamber 93 is greatest, the first guided portion 94*a* preferably has a length that allows the first guided portion 94*a* to engage with the first guide portion 78*e*. Furthermore, as illustrated in FIG. 11, the second guided portion 94*b* is preferably positioned in a position furthest away from the second guide portion 95*a*, and when the volume of the liquid chamber 93 is smallest, the second guided portion 94*b* preferably has a length that allows the second guided portion 94*b* to engage with the second guide portion 95*a*. With such a configuration, a risk of the guided portions 94*a* and 94*b* being separated from the guide portions 78*e* and 95*a* can be reduced.

The liquid storing portion 73 includes a lever portion 97, a second urging member 98 that urges the lever portion 97, and a displacement detector 99, which is an example of a detector. The lever portion 97 is provided so as to be rotatable about a shaft 97*a*. The displacement detector 99 detects the displacement of the flexible member 92 by detecting a detected portion 97*b* of the lever portion 97. The second urging member 98 according to this embodiment is a tension spring.

As illustrated in FIG. 10, when the liquid is fed to the liquid storing portion 73, the liquid flows into the liquid chamber 93 through the third flow path 27*c*. As a result, the closing portion 92*a* is displaced in a direction that increases the volume of the liquid chamber 93. As a result of being pressed against the second guided portion 94*b*, the lever portion 97 is rotated in resistance to an urging force of the second urging member 98, and comes to be in a non-detection posture in which the detected portion 97*b* is not detected by the displacement detector 99.

As illustrated in FIG. 11, when the liquid is not being fed to the liquid storing portion 73, the urging force of the first urging member 96 causes the flexible member 92 to be displaced in the direction that reduces the volume of the liquid chamber 93. As a result, the liquid in the liquid chamber 93 is fed to the liquid ejection head 38 through the fourth flow path 27*d*. At this time, as the second guided portion 94*b* is displaced, the lever portion 97 is rotated by the urging force of the second urging member 98. Then, when an amount of the liquid in the liquid storing portion 73 falls below a predetermined amount, the detected portion 97*b* is detected by the displacement detector 99.

Figure 12:
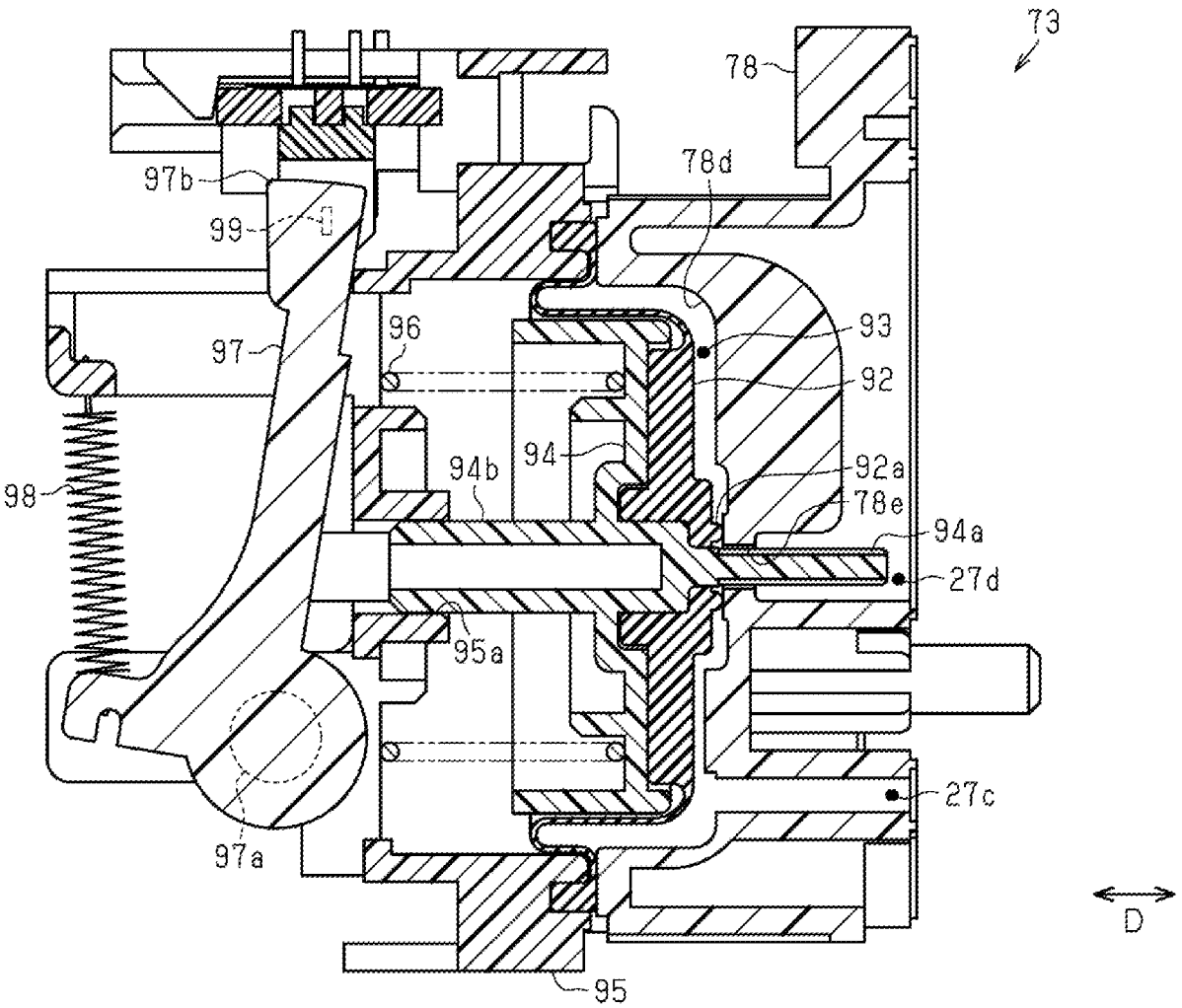
FIG. 12 is a cross-sectional view of the liquid storing portion in a state in which a supply flow path is closed.

As illustrated in FIG. 12, when the amount of liquid in the liquid storing portion 73 is further reduced, the urging force of the first urging member 96 further displaces the flexible member 92 in the direction that reduces the volume of the liquid chamber 93. As a result, the closing portion 92*a* comes into contact with the liquid storing portion recessed portion 78*d*, which forms a wall of the liquid chamber 93, and closes the supply flow path 27. In other words, by surrounding the first guide portion 78*e* by the closing portion 92*a*, the flexible member 92 makes it unable for the liquid chamber 93 and the fourth flow path 27*d* to communicate with each other.

The displacement detector 99, which is an example of the detector, is configured to be able to detect the amount of liquid in the liquid storing portion 73. The displacement detector 99 according to this embodiment is an optical sensor having a light emitting portion and a light receiving portion. Thus, when a state in which the light receiving portion receives light from the light emitting portion changes to a state illustrated in FIG. 11 in which the light from the light emitting portion is blocked by the detected portion 97*b* and does not reach the light receiving portion, the displacement detector 99 detects that the amount of liquid in the liquid storing portion 73 has fallen below the predetermined amount. The displacement detector 99 may continuously measure the amount of liquid in the liquid storing portion 73 using an optical or magnetic linear encoder capable of detecting a continuous displacement.

When the liquid in the liquid containing portion 21 has run out, even if the liquid feeding portion 71 continuously performs the suction operation and the discharge operation in the alternating manner, the liquid is not fed to the liquid storing portion 73. As a result of this, the lever portion 97 is in detection posture in which the detected portion 97*b* is detected by the displacement detector 99. In other words, while the supply mechanism 28 illustrated in FIG. 3 is being driven, when the displacement detector 99 detects that the amount of liquid in the liquid storing portion 73 has fallen below the predetermined amount, the control unit 29 determines that the liquid in the liquid containing portion 21 has run out.

Even when the state in which the interior of the voltage transformation chamber 75 illustrated in FIG. 9 is open to the atmospheric air continues, the diaphragm 77 stops while remaining in the state illustrated in FIG. 9 in which the diaphragm 77 is displaced in the direction that reduces the capacity of the liquid feeding chamber 76, and the liquid is not fed to the liquid storing portion 73. Thus, the lever portion 97 is in the detection posture illustrated in FIG. 12 in which the detected portion 97*b* is detected by the displacement detector 99. In other words, when the supply mechanism 28 illustrated in FIG. 3 is not being driven, even when the displacement detector 99 detects that the amount of liquid in the liquid storing portion 73 has fallen below the predetermined amount, the control unit 29 does not determine that the liquid in the liquid containing portion 21 has run out.

Method for Calculating Remaining Amount of Liquid

Figure 13:
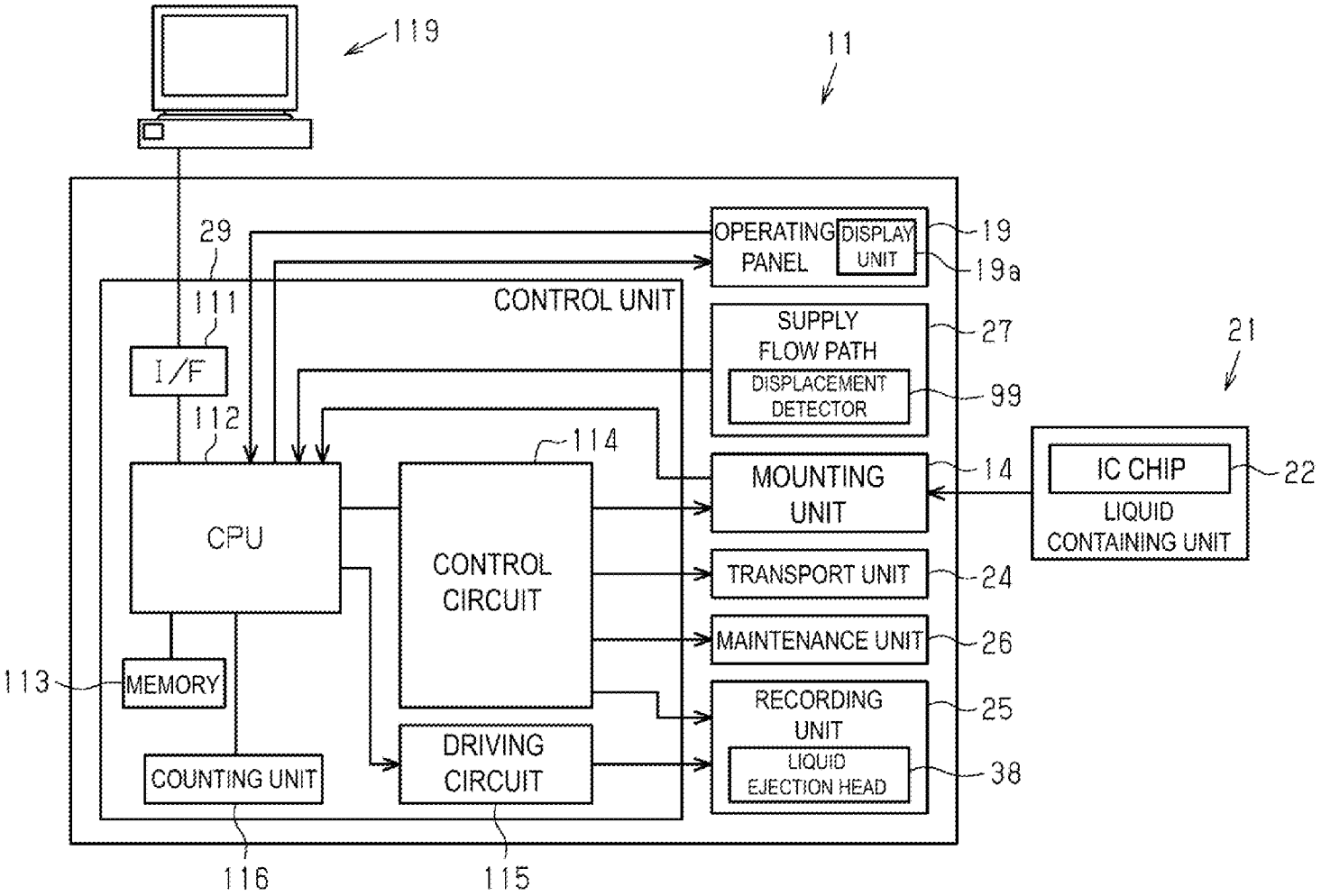
FIG. 13 is a block diagram illustrating an electrical configuration of the liquid ejecting apparatus according to the first embodiment.

As illustrated in FIG. 13, the liquid ejecting apparatus 11 includes the control unit 29 that controls the mounting unit 14, the operating panel 19, the transport unit 24, the recording unit 25, the maintenance unit 26, and the supply flow path 27. The display unit 19*a* included in the operation panel 19 displays a menu, a message, and the like to the user. The displacement detector 99 included in the supply flow path 27 outputs detection result to the control unit 29. The liquid containing portion 21 including an IC chip 22 is mounted in the mounting unit 14. The control unit 29 reads, via the mounting unit 14, information stored in the IC chip 22.

The control unit 29 includes an interface unit 111, a CPU 112, a memory 113, a control circuit 114, a driving circuit 115, and a counting unit 116.

The interface portion 111 transmits and receives data between a computer 119, which is an external device, and the liquid ejecting apparatus 11. The CPU 112 is an arithmetic processing device. The memory 113 is a storage medium that secures a region for storing programs for the CPU 12, a working region, and the like, and includes a storage element such as a RAM and an EEPROM. The CPU 112 controls the mounting unit 14, the transport unit 24, the recording unit 25, and the maintenance unit 26 via the control circuit 114, in accordance with the programs stored in the memory 113. The driving circuit 115 generates a driving signal for driving an actuator of the liquid ejection head 38.

The counting unit 116 calculates a remaining amount Q3 of the liquid in the liquid containing portion 21, based on a contained amount reference value Q1 indicating an amount of the liquid contained in the liquid containing portion 21, and a discharge amount reference value Q2p indicating a discharge amount of the liquid discharged from the liquid ejection head 38.

The contained amount reference value Q1 refers to an amount of the liquid contained in the liquid containing portion 21 that has not been used yet. When the amount of liquid contained in the liquid containing portion 21 is controlled to be at a constant value at the time of shipping the liquid containing portion 21, that value is the contained amount reference value Q1. In other words, the contained amount reference value Q1 is the amount of liquid contained in the liquid containing portion 21 when the liquid containing portion 21 is mounted in the mounting unit 14.

When the liquid containing portion 21 is mounted in the mounting unit 14, the mounting unit 14 and the liquid containing portion 21 are electrically coupled to each other. At this time, the control unit 29 may read the various types of information relating to the liquid containing portion 21, from the IC chip 22 of the liquid containing portion 21 via the mounting unit 14. When the amount of liquid contained in the liquid containing portion 21 is stored in the IC chip 22 at the time of shipping the liquid containing portion 21, a value of the contained amount may be read from the IC chip 22 and may be used as the contained amount reference value Q1. In such a case, the control unit 29 manages the contained amount reference value Q1 as a separate value for each of the liquid containing portions 21.

The discharge amount reference value Q2p refers to the discharge amount of the liquid discharged by the liquid ejection head 38. More specifically, the discharge amount reference value Q2p is the amount of the liquid discharged from one of the nozzles 37 in one shot. Note that a single ejection from one of the nozzles 37 is referred to as the one shot. The control unit 29 manages the discharge amount reference value Q2p as a separate value for each type of the liquid contained in the liquid containing portions 21.

A total discharge amount Q2 is calculated by multiplying the discharge amount reference value Q2p by a number of shots n. In other words, the counting unit 116 calculates the total discharge amount Q2 using the Equation $Q2=Q2p\times n$.

Note that the number of shots n is a number of times obtained by adding together, for all of the nozzles 37, the number of times that the liquid is ejected from one of the nozzles 37, from when the liquid containing portion 21 containing that liquid is mounted in the mounting unit 14. Note that the number of shots n includes a number of times the liquid is ejected to perform the flushing, as well as the number of times the liquid is ejected onto the medium S to perform the recording. When the discharge amount reference value Q2p changes depending on driving conditions of the actuator of the liquid ejection head 38, or environmental conditions such as the temperature and humidity, the discharge amount reference value Q2p may be a value that changes depending on those conditions. Further, when the discharge amount reference value Q2p is affected by a recording duty, the discharge amount reference value Q2p may be a value that changes depending on the recording duty.

The total discharge amount Q2 may also be calculated by adding amounts of the liquid discharged from the liquid ejection head 38 due to maintenance such as the suction cleaning. For example, the total discharge amount Q2 may be calculated by adding values respectively obtained by multiplying a suction amount reference value Q2s in one cleaning, by a number of cleaning operations m. In other words, the counting unit 116 may calculate the total discharge amount Q2 using the Equation $Q2=(Q2p\times n)+(Q2s\times m)$. The suction amount reference value Q2s is an amount of the liquid discharged from the entire liquid ejection head 38 in one suction cleaning. The number of cleaning operations m is a number of times the suction cleaning is performed on the liquid ejection head 38 from when the liquid containing portion 21 containing that liquid is mounted in the mounting unit 14. In the suction cleaning, when an intensity of sucking the liquid is adjusted, the suction amount reference value Q2s may be a value that changes depending on the intensity of sucking the liquid.

The liquid containing portion 21 according to this embodiment does not include a remaining amount sensor that detects an amount of liquid remaining in the liquid containing portion 21. However, the counting unit 116 subtracts the total discharge amount Q2 from the contained amount reference value Q1. As a result, the liquid ejecting apparatus 11 according to this embodiment is configured be able to calculate the remaining amount Q3 of the liquid in the liquid containing portion 21. In other words, the counting unit 116 calculates the remaining amount Q3 using the Equation $Q3=Q1-Q2$.

In this embodiment, the counting unit 116 calculates, with respect to the four liquid containing portions 21, the remaining amounts Q3 of the liquids in the respective liquid containing portions 21, based on the respective contained amount reference values Q1 and the respective discharge amount reference values Q2p. For example, when the four liquid containing bodies 20 contain the black, cyan, magenta, and yellow inks, respectively, the counting unit 116 calculates a remaining amount Q3a of the black ink, a remaining amount Q3b of the cyan ink, a remaining amount Q3c of the magenta ink, and a remaining amount Q3d of the yellow ink. More specifically, for example, with respect to the liquid containing portion 21 containing the black ink, the remaining amount Q3a of the black ink is calculated based on a contained amount volume reference value Q1a of the black ink and a discharge amount reference value Q2pa of the black ink.

The counting unit 116 calculates the remaining amount Q3 each time the liquid is discharged from the liquid ejection head 38, from when the liquid containing portion 21 is mounted in the mounting unit 14 until when the liquid contained in that liquid containing portion 21 runs out. In other words, while the supply mechanism 28 illustrated in FIG. 3 is being driven, the counting unit 116 continuously calculates the remaining amount Q3 of the liquid in the liquid containing portion 21 until the displacement detector 99 corresponding to that liquid detects that the amount of liquid in the liquid storing portion 73 has fallen below the predetermined amount. As a result, the liquid ejecting apparatus 11 is configured so that the control unit 29 can change driving control of the liquid feeding portion 71 in accordance with the remaining amount Q3 of the liquid in the liquid containing portion 21.

It is desirable that the discharge amount reference value Q2p and the suction amount reference value Q2s be set so that the remaining amount Q3 calculated by the counting unit 116 is a value close to "zero" when the liquid in the liquid containing portion 21 runs out. As a result, the control unit 29 can increase the accuracy of a timing at which the control unit 29 changes the driving control of the liquid feeding portion 71.

The liquid containing portion 21 may include a remaining amount sensor that detects the remaining amount Q3 of the liquid in that liquid containing portion 21. Further, the mounting unit 14 may also include a remaining amount sensor that detects the remaining amount Q3 of the liquid in the liquid containing portion 21 mounted in that mounting unit 14. For example, the remaining amount Q3 may be detected by detecting the height of a liquid level using an optical sensor. Then, the control unit 29 may change the driving control of the liquid feeding portion 71 in accordance with the remaining amount Q3 detected by the remaining amount sensor instead of the remaining amount Q3 calculated by the counting unit 116. Further, the control unit 29 may change the driving control of the liquid feeding portion 71 between when the remaining amount Q3 detected by the remaining amount sensor has fallen below a threshold value Qt, and when the remaining amount Q3 detected by the remaining amount sensor is equal to or greater than the threshold value Qt.

As described above, in this embodiment, the counting unit 116 calculates the remaining amounts Q3a, Q3b, Q3c, Q3d in the four liquid containing portions 21, respectively. As a result, the control unit 29 changes the driving control of the liquid feeding portions 71 in accordance with values of the remaining amounts Q3a, Q3b, Q3c, and Q3d, respectively. Furthermore, the control unit 29 changes the driving control of the liquid feeding portions 71 between when at least one of the remaining amounts Q3a, Q3b, Q3c, and Q3d has fallen below the threshold value Qt, and when all of the remaining amounts Q3 are equal to or greater than the corresponding threshold values Qt. Note that threshold values Qta, Qtb, Qtc, and Qtd corresponding to the four liquid containing portions 21, respectively, may be set so that the threshold Qt can be changed depending on the type of liquid contained in the liquid containing portion 21. The driving control of the liquid feeding portion 71 and the threshold value Qt will be described later.

Negative Pressure and Threshold Value

Figure 14:
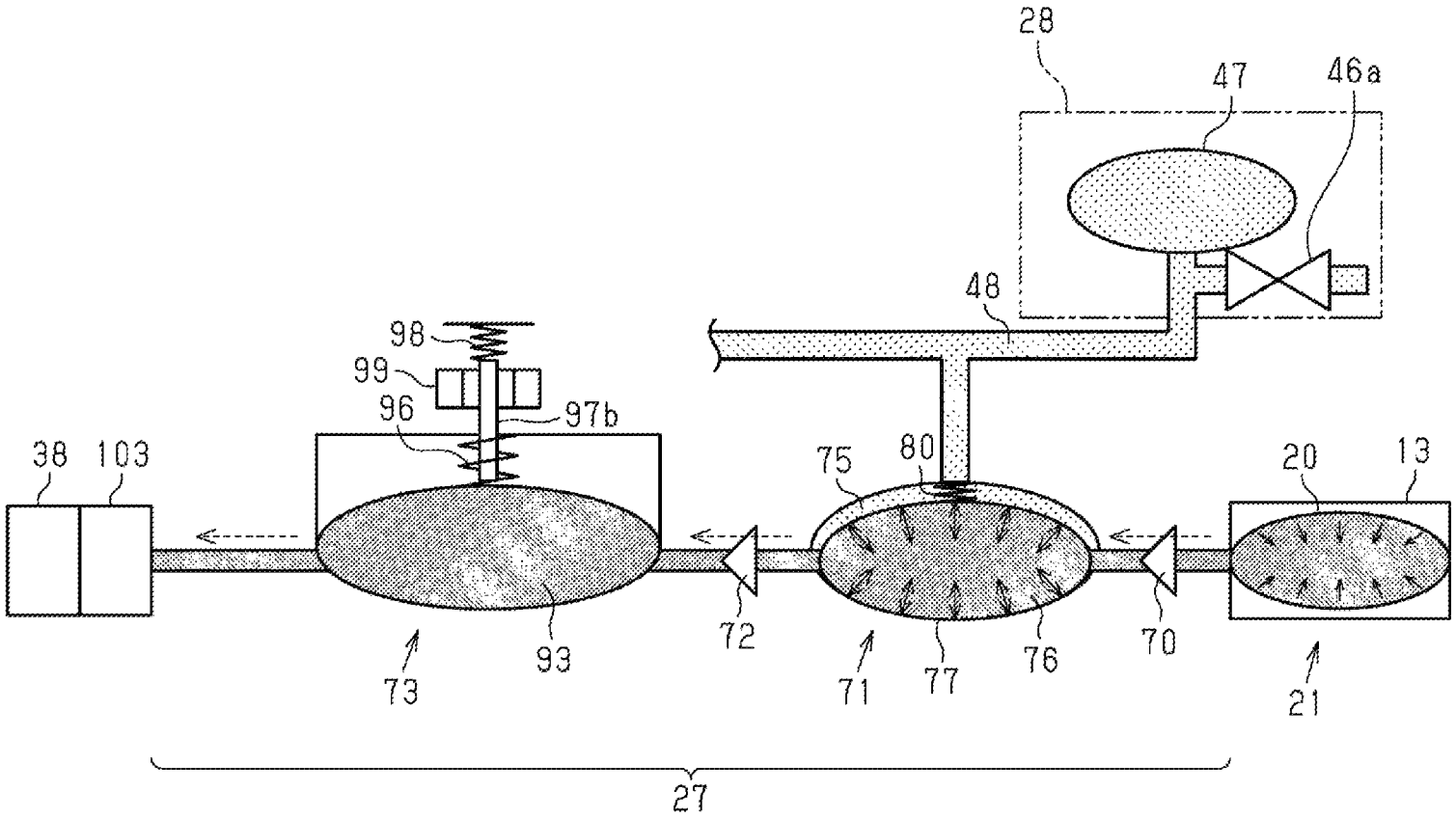
FIG. 14 is a schematic view of the supply flow path according to the first and second embodiments.

As illustrated in FIG. 14, the liquid containing portion 21 is coupled to the upstream end of the supply flow path 27. The liquid ejection head 38 is coupled to the downstream end of the supply flow path 27 via a pressure adjusting valve 103. The pressure adjusting valve 103 is a differential pressure valve that opens when a flow path pressure is lower than the outside air pressure and a difference between the flow path pressure and the outside air pressure is equal to or greater than a set value, the flow path pressure being a pressure between a valve body of the pressure adjusting valve 103 and the liquid ejection head 38. As a result, the pressure of the liquid supplied to the liquid ejection head 38 can be adjusted to be an adjusted pressure that can be ejected from the nozzles 37.

The supply mechanism 28 includes the driving source 47 and an atmospheric air open valve 46*a*. When the driving source 47 is driven in a state in which the atmospheric open valve 46*a* is closed, the pressure in the voltage transformation flow path 48 is reduced. As a result, the liquid feeding portion 71 coupled to the voltage transformation flow path 48 performs the suction operation. Further, when the driving source 47 is stopped and the atmospheric air open valve 46*a* is opened, the pressure in the voltage transformation flow path 48 returns to its original state. As a result, the liquid feeding portion 71 coupled to the voltage transformation flow path 48 performs the discharge operation. In this embodiment, the four liquid feeding portions 71 coupled to the voltage transformation flow path 48 simultaneously perform the discharge operation.

When the suction operation is performed by the liquid feeding portion 71 when the remaining amount Q3 of the liquid in the liquid containing portion 21 is low, the pressure inside the liquid containing body 20 becomes negative. Further, when the liquid feeding portion 71 performs the suction operation around a timing at which the liquid in the liquid containing portion 21 has nearly run out, a high negative pressure acts inside the liquid containing body 20. The high negative pressure of the liquid inside the liquid containing body 20 is partly caused by a restoring force generated as a result of the liquid containing body 20 that is in a collapsed state attempting to return to its original shape. Then, in the supply flow path 27, a flow path between the liquid containing portion 21 and the suction-side one-way valve 70 is subjected to the high negative pressure. A material of the flow path is a resin. The resin has gas permeability, and has properties that allow a small amount of gas to permeate. Further, although a coupling portion and the like between the liquid containing portion 21 and the supply flow path 27 are sealed, there is a possibility that a small amount of gas flows into the coupling portion due to an excessive differential pressure. Thus, due to the high negative pressure in the flow path between the liquid containing portion 21 and the suction-side one-way valve 70, air may flow, as air bubbles, into the liquid containing body 20 through gas permeation via a resin wall of the supply flow path 27, or through an inflow of gas from the coupling portion between the liquid containing portion 21 and the supply flow path 27. Even when the air that has flowed into the liquid containing body 20 is dissolved in the liquid or is in the form of extremely small air bubbles, the air may grow into air bubbles of a certain size over time. Around the timing at which the liquid in the liquid containing portion 21 has nearly run out, the longer the time period during which the interior of the liquid containing body 20 is kept in the high negative pressure state, the more likely the air bubbles are to be generated in the liquid contained in the liquid containing body 20. Then, the ejection failure occurs as a result of the air bubbles flowing out of the liquid containing portion 21 with the liquid, flowing into the supply flow path 27, and reaching the liquid ejection head 38.

It is desirable that a relationship between a number of the liquid containing portions 21 in which the liquid is used and an accumulated amount of air bubbles flowing into the supply flow path 27 be determined in advance, and powerful suction cleaning be performed in the supply flow path 27 immediately before the air bubbles that have flowed into the supply flow path 27 reach an accumulated amount large enough to reach the liquid ejection head 38, and immediately after the liquid containing portion 21 has been replaced. As a result, the air bubbles accumulated in the supply flow path 27 can be instantly discharged from the liquid ejection head 38, and an air bubble state in the supply flow path 27 can be reset. Then, the amount of air bubbles in the supply flow path 27, which cause the ejection failure in the liquid ejection head 38, can be reduced.

The threshold value Qt is an amount of the liquid in the liquid containing portion 21 around the timing at which the liquid in the liquid containing portion 21 has nearly run out, and is set to be an amount of the liquid in the liquid containing portion 21 when the high negative pressure starts to act inside the liquid containing portion 21. For example, when an amount of liquid to be used, from when the liquid in the liquid feeding portion 71 has run out after the liquid in the liquid containing portion 21 has run out, to when the amount of liquid in the liquid storing portion 73 falls below the predetermined amount, is 3 grams, the threshold value Qt is set to a value equal to or greater than 3 grams. The threshold value Qt differs depending on the size and structure of the liquid containing body 20 to be used, but is set to 10 grams, for example.

The control unit 29 changes the driving control of the liquid feeding portion 71 in accordance with the remaining amount Q3 of the liquid in the liquid containing portion 21, so that the high negative pressure acting inside the liquid containing portion 21 is suppressed. Compared to when the remaining amount Q3 is equal to or greater than the corresponding threshold value Qt, when the remaining amount Q3 has fallen below the threshold value Qt, the control unit 29 reduces an amount of liquid the liquid feeding portion sucks 71 at one time, and at the same time, increases a number of times the liquid feeding portion 71 sucks the liquid. By reducing the amount of liquid the liquid feeding portion sucks 71 at one time, the negative pressure acting inside the liquid containing portion 21 is reduced. In this embodiment, when the driving source 47 included in the supply mechanism 28 is driven, pressures in the four voltage transformation chambers 75 all become negative. Thus, compared to when the remaining amounts Q3 of the liquid in all of the liquid containing portions 21 are equal to or greater than the corresponding threshold values Qt, when the remaining amount Q3 of the liquid in at least one of the liquid containing portions 21 has fallen below the threshold value Qt, the control unit 29 reduces the amount of liquid the liquid feeding portion sucks 71 at one time, and at the same time, increases the number of times that the liquid feeding portion 71 sucks the liquid. As a result, in this embodiment, the liquid ejecting apparatus 11 according to the embodiment is configured so that, when the liquid feeding portion 71 performs the suction operation, the high negative pressure acting inside the liquid containing portion 21 is suppressed with respect to all of the liquid containing portions 21.

The control unit 29 changes the driving control of the liquid feeding portion 71 in accordance with the remaining amount Q3 of the liquid in the liquid containing portion 21, so that the high negative pressure acting inside the liquid containing portion 21 is suppressed. Compared to when the remaining amount Q3 is equal to or greater than the corresponding threshold value Qt, when the remaining amount Q3 has fallen below the threshold value Qt, the control unit 29 reduces a velocity at which the liquid feeding portion 71 sucks the liquid. By reducing the velocity at which the liquid feeding portion 71 sucks the liquid, the negative pressure acting inside the liquid containing portion 21 is reduced. In this embodiment, when the driving source 47 included in the supply mechanism 28 is driven, the pressures in the four voltage transformation chambers 75 all become negative. Thus, compared to when the remaining amounts Q3 of the liquid in all of the liquid containing portions 21 are equal to or greater than the corresponding threshold values Qt, when the remaining amount Q3 in at least one of the liquid containing portions 21 has fallen below the threshold value Qt, the control unit 29 reduces the velocity at which the liquid feeding portion 71 sucks the liquid. As a result, the liquid ejecting apparatus 11 according to this embodiment is configured so that, when the liquid feeding portion 71 performs the suction operation, the high negative pressure acting inside the liquid containing portion 21 is suppressed with respect to all of the liquid containing portions 21.

The control unit 29 changes the driving control of the liquid feeding portion 71 in accordance with the remaining amount Q3 of the liquid in the liquid containing portion 21, so that a number of times a negative pressure acts inside the liquid containing portion 21 is reduced. When the remaining amount Q3 of the liquid in the liquid containing portion 21 is equal to or greater than the threshold value Qt, the control unit 29 causes the liquid feeding portion 71 to feed the liquid before the amount of liquid in the liquid storing portion 73 falls below the predetermined amount. Then, after the remaining amount Q3 of the liquid in the liquid containing portion 21 has fallen below the threshold value Qt, the control unit 29 causes the liquid feeding portion 71 to feed the liquid after the amount of liquid in the liquid storing portion 73 has fallen below the predetermined amount. As a result, since the feeding of the liquid by the liquid feeding portion 71 is stopped until the amount of liquid in the liquid storing portion 73 falls below the predetermined amount, the number of times the negative pressure acts inside the liquid containing portion 21 is reduced. In this embodiment, when the driving source 47 included in the supply mechanism 28 is driven, the pressures in the four voltage transformation chambers 75 all become negative. Thus, when the remaining amounts Q3 of the liquid in all of the liquid containing portions 21 are equal to or greater than the corresponding threshold values Qt, the control unit 29 causes the liquid feeding portion 71 to feed the liquid before the amount of liquid in at least one of the liquid storing portions 73 falls below the predetermined amount. Then, after the remaining amount Q3 of the liquid in at least one of the liquid containing portions 21 has fallen below the threshold value Qt, the control unit 29 causes the liquid feeding portion 71 to feed the liquid after the amount of liquid in one of the liquid storing portions 73 has fallen below the predetermined amount. As a result, since the feeding of the liquid by the liquid feeding portion 71 is stopped until the amount of liquid in at least one of the liquid storing portions 73 falls below the predetermined amount, the liquid ejecting apparatus 11 according to this embodiment is configured so that, during that time period, the negative pressure is suppressed in all of the liquid containing portions 21.

Here, when the remaining amount Q3 has fallen below the threshold value Qt, at least one of the operations, namely, reducing the amount of liquid the liquid feeding portion sucks 71 at one time, increasing the number of times the liquid feeding portion 71 sucks the liquid, reducing the velocity at which the liquid feeding portion sucks the liquid, and causing the liquid feeding portion 71 to feed the liquid after the amount of liquid in the liquid storing portion 73 has fallen below the predetermined amount, may be performed. In this case also, when the liquid feeding portion 71 performs the suction operation, the high negative pressure acting inside the liquid containing portion 21 is suppressed with respect to all of the liquid containing portions 21.

A timing at which the air bubbles that have flowed into the liquid containing portion 21 start to flow into the supply flow path 27 changes depending on the temperature and a mounting period of the liquid containing portion 21. For example, when the temperature of the liquid is high, the air bubbles easily grow. When the temperature of the liquid containing body 20 is low, the rigidity of the liquid containing body 20 increases, and thus, the negative pressure becomes greater, which makes it easier for the air bubbles to grow. Further, when the mounting period of the liquid containing portion 21 is long, the air bubbles easily grow. Thus, it is desirable that the control unit 29 changes the timing of changing the driving control of the liquid feeding portion 71 depending on the temperature and the mounting period of the liquid containing portion 21. In other words, it is desirable for the control unit 29 to change the threshold value Qt depending on the temperature and the mounting period of the liquid containing portion 21. Then, it is desirable for the control unit 29 to change the threshold value Qt for the remaining amount Q3 of the liquid in each of the liquid containing portions 21, depending on the temperature of each of the liquid containing bodies 20 and the mounting period of each of the liquid containing portions 21.

As described above, the liquid feeding portions 71 may be respectively coupled to each of the separate voltage transformation flow paths 48. Then, those voltage transformation flow paths 48 may be respectively coupled to each of the separate supply mechanisms 28. As a result, the driving of the liquid feeding portion 71 can be controlled for each of the liquid containing portions 21. Specifically, in accordance with the remaining amount Q3 of the liquid in each of the liquid containing portions 21, only the driving control of the liquid feeding portion 71 corresponding to the target liquid containing portion 21 can be changed. In other words, in accordance with an acting state of the negative pressure in each of the liquid containing portions 21, it is possible to change the driving control of the liquid feeding portion 71 corresponding to the target liquid containing portion 21 only.

Method for Controlling Driving of Liquid Feeding Portion

First, operations of the liquid feeding portion 71 and the liquid storing portion 73 in a method for controlling the liquid ejecting apparatus 11 according to this embodiment will be described sequentially in accordance with changes in the remaining amount Q3 of the liquid in the liquid containing portion 21.

As illustrated in FIG. 14, when the remaining amounts Q3 of the liquid in all of the liquid containing portions 21 are equal to or greater than the threshold values Qt, as a result of the suction operation and the discharge operation being continuously performed in the alternating manner, the control unit 29 causes the liquid feeding portions 71 to supply the liquid from all of the liquid containing portions 21 to the liquid ejection head 38 through the liquid feeding portions 71 and the liquid storing portions 73, in a direction indicated by dashed line arrows illustrated in FIG. 14. Then, the control unit 29 causes the liquid feeding portion 71 to feed the liquid before the amount of liquid in the liquid storing portion 73 falls below the predetermined amount.

Figure 15:
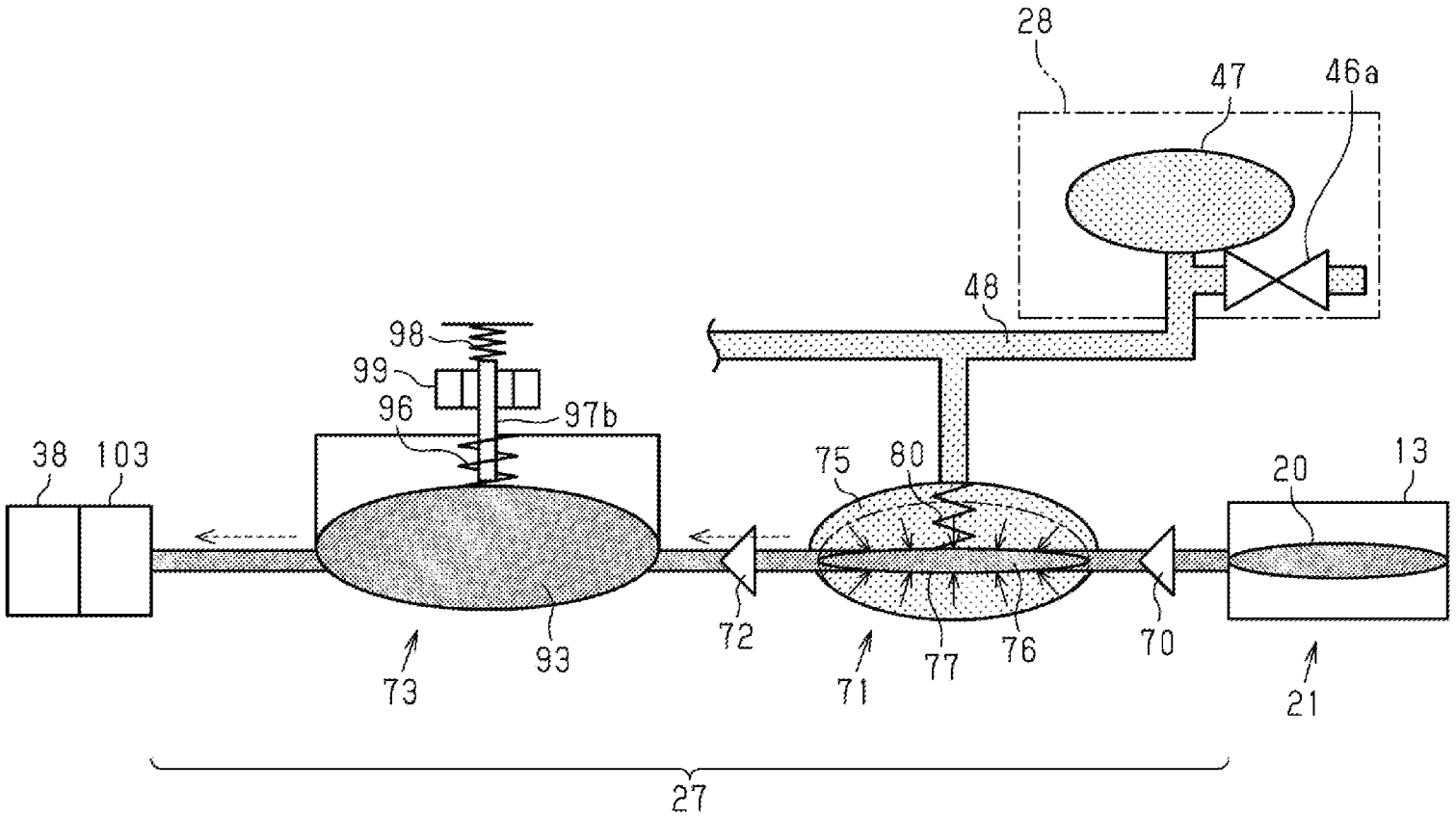
FIG. 15 is a schematic view illustrating a state in which, in the supply flow path illustrated in FIG. 14, the liquid in a liquid feeding portion is used when a remaining amount of the liquid has fallen below a threshold value.

As illustrated in FIG. 15, when the remaining amount Q3 of the liquid in at least one of the liquid containing portions 21 has fallen below the threshold value Qt, the control unit 29 stops the feeding of the liquid by the liquid feeding portion 71. In other words, the control unit 29 stops driving the driving source 47, and opens the atmospheric air open valve 46*a*. As a result, the diaphragm 77 is displaced in the direction that reduces the capacity of the liquid feeding chamber 76 due to the urging force of the first coil spring 80, thus causing all of the liquid feeding portions 71 to perform the discharge operation. All of the liquid feeding portions 71 feed the liquid in the liquid feeding portions 71 from the liquid feeding portions 71 to the liquid ejection head 38 through the liquid storing portions 73, in a direction indicated by dashed line arrows illustrated in FIG. 15. Then, when the diaphragm 77 stops while remaining in the state illustrated in FIG. 9 in which the diaphragm 77 is displaced in the direction that reduces the capacity of the liquid feeding chamber 76, the liquid is no longer fed from the liquid feeding portion 71 to the liquid storing portion 73.

Figure 16:
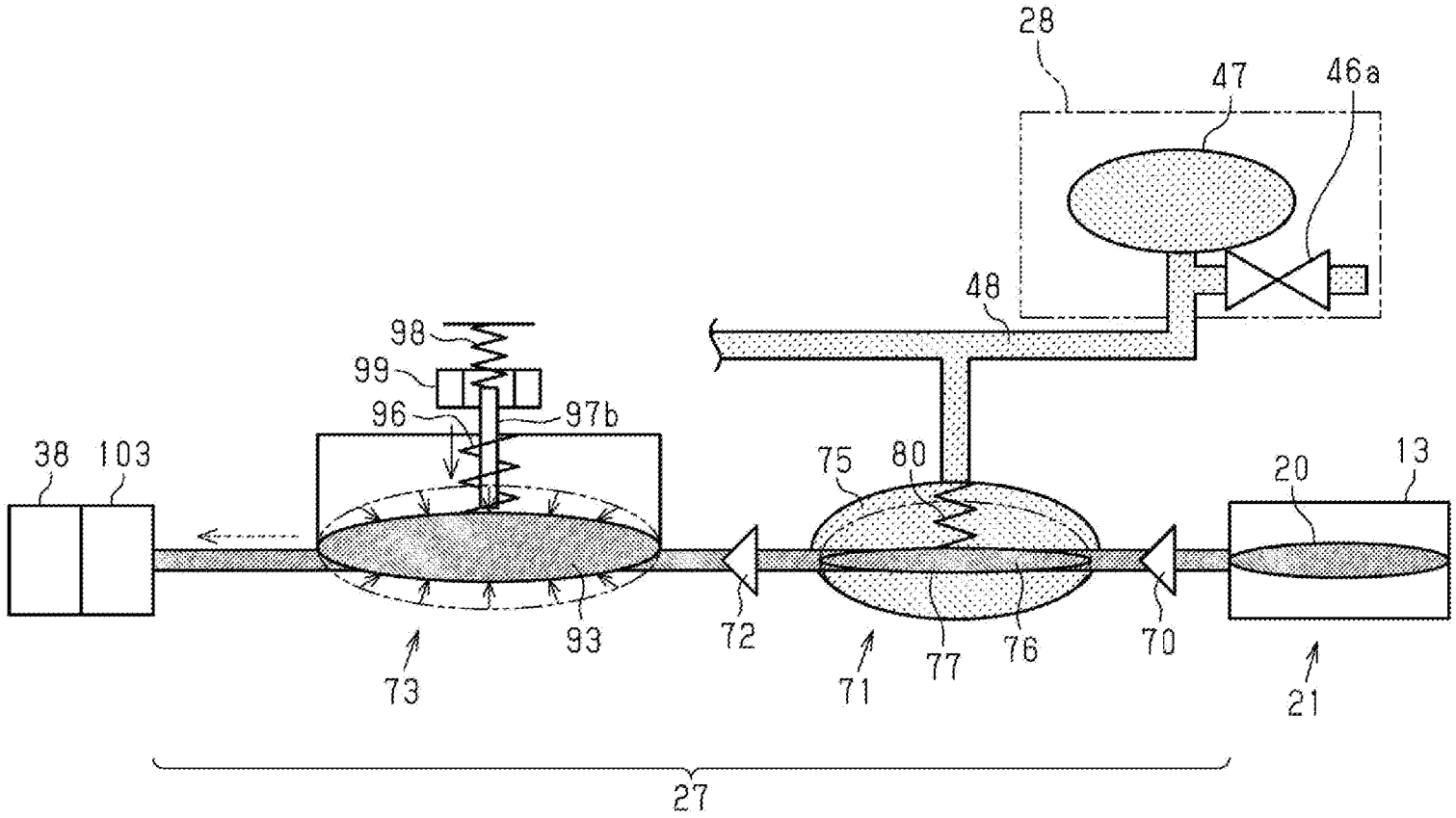
FIG. 16 is a schematic view illustrating a state in which, in the supply flow path illustrated in FIG. 14, the liquid in the liquid storing portion is used when the remaining amount of the liquid has fallen below the threshold value.

As illustrated in FIG. 16, when the liquid is not being fed from the liquid feeding portion 71 to the liquid storing portion 73, the urging force of the first urging member 96 causes the flexible member 92 to be displaced in the direction that reduces the capacity of the liquid chamber 93. As a result, the liquid in the liquid storing portion 73 is fed to the liquid ejection head 38 in a direction indicated by dashed line arrows illustrated in FIG. 16. When the amount of liquid in the liquid storing portion 73 has fallen below the predetermined amount, the detected portion 97*b* is detected by the displacement detector 99. As a result, the amounts of liquid in all of the liquid storing portions 73 corresponding to the four liquid containing portions 21 sequentially fall below the predetermined amount.

Figure 17:
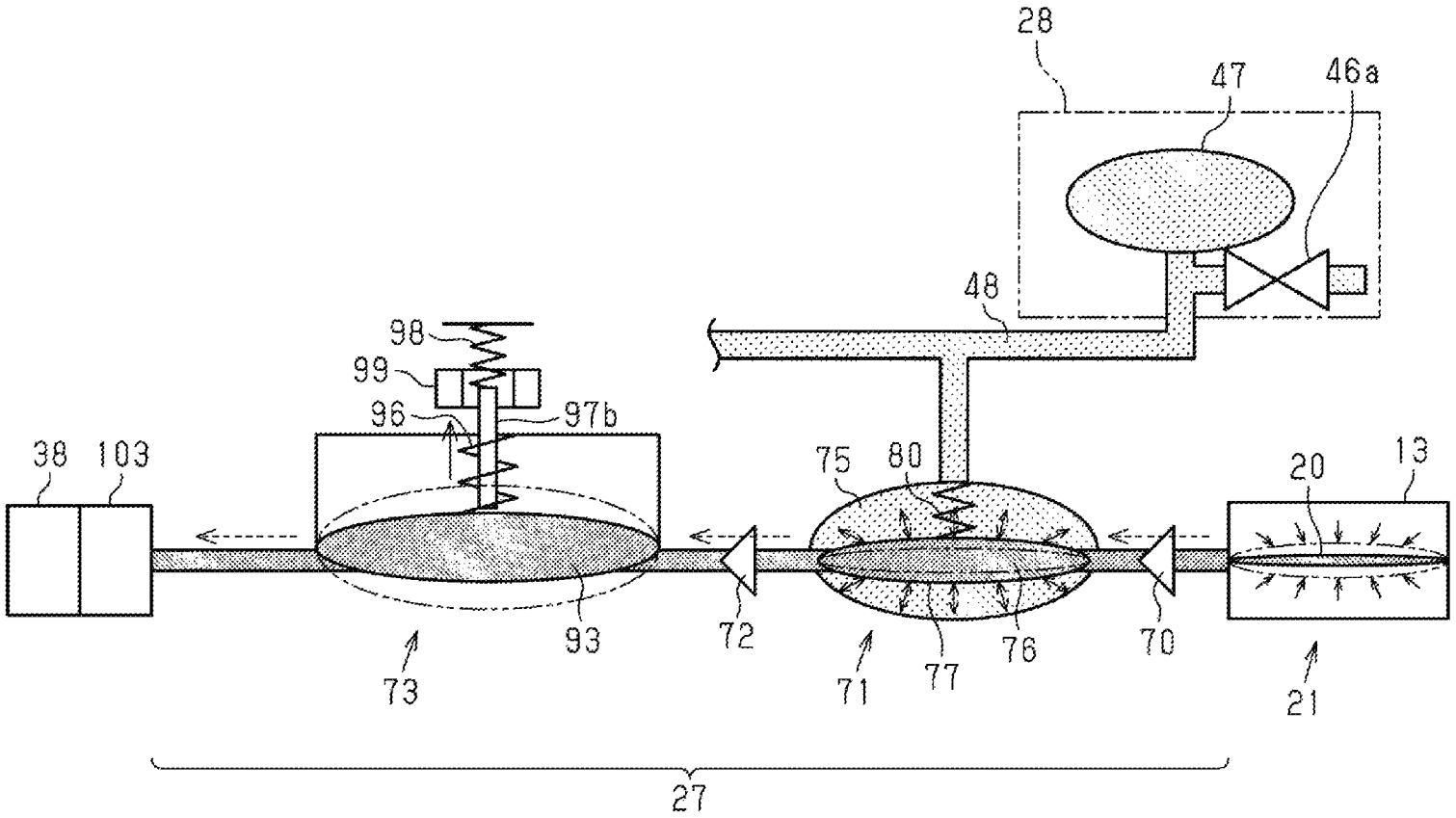
FIG. 17 is a schematic view illustrating a state in which, in the supply flow path illustrated in FIG. 14, the liquid in the liquid containing portion is used when the remaining amount of the liquid has fallen below the threshold value.

As illustrated in FIG. 17, when the amount of liquid in at least one of the liquid storing portions 73 has fallen below the predetermined amount, the control unit 29 causes the liquid feeding portion 71 to continuously perform the suction operation and the discharge operation in the alternating manner. In other words, after the remaining amount Q3 of the liquid in the liquid containing portion 21 has fallen below the threshold value Qt, the control unit 29 causes the liquid feeding portion 71 to feed the liquid after the amount of liquid in the liquid storing portion 73 has fallen below the predetermined amount. At this time, compared to when the remaining amount Q3 is equal to or greater than the corresponding threshold value Qt, the control unit 29 reduces the amount of liquid the liquid feeding portion sucks 71 at one time, and at the same time, increases the number of times the liquid feeding portion 71 sucks the liquid. Then, compared to when the remaining amount Q3 is equal to or greater than the corresponding threshold value Qt, the control unit 29 reduces the velocity at which the liquid feeding portion 71 sucks the liquid. In this embodiment, after the remaining amount Q3 of the liquid in at least one of the liquid containing portions 21 has fallen below the threshold value Qt, the control unit 29 causes the liquid feeding portion 71 to feed the liquid after the amount of liquid in one of the liquid storing portions 73 has fallen below the predetermined amount. At this time, compared to when the remaining amounts Q3 of the liquid in all of the liquid containing portions 21 are equal to or greater than the corresponding threshold values Qt, the control unit 29 reduces the amount of liquid the liquid feeding portion sucks 71 at one time, and at the same time, increases the number of times the liquid feeding portion 71 sucks the liquid. Then, compared to when the remaining amounts Q3 of the liquid in all of the liquid containing portions 21 are equal to or greater than the corresponding threshold values Qt, the control unit 29 reduces the velocity at which the liquid feeding portion 71 sucks the liquid.

As a result of the suction operation and the discharge operation being continuously performed in the alternating manner, the liquid feeding portion 71 feeds the liquid from the liquid containing portion 21 to the liquid ejection head 38 through the liquid feeding portion 71 and the liquid storing portion 73, in a direction indicated by dashed line arrows illustrated in FIG. 17. At this time, the amount of liquid in the liquid storing portion 73 temporarily exceeds the predetermined amount. However, the liquid in the liquid containing portion 21, in which the remaining amount Q3 of the liquid has fallen below the threshold value Qt earlier, immediately runs out. Thus, the liquid is not fed to the liquid storing portion 73 from the liquid feeding portion 71 corresponding to the liquid containing portion 21 from which the liquid has run out. As a result, since the amount of liquid in the corresponding liquid storing portion 73 falls below the predetermined amount, the detected portion 97*b* is detected by the displacement detector 99 of the corresponding liquid storing portion 73. At this time, the liquid ejecting apparatus 11 stops accepting a recording job until the liquid containing portion 21 from which the liquid has run out is replaced with the new liquid containing portion 21 by the user.

Figure 18:
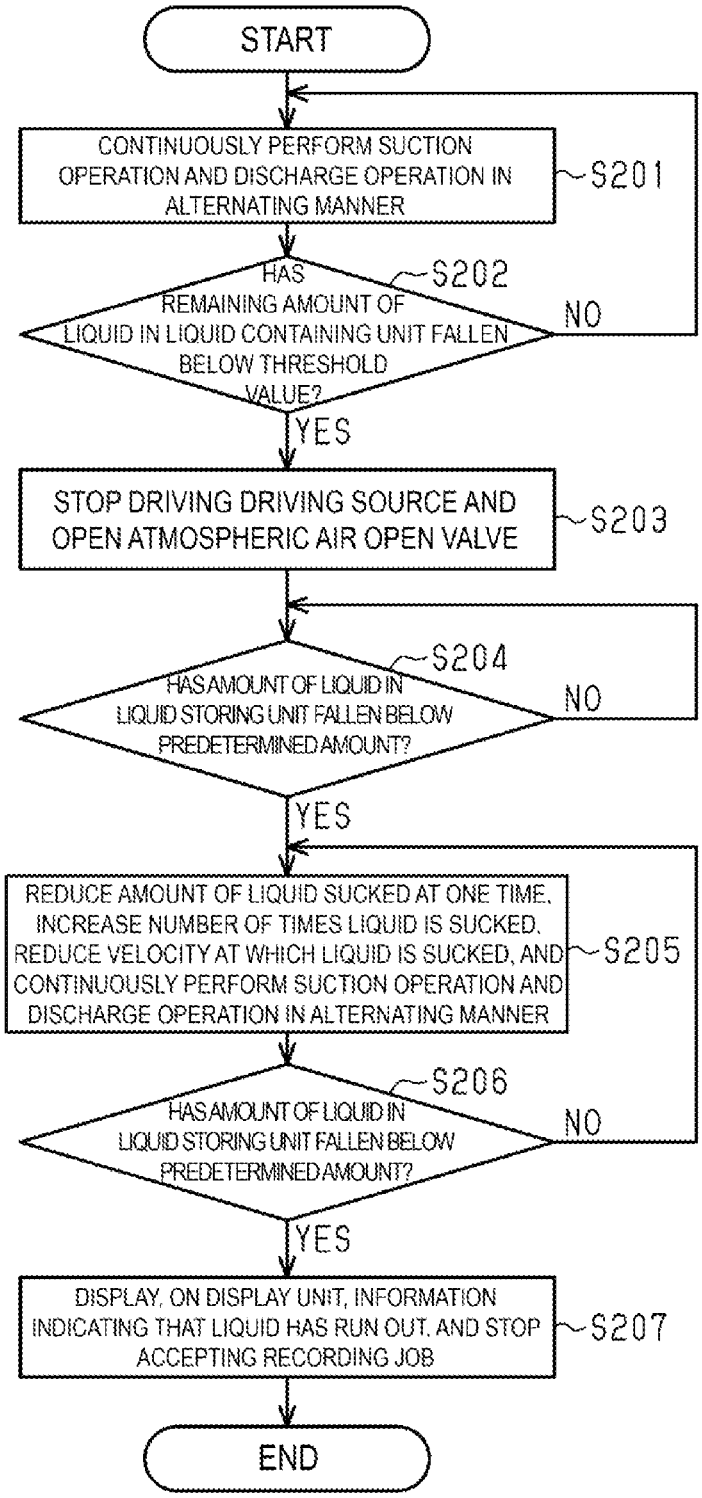
FIG. 18 is a flowchart illustrating a method for controlling the liquid ejecting apparatus according to the first embodiment.

Next, with reference to a flowchart illustrated in FIG. 18, control performed by the control unit 29 at each of steps will be sequentially described with respect to a method for controlling the liquid ejecting apparatus 11 applied when controlling the driving of the liquid feeding portion 71. Note that the control unit 29 only starts this flow after the new liquid containing portion 21 is mounted in the mounting unit 14 of the liquid ejecting apparatus 11, and the liquid is stored in the liquid chamber 93 of the liquid storing portion 73. In other words, this flow is started when the remaining amounts Q3 of the liquid in all of the liquid containing portions 21 are equal to or greater than the corresponding threshold values Qt, and the amounts of liquid in all of the liquid storing portions 73 are equal to or greater than the predetermined amount.

At step S201, the control unit 29 causes the liquid feeding portion 71 to continuously perform the suction operation and the discharge operation in the alternating manner. In other words, in the method for controlling the liquid ejecting apparatus 11, the control unit 29 causes the liquid feeding portion 71 to feed the liquid before the amount of liquid in the liquid storing portion 73 falls below the predetermined amount.

At step S202, the control unit 29 determines whether or not the remaining amount Q3 of the liquid in the liquid containing portion 21 has fallen below the threshold value Qt. In this embodiment, the control unit 29 determines whether or not the remaining amount Q3 of the liquid in at least one of the liquid containing portions 21 has fallen below the threshold value Qt. When all of the remaining amounts Q3 are equal to or greater than the corresponding threshold values Qt, the control unit 29 continues the control at step S201 until one of the remaining amounts Q3 falls below the threshold value Qt. When at least one of the remaining amounts Q3 has fallen below the threshold value Qt, the control unit 29 proceeds to step S203.

At step S203, the control unit 29 stops driving the driving source 47 and opens the atmospheric air open valve 46*a*. Then, at step S204, the control unit 29 determines whether or not the amount of liquid in the liquid storing portion 73 has fallen below the predetermined amount. In this embodiment, the control unit 29 determines whether or not the amount of liquid in at least one of the liquid storing portions 73 has fallen below the predetermined amount. When the remaining amounts of the liquid in all of the liquid storing portions 73 are equal to or greater than the predetermined amount, the control unit 29 maintains a current state until the amount of liquid in at least one of the liquid storing portions 73 falls below the predetermined amount. When the amount of liquid in at least one of the liquid storing portions 73 has fallen below the predetermined amount, the control unit 29 proceeds to step S205.

At step S205, the control unit 29 causes the liquid feeding portion 71 to continuously perform the suction operation and the discharge operation in the alternating manner, while reducing the amount of liquid the liquid feeding portion sucks 71 at one time, increasing the number of times the liquid feeding portion 71 sucks the liquid, and reducing the velocity at which the liquid feeding portion 71 sucks the liquid. In other words, in the method for controlling the liquid ejecting apparatus 11, after the remaining amount Q3 of the liquid in the liquid containing portions 21 has fallen below the threshold value Qt, the control unit 29 causes the liquid feeding portion 71 to feed the liquid after the amount of liquid in the liquid storing portion 73 has fallen below the predetermined amount. At this time, in the method for controlling the liquid ejecting apparatus 11, compared to when the remaining amount Q3 is equal to or greater than the corresponding threshold value Qt, the control unit 29 reduces the amount of liquid the liquid feeding portion sucks 71 at one time, and at the same time, increases the number of times the liquid feeding portion 71 sucks the liquid. Then, in the method for controlling the liquid ejecting apparatus 11, compared to when the remaining amount Q3 is equal to or greater than the corresponding threshold value Qt, the control unit 29 reduces the velocity at which the liquid feeding portion 71 sucks the liquid. In this embodiment, after the remaining amount Q3 of the liquid in at least one of the liquid containing portions 21 has fallen below the threshold value Qt, the control unit 29 causes the liquid feeding portion 71 to feed the liquid after the amount of liquid in one of the liquid storing portions 73 has fallen below the predetermined amount. At this time, compared to when all of the remaining amounts Q3 are equal to or greater than the corresponding threshold values Qt, the control unit 29 reduces the amount of liquid the liquid feeding portion sucks 71 at one time, and at the same time, increases the number of times the liquid feeding portion 71 sucks the liquid. Then, compared to when all of the remaining amounts Q3 are equal to or greater than the corresponding threshold values Qt, the control unit 29 reduces the velocity at which the liquid feeding portion 71 sucks the liquid.

At step S206, the control unit 29 determines whether or not the amount of liquid in the liquid storing portion 73 has fallen below the predetermined amount. In this embodiment, the control unit 29 determines whether or not the amount of liquid in at least one of the liquid storing portions 73 has fallen below the predetermined amount. When the amounts of liquid in all of the liquid storing portions 73 are equal to or greater than the predetermined amount, the control unit 29 continues the control at step S205 until the amount of liquid in at least one of the liquid storing portions 73 falls below the predetermined amount. When the amount of liquid in at least one of the liquid storing portions 73 has fallen below the predetermined amount, the control unit 29 proceeds to step S207.

At step S207, the control unit 29 displays, on the display unit 19*a*, information indicating that the liquid in the liquid containing portion 21, corresponding to the liquid storing portion 73 in which the amount of liquid has fallen below the predetermined amount, has run out. Then, the control unit 29 stops accepting the recording job, and terminates the flow. When the new liquid containing portion 21 is mounted in the mounting unit 14 of the liquid ejecting apparatus 11, and the corresponding liquid is stored in the liquid chamber 93 of the liquid storing portion 73, the control unit 29 starts this flow once again.

As described above, in the method for controlling the liquid ejecting apparatus 11, the control unit 29 changes the driving control of the liquid feeding portion 71 in accordance with the remaining amount Q3 of the liquid in the liquid containing portion 21.

Next, actions of this embodiment will be described.

In the liquid ejecting apparatus 11, when the control unit 29 confirms that the four liquid containing portions 21 are mounted in the mounting unit 14 by the user, the control unit 29 performs an initialization operation and starts accepting the recording job.

The counting unit 116 calculates the remaining amount Q3, based on the contained amount reference value Q1 and the discharge amount reference value Q2p, with respect to each of the four liquid containing portions 21 each time the liquid thereof is discharged from the liquid ejection head 38. Then, the counting unit 116 calculates the remaining amount Q3 each time the liquid is discharged from the liquid ejection head 38, from when the corresponding liquid containing portion 21 is mounted in the mounting unit 14 until when the liquid contained in that liquid containing portion 21 runs out. As a result, the control unit 29 can always determine the remaining amount Q3 of the liquid in each of the four liquid containing portions 21 mounted in the liquid ejecting apparatus 11. Furthermore, the control unit 29 can always determine whether or not the remaining amount Q3 of the liquid in each of the four liquid containing portions 21 mounted in the liquid ejecting apparatus 11 is equal to or greater than the corresponding threshold value Qt.

Each of the threshold values Qt is set to an amount of liquid obtained when the high negative pressure acts inside the liquid containing portion 21 around the timing at which the liquid in each of the liquid containing portions 21 has nearly run out. Thus, the control unit 29 can always detect whether or not the high negative pressure is acting inside the four liquid containing portions 21 mounted in the liquid ejecting apparatus 11.

When the remaining amounts Q3 of the liquid in all of the liquid containing portions 21 are equal to or greater than the corresponding threshold values Qt, as a result of the suction operation and the discharge operation being continuously performed in the alternating manner, the liquid is fed to the liquid ejection head 38 through the liquid feeding portions 71 and the liquid storing portions 73. As a result, the liquid can be efficiently fed to the liquid ejection head 38 during a time period in which the high negative pressure is not acting inside any of the liquid containing portions 21.

When the remaining amount Q3 of the liquid in one of the liquid containing portions 21 has fallen below the threshold value Qt, the control unit 29 stops the feeding of the liquid by the liquid feeding portion 71, thus causing the liquid in the liquid storing portion 73 to be fed to the liquid ejection head 38. Specifically, when the control unit 29 detects that the high negative pressure is acting inside one of the liquid containing portions 21, the control unit 29 can feed the liquid to the liquid ejection head 38 while stopping the feeding of the liquid by the liquid feeding portion 71. In other words, the negative pressure acting inside the liquid containing portion 21 can be suppressed while feeding the liquid to the liquid ejection head 38. Further, the number of times the negative pressure acts inside the liquid containing portion 21 can be reduced by providing the time period in which the feeding of the liquid by the liquid feeding portion 71 is stopped while feeding the liquid to the liquid ejection head 38.

When the liquid in the liquid storing portion 73 is used, the amount of liquid in one of the liquid storing portions 73 falls below the predetermined amount. The control unit 29 causes the liquid feeding portion 71 to feed the liquid after the amount of liquid in one of the liquid storing portions 73 has fallen below the predetermined amount. At this time, compared to when all of the remaining amounts Q3 are equal to or greater than the corresponding threshold values Qt, the control unit 29 reduces the amount of liquid the liquid feeding portion sucks 71 at one time, and at the same time, increases the number of times the liquid feeding portion 71 sucks the liquid. Then, compared to when all of the remaining amounts Q3 are equal to or greater than the corresponding threshold values Qt, the control unit 29 reduces the velocity at which the liquid feeding portion 71 sucks the liquid. As a result, it is possible to inhibit the high negative pressure from acting inside the liquid containing portion 21. Here, when the remaining amount Q3 has fallen below the threshold value Qt, at least one of the operations, namely, causing the liquid feeding portion 71 to feed the liquid after the amount of liquid in the liquid storing portion 73 has fallen below the predetermined amount, reducing the amount of liquid the liquid feeding portion sucks 71 at one time, increasing the number of times the liquid feeding portion 71 sucks the liquid, and reducing the velocity at which the liquid feeding portion sucks the liquid, may be performed. In this case also, it is possible to inhibit the high negative pressure from acting inside the liquid containing portion 21.

When the liquid in the liquid containing portion 21 is used up as a result of the liquid feeding portion 71 feeding the liquid, the liquid in the liquid containing portion 21, in which the remaining amount Q3 of the liquid has fallen below the threshold value Qt earlier, runs out. As a result, the amount of liquid in the liquid storing portion 73 corresponding to that liquid containing portion 21 falls below the predetermined amount. The control unit 29 displays, on the display unit 19*a*, information indicating that the liquid in the liquid containing portion 21, corresponding to the liquid storing portion 73 in which the amount of liquid has fallen below the predetermined amount, has run out.

Effects of this embodiment will be described.

(1) The control unit 29 changes the driving control of the liquid feeding portion 71 in accordance with the remaining amount Q3 of the liquid in the liquid containing portion 21. As a result, the negative pressure that acts when the remaining amount Q3 of the liquid in the liquid containing portion 21 becomes low can be adjusted. Thus, the amount of air bubbles flowing out of the liquid containing portion 21 into the supply flow path 27 can be suppressed.

(2) When the remaining amount Q3 of the liquid in the liquid containing portion 21 becomes low, the negative pressure acting inside the liquid containing portion 21 increases, and thus, air bubbles easily flow into the liquid containing portion 21. Then, when the air bubbles flow out of the liquid containing portion 21 into the supply flow path 27, the ejection failure occurs. In this embodiment, when the remaining amount Q3 of the liquid in at least one of the liquid containing portions 21 becomes low, the control unit 29 reduces the amount of liquid the liquid feeding portion sucks 71 at one time, and increases the number of times the liquid feeding portion 71 sucks the liquid. As a result, when the remaining amount Q3 of the liquid in the liquid containing portion 21 becomes low, the negative pressure acting inside all of the liquid containing portions 21 can be suppressed without changing an amount of liquid to be fed. Thus, the amount of air bubbles flowing out of the liquid containing portion 21 into the supply flow path 27 can be suppressed.

(3) When the remaining amount Q3 of the liquid in the liquid containing portion 21 becomes low, the negative pressure acting inside the liquid containing portion 21 increases, and thus, air bubbles easily flow into the liquid containing portion 21. Then, when the air bubbles flow out of the liquid containing portion 21 into the supply flow path 27, the ejection failure occurs. In this embodiment, when the remaining amount Q3 of the liquid in at least one of the liquid containing portions 21 becomes low, the control unit 29 reduces the velocity at which the liquid feeding portion 71 sucks the liquid. As a result, when the remaining amount Q3 of the liquid in the liquid containing portion 21 becomes low, the negative pressure acting inside all of the liquid containing portions 21 can be suppressed without changing an amount of liquid to be fed. Thus, the amount of air bubbles flowing out of the liquid containing portion 21 into the supply flow path 27 can be suppressed.

In this embodiment, after the remaining amount Q3 of the liquid in at least one of the liquid containing portions 21 has fallen below the threshold value Qt, the liquid feeding portion 71 feeds the liquid after the amount of liquid in one of the liquid storing portions 73 has fallen below the predetermined amount. After the remaining amount Q3 of the liquid in the liquid containing portion 21 has fallen below the threshold value Qt, the negative pressure acting inside the liquid containing portion 21 increases when the liquid feeding portion 71 feeds the liquid. By stopping the feeding of the liquid by the liquid feeding portion 71 until the amount of liquid in the liquid storing portion 73 falls below the predetermined amount, the negative pressure is suppressed in all of the liquid containing portions 21 during that time period. In other words, the number of times the high negative pressure acts inside the liquid containing portion 21 can be reduced. As a result, it becomes more difficult for the air bubbles to flow into the liquid containing portion 21, and thus, the amount of air bubbles flowing out of the liquid containing portion 21 into the supply flow path 27 can be suppressed.

(5) In the method for controlling the liquid ejecting apparatus 11 also, since the driving control of the liquid feeding portion 71 is changed in accordance with the remaining amount Q3 of the liquid in the liquid containing portion 21, the same effect as that of the liquid ejecting apparatus 11 described in (1) above is obtained.

(6) In the method for controlling the liquid ejecting apparatus 11 also, since the amount of liquid the liquid feeding portion sucks 71 at one time is reduced and the number of times the liquid feeding portion 71 sucks the liquid is increased when the remaining amount Q3 of the liquid in at least one of the liquid containing portions 21 becomes low, the same effect as that of the liquid ejecting apparatus 11 described in (2) above is obtained.

(7) In the method for controlling the liquid ejecting apparatus 11 also, since the velocity at which the liquid feeding portion 71 sucks the liquid is reduced when the remaining amount Q3 of the liquid in at least one of the liquid containing portions 21 becomes low, the same effect as that of the liquid ejecting apparatus 11 described in (3) above is obtained.

In the method for controlling the liquid ejecting apparatus 11 also, since, after the remaining amount Q3 of the liquid in at least one of the liquid containing portions 21 has fallen below the threshold value Qt, the liquid feeding portion 71 feeds the liquid after the amount of liquid in the corresponding liquid storing portion 73 has fallen below the predetermined amount, the same effect as that of the liquid ejecting apparatus 11 described in (4) above is obtained.

Second Embodiment

A second embodiment of the liquid ejecting apparatus 11 will be described below with reference to the drawings. Since the second embodiment is substantially the same as the first embodiment, a duplicate description of the same configuration will be omitted while assigning the same reference signs to the same components.

Figure 19:
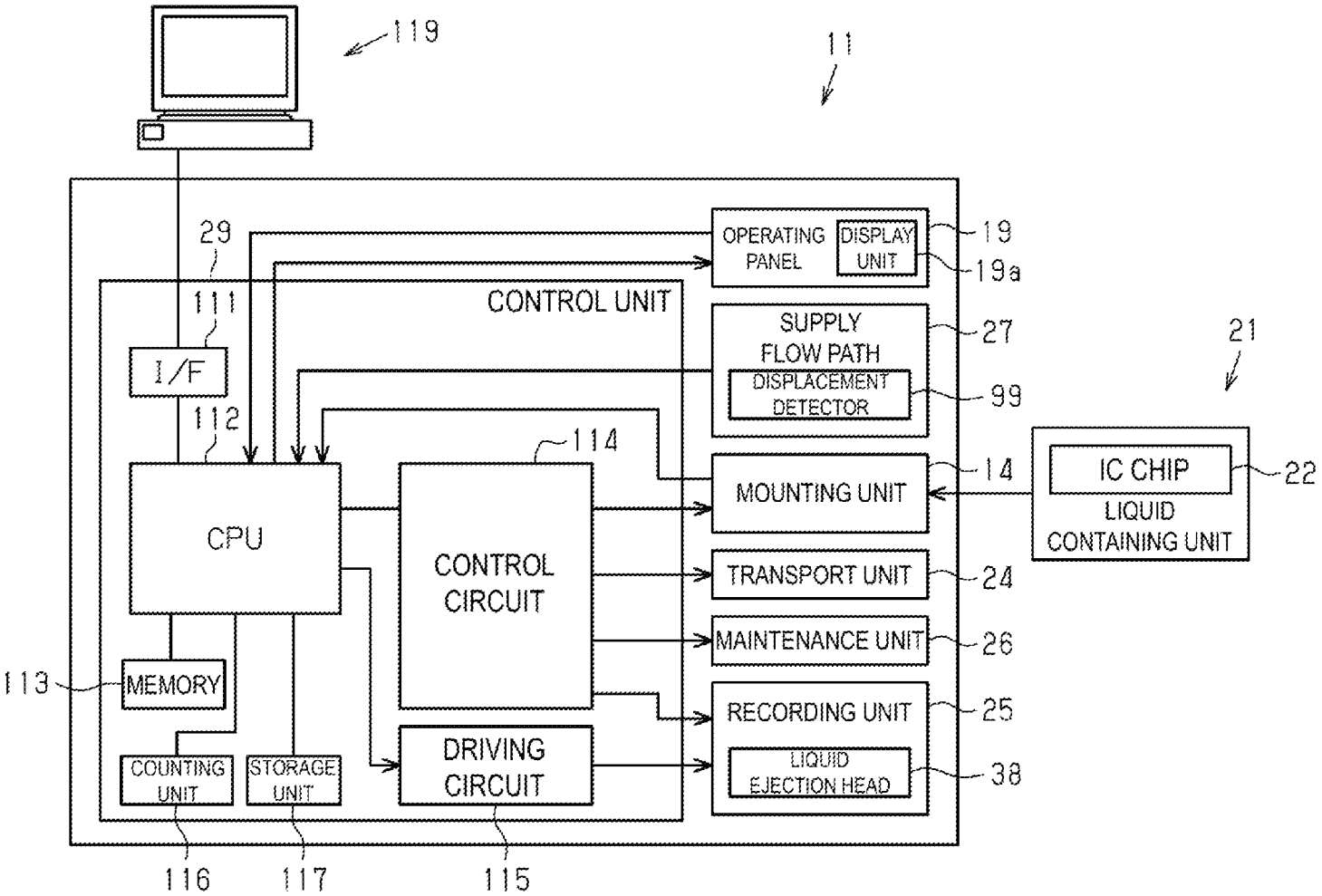
FIG. 19 is a block diagram illustrating an electrical configuration of the liquid ejecting apparatus according to the second embodiment.

Method for Calculating Remaining Amount of Liquid, and Remaining Amount Difference As illustrated in FIG. 19, the liquid ejecting apparatus 11 includes the control unit 29 that controls the mounting unit 14, the operating panel 19, the transport unit 24, the recording unit 25, the maintenance unit 26, and the supply flow path 27. The display unit 19*a* included in the operation panel 19 displays a menu, a message, and the like to the user. The displacement detector 99 included in the supply flow path 27 outputs detection result to the control unit 29. The liquid containing portion 21 including the IC chip 22 is mounted in the mounting unit 14. The control unit 29 reads, via the mounting unit 14, information stored in the IC chip 22.

The control unit 29 includes the interface unit 111, the CPU 112, the memory 113, the control circuit 114, the driving circuit 115, the counting unit 116, and a data storage portion 117. The interface portion 111 transmits and receives the data between the computer 119, which is an external device, and the liquid ejecting apparatus 11. The CPU 112 is an arithmetic processing device. The memory 113 is a storage medium that secures a region for storing programs for the CPU 12, a working region, and the like, and includes a storage element such as a RAM and an EEPROM. The CPU 112 controls the mounting unit 14, the transport unit 24, the recording unit 25, and the maintenance unit 26 via the control circuit 114, in accordance with the programs stored in the memory 113. The driving circuit 115 generates a driving signal for driving an actuator of the liquid ejection head 38.

The counting unit 116 calculates a remaining amount Q3 of the liquid in the liquid containing portion 21, based on a contained amount reference value Q1 indicating an amount of the liquid contained in the liquid containing portion 21, and a discharge amount reference value Q2p indicating a discharge amount of the liquid discharged from the liquid ejection head 38.

The contained amount reference value Q1 refers to an amount of the liquid contained in the liquid containing portion 21 that has not been used yet. When the amount of liquid contained in the liquid containing portion 21 is controlled to be at a constant value at the time of shipping the liquid containing portion 21, that value is the contained amount reference value Q1. In other words, the contained amount reference value Q1 is the amount of liquid contained in the liquid containing portion 21 when the liquid containing portion 21 is mounted in the mounting unit 14.

When the liquid containing portion 21 is mounted in the mounting unit 14, the mounting unit 14 and the liquid containing portion 21 are electrically coupled to each other. At this time, the control unit 29 may read the various types of information relating to the liquid containing portion 21, from the IC chip 22 of the liquid containing portion 21 via the mounting unit 14. When the amount of liquid contained in the liquid containing portion 21 is stored in the IC chip 22 at the time of shipping the liquid containing portion 21, a value of the contained amount may be read from the IC chip 22 and may be used as the contained amount reference value Q1. In such a case, the control unit 29 manages the contained amount reference value Q1 as a separate value for each of the liquid containing portions 21.

The discharge amount reference value Q2p refers to the discharge amount of the liquid discharged by the liquid ejection head 38. More specifically, the discharge amount reference value Q2p is the amount of the liquid discharged from one of the nozzles 37 in one shot. Note that a single ejection from one of the nozzles 37 is referred to as the one shot. The control unit 29 manages the discharge amount reference value Q2p as a separate value for each type of the liquid contained in the liquid containing portion 21.

The total discharge amount Q2 is calculated by multiplying the discharge amount reference value Q2p by the number of shots n. In other words, the counting unit 116 calculates the total discharge amount Q2 using the Equation $Q2=Q2p\times n$. Note that the number of shots n is a number of times obtained by adding together, for all of the nozzles 37, the number of times that the liquid is ejected from one of the nozzles 37, from when the liquid containing portion 21 containing that liquid is mounted in the mounting unit 14. Note that the number of shots n includes a number of times the liquid is ejected to perform the flushing, as well as the number of times the liquid is ejected onto the medium S to perform the recording. When the discharge amount reference value Q2p changes depending on the driving conditions of the actuator of the liquid ejection head 38, or the environmental conditions such as the temperature and humidity, the discharge amount reference value Q2p may be the value that changes depending on those conditions. Furthermore, when the discharge amount reference value Q2p is affected by the recording duty, the discharge amount reference value Q2p may be the value that changes depending on the recording duty.

The total discharge amount Q2 may also be calculated by adding amounts of the liquid discharged from the liquid ejection head 38 due to maintenance such as the suction cleaning. For example, the total discharge amount Q2 may be calculated by adding values respectively obtained by multiplying a suction amount reference value Q2s in one cleaning, by a number of cleaning operations m. In other words, the counting unit 116 may calculate the total discharge amount Q2 using the Equation $Q2=(Q2p\times n)+(Q2s\times m)$. The suction amount reference value Q2s is the amount of liquid discharged from the entire liquid ejection head 38 in one suction cleaning. The number of cleaning operations m is the number of times the suction cleaning is performed on the liquid ejection head 38 after the liquid containing portion 21 containing that liquid is mounted in the mounting unit 14. In the suction cleaning, when the intensity of sucking the liquid is adjusted, the suction amount reference value Q2s may be the value that changes depending on the intensity of sucking the liquid.

The liquid containing portion 21 according to this embodiment does not include the remaining amount sensor that detects the amount of liquid remaining in the liquid containing portion 21. However, the counting unit 116 subtracts the total discharge amount Q2 from the contained amount reference value Q1. As a result, the liquid ejecting apparatus 11 according to this embodiment is configured be able to calculate the remaining amount Q3 of the liquid in the liquid containing portion 21. In other words, the counting unit 116 calculates the remaining amount Q3 using the Equation Q3=Q1−Q2.

In this embodiment, the counting unit 116 calculates, with respect to the four liquid containing portions 21, the remaining amounts Q3 of the liquids in the respective liquid containing portions 21, based on the respective contained amount reference values Q1 and the respective discharge amount reference values Q2p. For example, when the four liquid containing bodies 20 contain the black, cyan, magenta, and yellow inks, respectively, the counting unit 116 calculates a remaining amount Q3a of the black ink, a remaining amount Q3b of the cyan ink, a remaining amount Q3c of the magenta ink, and a remaining amount Q3d of the yellow ink. More specifically, for example, with respect to the liquid containing portion 21 containing the black ink, the remaining amount Q3a of the black ink is calculated based on the contained amount volume reference value Q1a of the black ink and the discharge amount reference value Q2pa of the black ink.

The counting unit 116 calculates the remaining amount Q3 each time the liquid is discharged from the liquid ejection head 38, from when the liquid containing portion 21 is mounted in the mounting unit 14 until when the liquid contained in that liquid containing portion 21 runs out. In other words, while the supply mechanism 28 illustrated in FIG. 3 is being driven, the counting unit 116 continuously calculates the remaining amount Q3 of the liquid in the liquid containing portion 21 until the displacement detector 99 corresponding to that liquid detects that the amount of liquid in the liquid storing portion 73 has fallen below the predetermined amount. As a result, the liquid ejecting apparatus 11 is configured so that the control unit 29 can change driving control of the liquid feeding portion 71 in accordance with the remaining amount Q3 of the liquid in the liquid containing portion 21.

The data storage portion 117 stores the remaining amount Q3 obtained when the displacement detector 99 detects that the amount of liquid in the liquid storing portion 73 illustrated in FIG. 11 has fallen below the predetermined amount. In other words, when the amount of liquid in the liquid storing portion 73 has fallen below the predetermined amount, the data storage portion 117 stores a value of the remaining amount Q3 calculated by the counting unit 116. The remaining amount of the liquid in the liquid containing portion 21 when the amount of liquid in the liquid storing portion 73 has fallen below the predetermined amount is actually "zero". In the following description, the remaining amount stored in the data storage portion 117 is referred to as a remaining amount difference ΔQ.

In this embodiment, the data storage portion 117 stores the respective remaining amount differences ΔQ of the four liquid containing portions 21. For example, when the four liquid storing portions 20 contain the black, cyan, magenta, and yellow inks, respectively, the data storage portion 117 stores a remaining amount difference ΔQa of the black ink, a remaining amount difference ΔQb of the cyan ink, a remaining amount difference ΔQc of the magenta ink, and a remaining amount difference ΔQd of the yellow ink.

Method for Correcting Discharge Amount Reference Value

First, an outline of a method for correcting the discharge amount reference value will be described.

It is desirable that the discharge amount reference value Q2p be set so that the remaining amount difference ΔQ is a value close to "zero", and that the total discharge amount Q2 be calculated based on this setting. More specifically, since the remaining amount difference ΔQ is an amount of the liquid to be used from when the liquid in the liquid containing portion 21 runs out and then the liquid in the liquid feeding portion 71 runs out, until the amount of liquid in the liquid storing portion 73 falls below the predetermined amount, it is desirable that the remaining amount difference ΔQ be the value close to "zero". For example, when the amount of liquid to be used, from when the liquid in the liquid containing portion 21 runs out and then the liquid in the liquid feeding portion 71 runs out, until the amount of liquid in the liquid storing portion 73 falls below the predetermined amount, is 3 grams, it is desirable that the remaining amount difference ΔQ be −3 grams. In other words, it is desirable that the discharge amount reference value Q2p be set so that the remaining amount difference ΔQ is −3 grams, and the total discharge amount Q2 be calculated based on this setting. However, when an average value of actual discharge amounts, each of which is an amount of the liquid actually discharged in one shot, is greater than the discharge amount reference value Q2p, the remaining amount difference ΔQ becomes a value greater than −3 grams, and when the average value of the actual discharge amounts is less than the discharge amount reference value Q2p, the remaining amount difference ΔQ becomes a value smaller than −3 grams. In the following description, the average value of the actual discharge amounts will be described as an actual discharge amount Q2pr.

Since the discharge amount reference value Q2p is an extremely small value, and the number of shots n is an extremely large value, the accuracy of the total discharge amount Q2 calculated by multiplying the discharge amount reference value Q2p by the number of shots n is not high. Thus, the remaining amount difference ΔQ may not become a value close to "zero". The control unit 29 corrects the discharge amount reference value Q2p based on the remaining amount difference ΔQ. In other words, the control unit 29 calculates the actual discharge amount Q2pr based on the remaining amount difference ΔQ, which is a difference between the total discharge amount Q2 when the liquid has actually run out, and the contained amount reference value Q1, and replaces the discharge amount reference value Q2p with the actual discharge amount Q2pr. More specifically, the control unit 29 calculates the actual discharge amount Q2pr using the Equation Q2pr=Q2p×Q1χ(Q1−ΔQ). When the amount of liquid to be used, from when the liquid in the liquid containing portion 21 runs out and then the liquid in the liquid feeding portion 71 runs out, until the amount of liquid in the liquid storing portion 73 falls below the predetermined amount, is 3 grams, the control unit 29 may calculate the actual discharge amount Q2pr using the Equation Q2pr=Q2p×Q1χ(Q1−(ΔQ+3 grams). Then, in the next liquid containing portion 21 that replaces the liquid containing portion 21 that has been mounted up to that point, the counting unit 116 calculates the total discharge amount Q2 using the calculated actual discharge volume Q2pr as the discharge amount reference value Q2p. In this way, each time the liquid containing portion 21 is replaced, the discharge amount reference value Q2p is corrected. Then, the remaining amount difference ΔQ stored in the data storage portion 117 approaches "zero". As a result, the accuracy of calculating the remaining amount Q3 is improved, and thus the accuracy of the timing at which the control unit 29 changes the driving control of the liquid feeding portion 71 can be increased.

After performing the correction of the discharge amount reference value Q2p a predetermined number of times, the control unit 29 notifies the user, based on a calculation result of the remaining amount Q3 by the counting unit 116, that the amount of liquid in the liquid storing portion 73 has fallen below the predetermined amount, in advance of the detection of that fact by the displacement detector 99. By improving the accuracy of calculating the remaining amount Q3, the liquid ejecting apparatus 11 is configured so as to be able to display, on the display unit 19*a*, information indicating that the liquid containing portion 21 has reached a replacement timing, around the timing at which the liquid in the liquid containing portion 21 has nearly run out, before the high negative pressure starts acting inside the liquid containing portion 21. The predetermined number of times may be one time. After the correction of the discharge amount reference value Q2p has been performed a plurality of times, and the accuracy of calculating the remaining amount Q3 has been improved, the control unit 29 may notify the user that the liquid in the liquid storing portion 73 has fallen below the predetermined amount, in advance of the detection of that fact by the displacement detector 99.

The control unit 29 may calculate an actual suction amount Q2sr in one cleaning, based on the remaining amount difference ΔQ. For example, if the remaining amount difference ΔQ does not approach "zero" even when the discharge amount reference value Q2p has been corrected a plurality of times using the calculated actual discharge amount Q2pr, the control unit 29 may calculate the actual suction amount Q2sr to correct the suction amount reference value Q2s.

Figure 20:
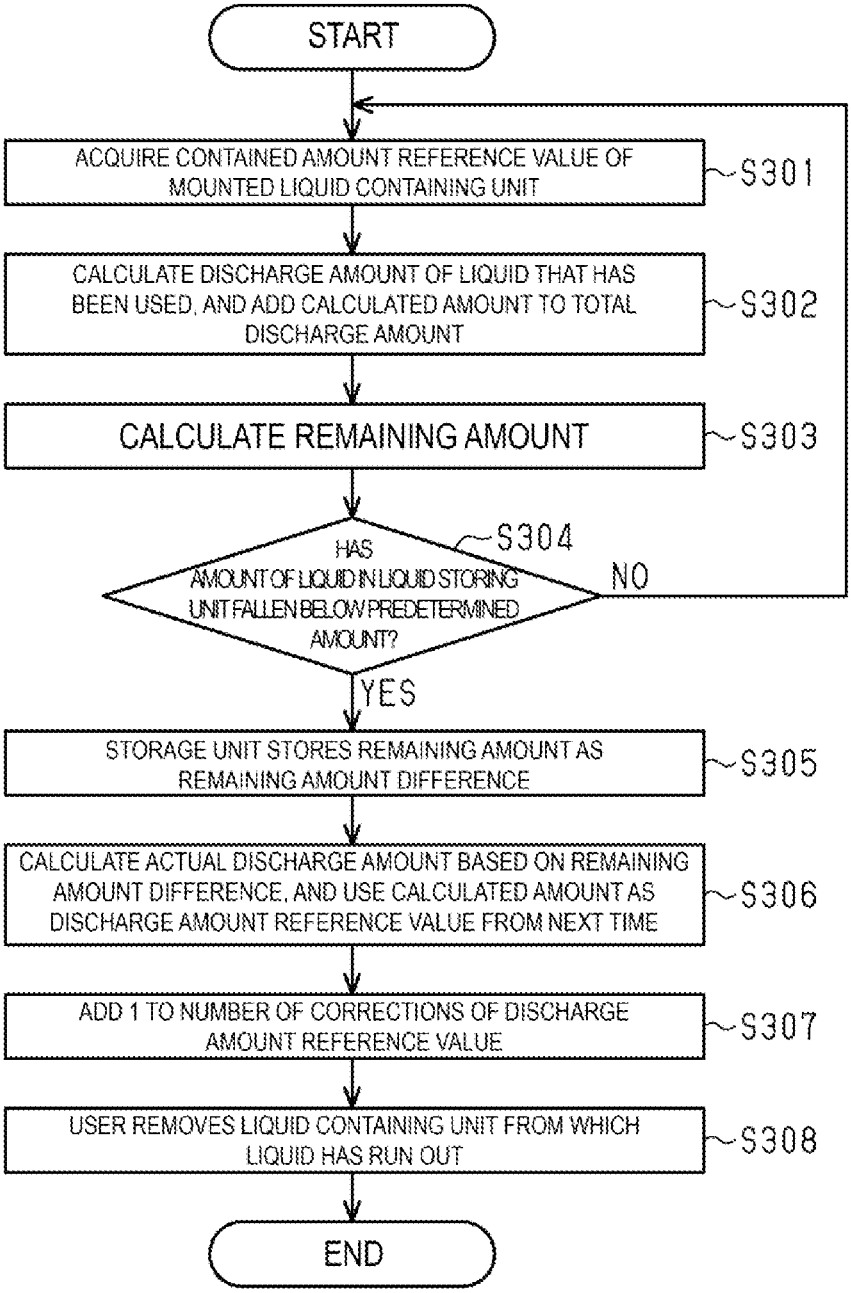
FIG. 20 is a flowchart illustrating a method for correcting a discharge amount reference value according to the second embodiment.

Next, with reference to a flowchart illustrated in FIG. 20, in the method for controlling the liquid ejecting apparatus 11, control performed by the control unit 29 at each of steps will be sequentially described with respect to a method for correcting the discharge amount reference value Q2p when the control unit 29 corrects the discharge amount reference value Q2p based on the remaining amount difference ΔQ, which is the remaining amount Q3 of the liquid stored in the data storage portion 117. Note that the control unit 29 starts this flow when the new liquid containing portion 21 is mounted in the liquid ejecting apparatus 11 by the user.

In this embodiment, with respect to the four types of the liquid, the control unit 29 corrects the discharge amount reference value Q2p corresponding to the respective liquids based on the remaining amount difference ΔQ corresponding to the respective liquids. For example, when the four liquid containing bodies 20 contain the black, cyan, magenta, and yellow inks, respectively, the control unit 29 corrects the discharge amount reference value Q2pa of the black ink, the discharge amount reference value Q2pb of the cyan ink, the discharge amount reference value Q2pc of the magenta ink, and the discharge amount reference value Q2pd of the yellow ink. More specifically, for example, with respect to the liquid containing portion 21 containing the black ink, the control unit 29 corrects the discharge amount reference value Q2pa of the black ink based on the remaining amount difference ΔQa of the black ink.

At step S301, the control unit 29 acquires the contained amount reference value Q1 of the liquid containing portion 21 mounted in the liquid ejecting apparatus 11. Note that the total discharge amount Q2 obtained immediately after the liquid containing portion 21 is mounted in the liquid ejecting apparatus 11 is "zero".

At step S302, when the recording or the flushing is performed by the liquid ejection head 38, the control unit 29 calculates the discharge amount of the liquid used in the recording or the flushing, based on the discharge amount reference value Q2p and the number of shots n, and adds the calculated amount to the total discharge amount Q2. Note that when the liquid containing portion 21 contains a type of the liquid that is mounted in the liquid ejecting apparatus 11 for the first time, an initial value of the discharge amount reference value Q2p is used as the discharge amount reference value Q2p. For example, the initial value is a value determined in advance through experiments or the like, and is a value stored in the memory 113 illustrated in FIG. 19. When the liquid in the liquid containing portion 21 that has been mounted in the liquid ejecting apparatus 11 up to that point has run out, and when the liquid containing portion 21 has been replaced with the new liquid containing portion 21, the discharge amount reference value Q2p calculated at step S306, which will be described below, for the liquid containing portion 21 that has been mounted up to that point is used as the discharge amount reference value Q2p.

At step S303, the control unit 29 subtracts the total discharge amount Q2 from the contained amount reference value Q1, to calculate the remaining amount Q3. In other words, in the method for controlling the liquid ejecting apparatus 11, the control unit 29 calculates the remaining amount Q3 of the liquid in the liquid containing portion 21 based on the contained amount reference value Q1 indicating the amount of liquid contained in the liquid containing portion 21, and the discharge amount reference value Q2p indicating the discharge amount of liquid discharged from the liquid ejection head 38.

At step S304, the control unit 29 determines whether or not the amount of liquid in the liquid storing portion 73 has fallen below the predetermined amount. When the amount of liquid in the liquid storing portion 73 is equal to or greater than the predetermined amount, the control unit 29 proceeds to step S302. When the amount of liquid in the liquid storing portion 73 has fallen below the predetermined amount, the control unit 29 proceeds to step S305.

At step S305, the control unit 29 stores, in the data storage portion 117, the remaining amount Q3 obtained when the displacement detector 99 detects that the amount of liquid in the liquid storing portion 73 has fallen below the predetermined amount, as the remaining amount difference ΔQ. Then, at step S306, the control unit 29 calculates the actual discharge amount Q2pr based on the remaining amount difference ΔQ, and uses the calculated actual discharge amount Q2pr as the discharge amount reference value Q2p to be used from the next time. In other words, in the method for controlling the liquid ejecting apparatus 11, the control unit 29 stores the remaining amount Q3 obtained when the displacement detector 99 detects that the amount of liquid in the liquid storing portion 73 has fallen below the predetermined amount, and corrects the discharge amount reference value Q2p based on the stored remaining amount Q3. Note that at this time, at step S409 of a flow, which will be described below with reference to FIG. 21, the liquid ejecting apparatus 11 stops accepting the recording job.

At step S307, the control unit 29 adds 1 to a number of corrections of the discharge amount reference value Q2p. Note that an initial value of the number of corrections is "zero", and the number of corrections changes from "zero" to 1 at step S307 of this flow when the liquid containing portion 21 containing the corresponding type of liquid is mounted in the liquid ejecting apparatus 11 for the first time.

At step S308, when the liquid containing portion 21, from which the liquid has run out, is removed from the liquid ejecting apparatus 11 by the user, the control unit 29 terminates this flow. Then, after that, when the liquid containing portion 21, from which the liquid has run out, is replaced by the user with the new liquid containing portion 21 containing the corresponding type of liquid, the control unit 29 starts this flow once again.

Method for Driving Liquid Feeding Portion and Method for Controlling Notification First, operations of the liquid feeding portion 71, the liquid storing portion 73, and the display unit 19*a* in the liquid ejecting apparatus 11 will be described. Note that operations of the liquid ejecting apparatus 11 are different between when the correction of the discharge amount reference value Q2p has not been performed the predetermined number of times, and after the correction of the discharge amount reference value Q2p has been performed the predetermined number of times. In this embodiment, with respect to all types of the liquid, the operations of the liquid ejecting apparatus 11 are different between when the correction of the discharge amount reference value Q2p has not been performed the predetermined number of times, and after the correction of the discharge amount reference value Q2p has been performed the predetermined number of times. When the correction of the discharge amount reference value Q2p has been performed the predetermined number of times with respect to at least one type of the liquid, the control unit 29 performs control in accordance with the threshold value Qt corresponding to the one type of liquid. More specifically, for example, when the correction of the discharge amount reference value Q2p has been performed the predetermined number of times only with respect to the black ink, of the four types of the liquid, the control unit 29 changes the control of the liquid ejecting apparatus 11 only in accordance with the threshold value Qta corresponding to the black ink.

As illustrated in FIG. 14, when the remaining amount Q3, of the liquid in the liquid containing portion 21, calculated by the counting unit 116 is equal to or greater than the threshold value Qt, the liquid feeding portion 71 continuously performs the suction operation and the discharge operation in the alternating manner. As a result, the control unit 29 causes the liquid to be fed from the liquid containing portion 21 to the liquid ejection head 38 through the liquid feeding portion 71 and the liquid storing portion 73, in the direction indicated by the dashed line arrows illustrated in FIG. 14. In this embodiment, when the remaining amounts Q3, of the liquid in all of the liquid containing portions 21, calculated by the counting unit 116 are equal to or greater than the corresponding threshold values Qt, the liquid feeding portions 71 continuously perform the suction operation and the discharge operation in the alternating manner.

When the correction of the discharge amount reference value Q2p, which is illustrated in FIG. 20, has not been performed the predetermined number of times, even when the remaining amount Q3, of the liquid in the liquid containing portion 21, calculated by the counting unit 116 has fallen below the threshold value Qt, the control unit 29 does not change the control until the detected portion 97*b* is detected by the displacement detector 99. In this embodiment, when the correction of the discharge amount reference value Q2p has not been performed the predetermined number of times with respect to any type of the liquid, even when the remaining amount Q3, of the liquid in one of the liquid containing portion 21, calculated by the counting unit 116 has fallen below the threshold value Qt, the control unit 29 does not change the control until the detected portion 97*b* is detected by the displacement detector 99.

After performing the correction of the discharge amount reference value Q2p, which is illustrated in FIG. 20, the predetermined number of times, the control unit 29 notifies the user that the amount of liquid in the liquid storing portion 73 has fallen below the predetermined amount, in advance of the detection of that fact by the displacement detector 99. In this embodiment, after the correction of the discharge amount reference value Q2p has been performed the predetermined number of times for at least one type of the liquid, when the remaining amount Q3, of that liquid in the liquid containing portion 21, calculated by the counting unit 116 has fallen below the threshold value Qt, the control unit 29 displays, on the display unit 19*a*, the information indicating that the liquid containing portion 21 has reached the replacement timing. Then, the control unit 29 changes the driving control of the liquid feeding portion 71 in accordance with the remaining amount Q3 of the liquid in the liquid containing portion 21. More specifically, compared to when the remaining amount Q3 is equal to or greater than the corresponding threshold value Qt, the control unit 29 reduces the amount of liquid the liquid feeding portion sucks 71 at one time, and at the same time, increases the number of times the liquid feeding portion 71 sucks the liquid. Then, compared to when the remaining amount Q3 is equal to or greater than the corresponding threshold value Qt, the control unit 29 reduces the velocity at which the liquid feeding portion 71 sucks the liquid. Here, when the remaining amount Q3 has fallen below the threshold value Qt, at least one of the operations, namely, reducing the amount of liquid the liquid feeding portion sucks 71 at one time, increasing the number of times the liquid feeding portion 71 sucks the liquid, and reducing the velocity at which the liquid feeding portion sucks the liquid may be performed.

When the liquid in the liquid containing portion 21 has run out, the feeding of the liquid from the liquid feeding portion 71 to the liquid storing portion 73 has been stopped, and the amount of liquid in the liquid storing portion 73 has fallen below the predetermined amount, the detected unit 97*b* is detected by the displacement detector 99. At this time, the liquid ejecting apparatus 11 stops accepting a recording job until the liquid containing portion 21 from which the liquid has run out is replaced with the new liquid containing portion 21 by the user.

Figure 21:
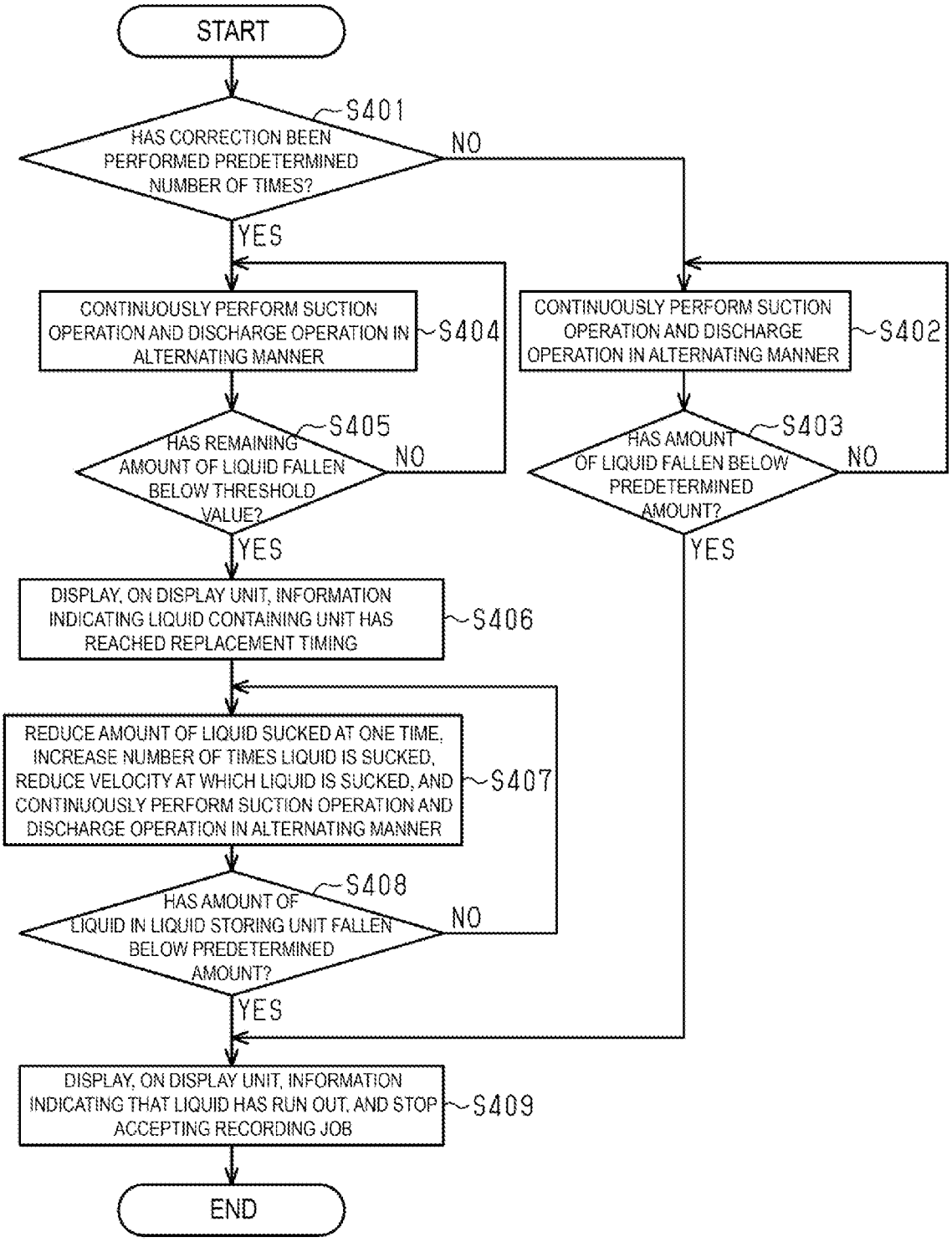
FIG. 21 is a flowchart illustrating a method for controlling the liquid ejecting apparatus according to the second embodiment.

Next, with reference to a flowchart illustrated in FIG. 21, in the method for controlling the liquid ejecting apparatus 11, control performed by the control unit 29 at each of steps will be sequentially described with respect to a method of controlling the liquid ejecting device 11 applied when controlling the driving of the liquid feeding portion 71. Note that the control unit 29 only starts this flow after the new liquid containing portion 21 is mounted in the mounting unit 14 of the liquid ejecting apparatus 11, and the liquid is stored in the liquid chamber 93 of the liquid storing portion 73. In other words, this flow is started when the remaining amount Q3 of the liquid in the liquid containing portion 21 is equal to or greater than the threshold value Qt, and the amount of liquid in the liquid storing portion 73 is equal to or greater than the predetermined amount. Note that since the discharge amount reference value Q2p is corrected for each type of the liquid, the control unit 29 performs this flow in parallel for each type of the liquid.

At step S401, the control unit 29 determines whether or not the correction of the discharge amount reference value Q2p has been performed the predetermined number of times. When the control unit 29 has already corrected the discharge amount reference value Q2p the predetermined number of times, the control unit 29 proceeds to step S404. When the control unit 29 has not yet performed the correction of the discharge amount reference value Q2p the predetermined number of times, the control unit 29 proceeds to step S402.

When the control unit 29 has already corrected the discharge amount reference value Q2p the predetermined number of times, at step S404, the control unit 29 causes the liquid feeding portion 71 to continuously perform the suction operation and the discharge operation in the alternating manner. Then, at step S405, the control unit 29 determines whether or not the remaining amount Q3 of the liquid in the liquid containing portion 21 has fallen below the threshold value Qt. When the remaining amount Q3 is equal to or greater than the threshold Qt, the control unit 29 continues the control at step S404 until the remaining amount Q3 falls below the threshold value Qt. When the remaining amount Q3 has fallen below the threshold value Qt, the control unit 29 proceeds to step S406.

At step S406, the control unit 29 displays, on the display unit 19*a*, the information indicating that the liquid containing portion 21 has reached the replacement timing. In other words, in the method for controlling the liquid ejecting apparatus 11, after performing the correction of the discharge amount reference Q2p the predetermined number of times, based on the remaining amount Q3 of the liquid, which is a calculation result by the counting unit 116, the control unit 29 notifies the user that the amount of liquid in the liquid storing portion 73 has fallen below the predetermined amount, in advance of the detection of that fact by the displacement detector 99, which is the example of the detector. Alternatively, the control unit 29 may notify the user by causing the information indicating that the liquid containing portion 21 has reached the replacement timing to be displayed on a display of the computer 119, which is the external device.

At step S407, while reducing the amount of liquid the liquid feeding portion sucks 71 at one time, increasing the number of times the liquid feeding portion 71 sucks the liquid, and reducing the velocity at which the liquid feeding portion 71 sucks the liquid, the control unit 29 causes the liquid feeding portion 71 to continuously perform the suction operation and the discharge operation in the alternating manner. In other words, in the method for controlling the liquid ejecting apparatus 11, compared to when the remaining amount Q3 is equal to or greater than the corresponding threshold value Qt, when the remaining amount Q3 has fallen below the threshold value Qt, the control unit 29 reduces the amount of liquid the liquid feeding portion sucks 71 at one time, and at the same time, increases the number of times the liquid feeding portion 71 sucks the liquid. Then, in the method for controlling the liquid ejecting apparatus 11, compared to when the remaining amount Q3 is equal to or greater than the corresponding threshold value Qt, the control unit 29 reduces the velocity at which the liquid feeding portion 71 sucks the liquid.

The control unit 29 performs this flow in parallel for each type of the liquid. In this embodiment, the four types of liquid are used. Thus, four of the flows are performed in parallel by the control unit 29. Then, the four liquid feeding portions 71 corresponding to the four types of liquid are coupled to the single voltage transformation flow path 48. Thus, in the flow of one of the four types of liquid, when the control unit 29 performs the step S407, the driving control of all of the four liquid feeding portions 71 is changed. In other words, in this embodiment, compared to when the remaining amount Q3 is equal to or greater than the threshold value Qt, when the remaining amount Q3 has fallen below the threshold value Qt, the control unit 29 reduces the amount of liquid the liquid feeding portion sucks 71 at one time, and at the same time, increases the number of times the liquid feeding portion 71 sucks the liquid. Then, compared to when the remaining amount Q3 is equal to or greater than the corresponding threshold value Qt, the control unit 29 reduces the velocity at which the liquid feeding portion 71 sucks the liquid.

As described above, the liquid feeding portions 71 may be respectively coupled to each of the separate voltage transformation flow paths 48. Then, those voltage transformation flow paths 48 may be respectively coupled to each of the separate supply mechanisms 28. As a result, the driving of the liquid feeding portion 71 can be controlled for each of the liquid containing portions 21. In other words, in accordance with the remaining amount Q3 of the liquid in each of the liquid containing portions 21, it is possible to change only the driving control of the liquid feeding portion 71 corresponding to the target liquid containing portion 21.

At step S408, the control unit 29 determines whether or not the amount of liquid in the liquid storing portion 73 has fallen below the predetermined amount. When the amount of liquid in the liquid storing portion 73 is equal to or greater than the predetermined amount, the control unit 29 continues the control at step S407 until the amount of liquid in the liquid storing portions 73 falls below the predetermined amount. When the amount of liquid in the liquid storing portion 73 has fallen below the predetermined amount, the control unit 29 proceeds to step S409.

At step S409, the control unit 29 displays, on the display unit 19*a*, the information indicating that the liquid in the liquid containing portion 21 has run out. Then, the control unit 29 stops accepting the recording job, and terminates this flow. When the new liquid containing portion 21 is mounted in the mounting unit 14 of the liquid ejecting apparatus 11, and the corresponding liquid is stored in the liquid chamber 93 of the liquid storing portion 73, the control unit 29 starts this flow once again.

When the control unit 29 has not yet corrected the discharge amount reference value Q2p the predetermined number of times, at step S402, the control unit 29 causes the liquid feeding portion 71 to continuously perform the suction operation and the discharge operation in the alternating manner. Then, at step S403, the control unit 29 determines whether or not the amount of liquid in the liquid storing portion 73 has fallen below the predetermined amount. When the amount of liquid in the liquid storing portion 73 is equal to or greater than the predetermined amount, the control unit 29 continues the control at step S402 until the amount of liquid in the liquid storing portions 73 falls below the predetermined amount. When the amount of liquid in the liquid storing portion 73 has fallen below the predetermined amount, the control unit 29 proceeds to step S409.

As described above, in the method for controlling the liquid ejecting apparatus 11, the control unit 29 changes the driving control of the liquid feeding portion 71 in accordance with the remaining amount Q3 of the liquid in the liquid containing portion 21.

Next, actions of this embodiment will be described.

In the liquid ejecting apparatus 11, when the control unit 29 confirms that the four liquid containing portions 21 have been mounted in the mounting unit 14 by the user, the control unit 29 performs the initialization operation and starts accepting the recording job.

The counting unit 116 calculates the remaining amount Q3, based on the contained amount reference value Q1 and the discharge amount reference value Q2p, with respect to each of the four liquid containing portions 21 each time the liquid thereof is discharged from the liquid ejection head 38. Then, the counting unit 116 calculates the remaining amount Q3 each time the liquid is discharged from the liquid ejection head 38, from when the corresponding liquid containing portion 21 is mounted in the mounting unit 14 until when the liquid contained in that liquid containing portion 21 runs out. As a result, the control unit 29 can always determine the remaining amount Q3 of the liquid in each of the four liquid containing portions 21 mounted in the liquid ejecting apparatus 11. Furthermore, the control unit 29 can always determine whether or not the remaining amount Q3, of the liquid in each of the four liquid containing portions 21 mounted in the liquid ejecting device 11, is equal to or greater than the corresponding threshold value Qt.

Each of the threshold values Qt is set to an amount of liquid obtained when the high negative pressure acts inside the liquid containing portion 21 around the timing at which the liquid in each of the liquid containing portions 21 has nearly run out. Thus, the control unit 29 can always detect whether or not the high negative pressure is acting inside the four liquid containing portions 21 mounted in the liquid ejecting apparatus 11.

The data storage portion 117 stores, as the remaining amount difference ΔQ, the remaining amount Q3 of the liquid in the liquid containing portion 21 obtained when the displacement detector 99 detects that the amount of liquid in the liquid storing portion 73 has fallen below the predetermined amount, and the control unit 29 corrects the discharge amount reference value Q2p based on the remaining amount difference ΔQ stored in the data storage portion 117. As a result, the accuracy of the counting unit 116 calculating the remaining amount Q3 of the liquid in the liquid containing portion 21 can be improved based on the contained amount reference value Q1 and the discharge amount reference value Q2p.

When the remaining amounts Q3 of the liquid in all of the liquid containing portions 21 are equal to or greater than the corresponding threshold values Qt, as a result of the suction operation and the discharge operation being continuously performed in the alternating manner, the liquid is fed to the liquid ejection head 38 through the liquid feeding portions 71 and the liquid storing portions 73. As a result, the liquid can be efficiently fed to the liquid ejection head 38 during a time period in which the high negative pressure is not acting inside any of the liquid containing portions 21.

After the control unit 29 performs the correction of the discharge amount reference Q2p the predetermined number of times, when the remaining amount Q3 of the liquid in the liquid containing portion 21, for which the correction of the discharge amount reference Q2p has been performed the predetermined number of times, has fallen below the threshold value Qt, the control unit 29 notifies the user based on the remaining amount Q3 of the liquid, which is the calculation result by the counting unit 116. As a result, around the timing at which the liquid in the liquid containing portion 21 has nearly run out, it is possible to notify the user that the liquid containing portion 21 has reached the replacement timing, before the high negative pressure starts acting inside the liquid containing portion 21.

Compared to when the remaining amounts Q3 are equal to or greater than the corresponding threshold values Qt, when the remaining amount Q3 of the liquid in one of the liquid containing portions 21 has fallen below the threshold value Qt, the control unit 29 reduces the amount of liquid the liquid feeding portion sucks 71 at one time, and at the same time, increases the number of times the liquid feeding portion 71 sucks the liquid. Then, compared to when all of the remaining amounts Q3 are equal to or greater than the corresponding threshold values Qt, the control unit 29 reduces the velocity at which the liquid feeding portion 71 sucks the liquid. As a result, it is possible to inhibit the high negative pressure from acting inside the liquid containing portion 21. Here, when the remaining amount Q3 has fallen below the threshold value Qt, at least one of the operations, namely, reducing the amount of liquid the liquid feeding portion sucks 71 at one time, increasing the number of times the liquid feeding portion 71 sucks the liquid, and reducing the velocity at which the liquid feeding portion sucks the liquid may be performed. In this case also, it is possible to inhibit the high negative pressure from acting inside the liquid containing portion 21.

When the liquid in the liquid containing portion 21 is used up as a result of the liquid feeding portion 71 feeding the liquid, the liquid in the liquid containing portion 21, in which the remaining amount Q3 of the liquid has fallen below the threshold value Qt earlier, runs out. As a result, the amount of liquid in the liquid storing portion 73 corresponding to that liquid containing portion 21 falls below the predetermined amount. The control unit 29 displays, on the display unit 19*a*, information indicating that the liquid has run out in the liquid containing portion 21 corresponding to the liquid storing portion 73 in which the amount of liquid has fallen below the predetermined amount.

Effects of this embodiment will be described.

In the liquid ejecting apparatus 11, the same effects as those of (1) to (3) in the first embodiment are obtained.

(9) The data storage portion 117 stores, as the remaining amount difference ΔQ, the remaining amount Q3 of the liquid in the liquid containing portion 21 obtained when the displacement detector 99 detects that the amount of liquid in the liquid storing portion 73 has fallen below the predetermined amount, and the control unit 29 corrects the discharge amount reference value Q2p based on the remaining amount difference ΔQ stored in the data storage portion 117. As a result, the accuracy of the counting unit 116 calculating the remaining amount Q3 of the liquid in the liquid containing portion 21 can be improved based on the contained amount reference value Q1 and the discharge amount reference value Q2p. Then, the driving control of the liquid feeding portion 71 can be changed at a correct timing in accordance with the remaining amount Q3 of the liquid in the liquid containing portion 21. In other words, by changing the driving control of the liquid feeding portion 71, the negative pressure that could act inside the liquid containing portion 21 can be adjusted before the negative pressure starts acting inside the liquid containing portion 21. Thus, the amount of air bubbles flowing out of the liquid containing portion 21 into the supply flow path 27 can be suppressed.

(10) The control unit 29 can further improve the accuracy of the counting unit 116 calculating the remaining amount Q3 of the liquid in the liquid containing portion 21 based on the discharge amount reference value Q2p, by performing the correction of the discharge amount reference value Q2p the predetermined number of times. As a result, before the high negative pressure starts acting inside the liquid containing portion 21, it is possible to notify the user that the liquid containing portion 21 has reached the replacement timing. Then, around the timing at which the liquid in the liquid containing portion 21 has nearly run out, as a result of the user replacing the liquid containing portion 21 before the high negative pressure starts acting inside the liquid containing portion 21, it is possible to suppress the amount of air bubbles flowing out of the liquid containing portion 21 into the supply flow path 27.

In the method for controlling the liquid ejecting apparatus 11, the same effects as those of (5) to (7) in the first embodiment are obtained.

(11) In the method for controlling the liquid ejecting apparatus 11 also, the remaining amount Q3 of the liquid in the liquid containing portion 21 obtained when the displacement detector 99 detects that the amount of liquid in the liquid storing portion 73 has fallen below the predetermined amount is stored in the data storage portion 117 as the remaining amount difference ΔQ, and the discharge amount reference value Q2p is corrected based on the remaining amount difference ΔQ stored in the data storage portion 117. Thus, the same effects as those of the liquid ejecting apparatus 11 described in (9) above are obtained.

(12) Since the correction of the discharge amount reference value Q2p is performed the predetermined number of times in the method for controlling the liquid ejecting apparatus 11 as well, the same effects as those of the liquid ejecting apparatus 11 described in (10) above are obtained.

This embodiment may be modified and implemented as follows. This embodiment and modified examples thereof to be described below may be implemented in combination within a range in which a technical contradiction does not arise.

With respect to the liquid containing portion 21, the liquid containing body 20 that is detachably placed in the container 13 may be replaceable as in this embodiment, or the entire liquid containing portion 21 may be a tank in which the liquid is contained. Further, the liquid containing body 20 may be a liquid pack in which the liquid is contained in a bag-like container, or may be a tank in which the liquid is contained in a box-like container. Since the negative pressure may act inside the liquid containing portion 21 if the liquid is contained in the liquid containing portion 21 that is sealed, it is sufficient that the liquid containing portion 21 be sealed.

The control unit 29 may gradually reduce the amount of liquid the liquid feeding portion sucks 71, and gradually increase the number of times the liquid feeding portion 71 sucks the liquid, as the remaining amount Q3 of the liquid in the liquid containing portion 21 decreases.

The control unit 29 may gradually reduce the velocity at which the liquid feeding portion 71 sucks the liquid, as the remaining amount Q3 of the liquid in the liquid containing portion 21 decreases.

A first threshold value and a second threshold value may be set with respect to the remaining amount Q3 of the liquid. The control unit 29 may perform a first change in the driving control of the liquid feeding portion 71 when the remaining amount Q3 of the liquid in the liquid containing portion 21 has fallen below the first threshold value, and may perform a second change in the driving control of the liquid feeding portion 71 when the remaining amount Q3 has fallen below the second threshold value. For example, when the remaining amount Q3 has fallen below the first threshold value, the control unit 29 may reduce the amount of liquid the liquid feeding portion sucks 71 at one time, and at the same time, increase the number of times the liquid feeding portion 71 sucks the liquid, and when the remaining amount Q3 has fallen below the second threshold value, the control unit 29 may reduce the velocity at which the liquid feeding portion 71 sucks the liquid. Further, a third threshold value may further be set with respect to the remaining amount Q3 of the liquid. In other words, the control unit 29 may have a plurality of threshold values that cause the control unit 29 to change the driving control of the liquid feeding portion 71.

When the second threshold value is smaller than the first threshold value and greater than the amount of liquid in the liquid containing portion 21 obtained when the displacement detector 99 detects that the amount of liquid in the liquid storing portion 73 has fallen below the predetermined amount, when the remaining amount Q3 has fallen below the second threshold value, the acceptance of the recording job may be stopped until the liquid containing portion 21 is replaced with the new liquid containing portion 21. At this time, the control unit 29 may display, on the display unit 19*a*, the information indicating that the liquid in the liquid containing portion 21 has run out.

The liquid ejecting apparatus 11 may be the liquid ejecting apparatus 11 that ejects a liquid other than the ink. A state of the liquid ejected from the liquid ejecting apparatus 11 in the form of a small amount of liquid droplets also includes a granular state, a teardrop-like state, and a string-like state that leaves a trail. A liquid described herein may be any material that can be ejected from the liquid ejecting apparatus 11. For example, it is sufficient that the liquid be a substance in a state of a liquid phase, and the liquid includes a liquid state body having a high or low viscosity, and other fluid bodies such as sol, gel water, other inorganic solvents, organic solvents, solutions, liquid resins, liquid metals, and metal melts. The liquid includes not only a liquid as a state of a substance, but also a substance obtained by dissolving, dispersing, or mixing particles of a functional material formed of solid bodies, such as pigments or metal particles, in a solvent. Representative examples of the liquid include ink, liquid crystal, and the like described in the embodiments described above. Here, the ink includes general aqueous ink and solvent ink, and various liquid compositions such as gel ink, hot-melt ink, and the like. For example, specific examples of the liquid ejecting apparatus 11 include a device that ejects a liquid including a material, such as an electrode material and a color material, used for manufacturing liquid crystal displays, electroluminescent displays, surface emitting displays, color filters, and the like, in a dispersed or dissolved state. The liquid ejecting apparatus 11 may also be a device that ejects a bio-organic substance used for manufacturing biochips, a device that is used as a precision pipette configured to eject a liquid that becomes a sample, a printing device, a micro dispenser, or the like. The liquid ejecting apparatus 11 may also be a device that ejects lubricating oil onto a precision instrument, such as a watch and a camera, in a pinpoint manner, or a device that ejects a transparent liquid resin, such as an ultra-violet curing resin, onto a substrate to form a semispherical micro lens, an optical lens, or the like used for an optical communication element or the like. The liquid ejecting apparatus 11 may also be a device that ejects an etching solution, such as an acid or alkali etching solution, to perform etching on a substrate or the like.

Hereinafter, technical concepts and effects thereof that are understood from the above-described embodiments and modified examples will be described.

(A) A liquid ejecting apparatus includes a liquid ejection head configured to eject a liquid, a supply flow path configured to supply the liquid from a liquid containing portion to the liquid ejection head, the liquid containing portion being replaceable and configured to contain the liquid, a liquid feeding portion provided on the supply flow path and configured to suck the liquid from the liquid containing portion and feed the liquid to the liquid ejection head, and a control unit configured to control driving of the liquid feeding portion. The control unit changes driving control of the liquid feeding portion in accordance with a remaining amount of the liquid in the liquid containing portion.

According to this configuration, the control unit changes the driving control of the liquid feeding portion in accordance with the remaining amount in the liquid containing portion. As a result, a negative pressure acting when the remaining amount of liquid in the liquid containing portion becomes low can be adjusted. Thus, an amount of air bubbles flowing out of the liquid containing portion into the supply flow path can be suppressed.

(B) In the liquid ejecting apparatus described above, when the remaining amount of the liquid in the liquid containing portion falls below a threshold value, the control unit may reduce an amount of the liquid the liquid feeding portion sucks at one time, and may increase a number of times the liquid feeding portion sucks the liquid, compared to when the remaining amount of the liquid is equal to or greater than the threshold value.

According to this configuration, when the remaining amount of the liquid in the liquid containing portion becomes low, the negative pressure acting inside the liquid containing portion increases, and thus, the air bubbles easily flow into the liquid containing portion. Then, when the air bubbles flow out of the liquid containing portion into the supply flow path, an ejection failure occurs. Thus, when the remaining amount of the liquid in the liquid containing portion becomes low, the control unit reduces the amount of liquid the liquid feeding portion sucks at one time, and increases the number of times the liquid feeding portion sucks the liquid. As a result, when the remaining amount of the liquid in the liquid containing portion becomes low, the negative pressure acting inside the liquid containing portions can be suppressed without changing the amount of liquid to be fed. Thus, the amount of air bubbles flowing out of the liquid containing portion into the supply flow path can be suppressed.

(C) In the liquid ejecting apparatus described above, when the remaining amount of the liquid in the liquid containing portion falls below a threshold value, the control unit may reduce a velocity at which the liquid feeding portion sucks the liquid, compared to when the remaining amount of the liquid is equal to or greater than the threshold value.

According to this configuration, when the remaining amount of the liquid in the liquid containing portion becomes low, the negative pressure acting inside the liquid containing portion increases, and thus, the air bubbles easily flow into the liquid containing portion. Then, when the air bubbles flow out of the liquid containing portion into the supply flow path, the ejection failure occurs. Thus, when the remaining amount of the liquid in the liquid containing portion becomes low, the control unit reduces the velocity at which the liquid feeding portion sucks the liquid. As a result, when the remaining amount of the liquid in the liquid containing portion becomes low, the negative pressure acting inside the liquid containing portions can be suppressed without changing the amount of liquid to be fed. Thus, the amount of air bubbles flowing out of the liquid containing portion into the supply flow path can be suppressed.

(D) The liquid ejecting apparatus described above may include a liquid storing portion provided on the supply flow path between the liquid feeding portion and the liquid ejection head, and configured to store the liquid, and a detector configured to detect an amount of the liquid in the liquid storing portion. When a remaining amount of the liquid in the liquid containing portion is equal to or greater than a threshold value, the control unit may perform liquid feeding by the liquid feeding portion before an amount of the liquid in the liquid storing portion falls below a predetermined amount, and, after the remaining amount of the liquid in the liquid containing portion has fallen below the threshold value, the control unit may perform the liquid feeding by the liquid feeding portion after the amount of the liquid in the liquid storing portion has fallen below the predetermined amount.

According to this configuration, after the remaining amount of the liquid in the liquid containing portion has fallen below the threshold value, the liquid feeding portion feeds the liquid after the amount of liquid in the liquid storing portion has fallen below the predetermined amount. After the remaining amount of the liquid in the liquid containing portion has fallen below the threshold value, the negative pressure acting inside the liquid containing portion increases when the liquid feeding portion feeds the liquid. By stopping feeding the liquid by the liquid feeding portion until the amount of liquid in the liquid storing portion falls below the predetermined amount, the negative pressure acting inside the liquid containing portion can be suppressed during that time period. In other words, the number of times the high negative pressure acts inside the liquid containing portion can be reduced. As a result, since it becomes more difficult for the air bubbles to flow into the liquid containing portion, the amount of air bubbles flowing out of the liquid containing portion into the supply flow path can be suppressed.

(E) The liquid ejecting apparatus described above may include a liquid storing portion provided on the supply flow path between the liquid feeding portion and the liquid ejection head, and configured to store the liquid, and a detector configured to detect an amount of the liquid in the liquid storing portion. The control unit may include a counting unit configured to calculate the remaining amount of the liquid in the liquid containing portion, based on a contained amount reference value indicating an amount of the liquid contained in the liquid containing portion and on a discharge amount reference value indicating a discharge amount of the liquid discharged from the liquid ejection head, and a data storage portion configured to store the remaining amount obtained when the detector detects an amount of the liquid in the liquid storing portion falling below a predetermined amount. The control unit may correct the discharge amount reference value based on the remaining amount stored in the data storage portion.

According to this configuration, the data storage portion stores the remaining amount of the liquid in the liquid containing portion obtained when the detector detects that the amount of liquid in the liquid storing portion has fallen below the predetermined amount, and the control unit corrects the discharge amount reference value based on the remaining amount stored in the data storage portion. As a result, the accuracy of the counting unit calculating the remaining amount of the liquid in the liquid containing portion can be improved based on the contained amount reference value and the discharge amount reference value. Then, the driving control of the liquid feeding portion can be changed at a correct timing in accordance with the remaining amount of the liquid in the liquid containing portion. In other words, before the negative pressure starts acting inside the liquid containing portion, the negative pressure that will act inside the liquid containing portion can be adjusted by changing the driving control of the liquid feeding portion. Thus, the amount of air bubbles flowing out of the liquid containing portion into the supply flow path can be suppressed.

(F) In the liquid ejecting apparatus described above, after performing the correction of the discharge amount a predetermined number of times, based on a calculation result by the counting unit, the control unit may notify a user, in advance of detection by the detector, that the amount of liquid in the liquid storing portion has fallen below the predetermined amount.

According to this configuration, by the control unit performing the correction of the discharge amount reference value the predetermined number of times, the accuracy of the counting unit calculating the remaining amount of the liquid in the liquid containing portion can be further improved based on the discharge amount reference value. As a result, before the high negative pressure starts acting inside the liquid containing portion, it is possible to notify the user that the liquid containing portion has reached a replacement timing. Then, around a timing at which the liquid in the liquid containing portion has nearly run out, before the high negative pressure starts acting in the liquid containing portion, by the user replacing the liquid containing portion, it is possible to suppress the amount of air bubbles flowing out of the liquid containing portion into the supply flow path.

(G) A method for controlling a liquid ejecting apparatus is a method for controlling a liquid ejecting apparatus that includes a liquid ejection head configured to eject a liquid, a supply flow path configured to supply the liquid from a liquid containing portion, which is replaceable and contains the liquid, to the liquid ejection head, and a liquid feeding portion provided on the supply flow path and configured to suck the liquid from the liquid containing portion and feed the liquid to the liquid ejection head. The method includes changing driving control of the liquid feeding portion in accordance with a remaining amount of the liquid in the liquid containing portion.

According to this method, the same effects as those of the liquid ejecting apparatus according to (A) described above are obtained.

(H) In the method for controlling the liquid ejecting apparatus described above, when a remaining amount of the liquid in the liquid containing portion falls below a threshold value, an amount of the liquid the liquid feeding portion sucks at one time may be reduced, and a number of times the liquid feeding portion sucks the liquid may be increased, compared to when the remaining amount of the liquid is equal to or greater than the threshold value.

According to this method, the same effects as those of the liquid ejecting apparatus according to (B) described above are obtained.

(I) In the method for controlling the liquid ejecting apparatus described above, when a remaining amount of the liquid in the liquid containing portion falls below a threshold value, a velocity at which the liquid feeding portion sucks the liquid may be reduced, compared to when the remaining amount of the liquid is equal to or greater than the threshold value.

According to this method, the same effects as those of the liquid ejecting apparatus according to (C) described above are obtained.

(J) In the method for controlling the liquid ejecting apparatus described above, the liquid ejecting apparatus may include a liquid storing portion provided on the supply flow path between the liquid feeding portion and the liquid ejection head, and configured to store the liquid, and a detector configured to detect an amount of the liquid in the liquid storing portion. The method may include, when a remaining amount of the liquid in the liquid containing portion is equal to or greater than a threshold value, performing liquid feeding by the liquid feeding portion before an amount of the liquid in the liquid storing portion falls below a predetermined amount, and, after the remaining amount of the liquid in the liquid containing portion has fallen below the threshold value, performing the liquid feeding by the liquid feeding portion after the amount of the liquid in the liquid storing portion has fallen below the predetermined amount.

According to this method, the same effects as those of the liquid ejecting apparatus according to (D) described above are obtained.

(K) In the method for controlling the liquid ejecting apparatus described above, the liquid ejecting apparatus may include a liquid storing portion provided on the supply flow path between the liquid feeding portion and the liquid ejection head, and configured to store the liquid, and a detector configured to detect an amount of the liquid in the liquid storing portion. The method may include calculating a remaining amount of the liquid in the liquid containing portion based on a contained amount reference value indicating an amount of the liquid contained in the liquid containing portion and on a discharge amount reference value indicating a discharge amount of the liquid discharged from the liquid ejection head, storing the remaining amount obtained when the detector detects an amount of the liquid in the liquid storing portion falling below a predetermined amount, correcting the discharge amount reference value based on the remaining amount stored, and, after performing the correction of the discharge amount a predetermined number of times, based on a calculation result, notifying a user, in advance of detection by the detector, that the amount of liquid in the liquid storing portion fell below the predetermined amount.

According to this method, the same effects as those of the liquid ejecting apparatus according to (E) and (F) described above are obtained.

What is claimed is:

1. A liquid ejecting apparatus comprising:

a liquid ejection head configured to eject a liquid;

a supply flow path configured to supply the liquid from a liquid containing portion to the liquid ejection head, the liquid containing portion being replaceable and configured to contain the liquid;

a liquid feeding portion provided on the supply flow path and configured to suck the liquid from the liquid containing portion and feed the liquid to the liquid ejection head; and a control unit configured to control driving of the liquid feeding portion, wherein the control unit changes driving control of a suction of the liquid feeding portion in accordance with a remaining amount of the liquid in the liquid containing portion.

2. The liquid ejecting apparatus according to claim 1, wherein when the remaining amount of the liquid in the liquid containing portion falls below a threshold value, the control unit reduces an amount of the liquid that the liquid feeding portion sucks at one time, and increases a number of times that the liquid feeding portion sucks the liquid, compared to when the remaining amount of the liquid is equal to or greater than the threshold value.

3. The liquid ejecting apparatus according to claim 1, wherein when the remaining amount of the liquid in the liquid containing portion falls below a threshold value, the control unit reduces a velocity at which the liquid feeding portion sucks the liquid, compared to when the remaining amount of the liquid is equal to or greater than the threshold value.

4. The liquid ejecting apparatus according to claim 1, comprising:

a liquid storing portion provided on the supply flow path between the liquid feeding portion and the liquid ejection head, and configured to store the liquid; and a detector configured to detect an amount of the liquid in the liquid storing portion, wherein when the remaining amount of the liquid in the liquid containing portion is equal to or greater than a threshold value, the control unit performs liquid feeding by the liquid feeding portion before an amount of the liquid in the liquid storing portion falls below a predetermined amount, and, after the remaining amount of the liquid in the liquid containing portion falls below the threshold value, the control unit performs the liquid feeding by the liquid feeding portion after the amount of the liquid in the liquid storing portion falls below the predetermined amount.

5. The liquid ejecting apparatus according to claim 1, comprising:

a liquid storing portion provided on the supply flow path between the liquid feeding portion and the liquid ejection head, and configured to store the liquid; and a detector configured to detect an amount of the liquid in the liquid storing portion, wherein the control unit includes a counting unit configured to calculate the remaining amount of the liquid in the liquid containing portion, based on a contained amount reference value indicating an amount of the liquid contained in the liquid containing portion and on a discharge amount reference value indicating a discharge amount of the liquid discharged from the liquid ejection head, and a data storage portion configured to store the remaining amount obtained when the detector detects that an amount of the liquid in the liquid storing portion falls below a predetermined amount, and the control unit corrects the discharge amount reference value based on the remaining amount stored in the data storage portion.

6. The liquid ejecting apparatus according to claim 5, wherein after performing the correction of the discharge amount reference value a predetermined number of times, based on a calculation result by the counting unit, the control unit notifies a user, in advance of detection by the detector, that the amount of liquid in the liquid storing portion falls below the predetermined amount.

7. A method for controlling a liquid ejecting apparatus that includes a liquid ejection head configured to eject a liquid, a supply flow path configured to supply the liquid from a liquid containing portion, which is replaceable and contains the liquid, to the liquid ejection head, and a liquid feeding portion provided on the supply flow path and configured to suck the liquid from the liquid containing portion and feed the liquid to the liquid ejection head, the method comprising:

changing driving control of a suction of the liquid feeding portion in accordance with a remaining amount of the liquid in the liquid containing portion.

8. The method for controlling the liquid ejecting apparatus according to claim 7, wherein when the remaining amount of the liquid in the liquid containing portion falls below a threshold value, an amount of the liquid that the liquid feeding portion sucks at one time is reduced, and a number of times that the liquid feeding portion sucks the liquid is increased, compared to when the remaining amount of the liquid is equal to or greater than the threshold value.

9. The method for controlling the liquid ejecting apparatus according to claim 7, wherein when the remaining amount of the liquid in the liquid containing portion falls below a threshold value, a velocity at which the liquid feeding portion sucks the liquid is reduced, compared to when the remaining amount of the liquid is equal to or greater than the threshold value.

10. The method for controlling the liquid ejecting apparatus according to claim 7, wherein the liquid ejecting apparatus includes a liquid storing portion provided on the supply flow path between the liquid feeding portion and the liquid ejection head, and configured to store the liquid, and a detector configured to detect an amount of the liquid in the liquid storing portion, and the method comprises:

when the remaining amount of the liquid in the liquid containing portion is equal to or greater than a threshold value, performing liquid feeding by the liquid feeding portion before an amount of the liquid in the liquid storing portion falls below a predetermined amount; and after the remaining amount of the liquid in the liquid containing portion falls below the threshold value, performing the liquid feeding by the liquid feeding portion after the amount of the liquid in the liquid storing portion falls below the predetermined amount.

11. The method for controlling the liquid ejecting apparatus according to claim 7, wherein the liquid ejecting apparatus includes a liquid storing portion provided on the supply flow path between the liquid feeding portion and the liquid ejection head, and configured to store the liquid, and a detector configured to detect an amount of the liquid in the liquid storing portion, and the method comprises:

calculating the remaining amount of the liquid in the liquid containing portion based on a contained amount reference value indicating an amount of the liquid contained in the liquid containing portion and on a discharge amount reference value indicating a discharge amount of the liquid discharged from the liquid ejection head;

storing the remaining amount obtained when the detector detects that an amount of the liquid in the liquid storing portion falls below a predetermined amount;

correcting the discharge amount reference value based on the remaining amount stored; and after performing the correction of the discharge amount reference value a predetermined number of times, based on a calculation result, notifying a user, in advance of detection by the detector, that the amount of liquid in the liquid storing portion falls below the predetermined amount.

* * * * *